US011982087B2

(12) United States Patent
McManus et al.

(10) Patent No.: US 11,982,087 B2
(45) Date of Patent: May 14, 2024

(54) TILE AND SUPPORT STRUCTURE

(71) Applicant: MBRICO, LLC, Bettendorf, IA (US)

(72) Inventors: Mark A. McManus, Bettendorf, IA (US); Jason McManus, Bettendorf, IA (US); Nicholas McManus, Le Claire, IA (US)

(73) Assignee: MBRICO, LLC, Bettendorf, IA (US)

( * ) Notice: Subject to any disclaimer, the term of this patent is extended or adjusted under 35 U.S.C. 154(b) by 0 days.

(21) Appl. No.: 16/877,037

(22) Filed: May 18, 2020

(65) Prior Publication Data

US 2020/0362564 A1 Nov. 19, 2020

Related U.S. Application Data

(60) Provisional application No. 62/884,964, filed on Aug. 9, 2019, provisional application No. 62/849,545, filed on May 17, 2019.

(51) Int. Cl.
*E04D 12/00* (2006.01)
*E04D 1/12* (2006.01)
(Continued)

(52) U.S. Cl.
CPC ..... *E04D 12/00* (2013.01); *E04D 1/12* (2013.01); *E04F 15/02194* (2013.01); *E04F 15/02458* (2013.01); *E04F 15/02183* (2013.01)

(58) Field of Classification Search
CPC ..... E04D 12/00; E04D 1/12; E04F 15/02194; E04F 15/02458; E04F 15/02183
See application file for complete search history.

(56) References Cited

U.S. PATENT DOCUMENTS 1,395,423 A 11/1921 Richard
1,399,088 A 12/1921 William
(Continued)

FOREIGN PATENT DOCUMENTS

DE 3405755 A1 12/1985
DE 202013102695 U1 7/2013
(Continued)

OTHER PUBLICATIONS

PCT/US2016/058511 International Search Report and Written Opinion, Apr. 13, 2017.

*Primary Examiner* — Brian D Mattei
*Assistant Examiner* — Omar F Hijaz
(74) *Attorney, Agent, or Firm* — SHUTTLEWORTH & INGERSOLL, PLC; Jason R. Sytsma

(57) ABSTRACT

In one aspect of a bottom indexing tile and support structure, a bottom indexing support structure may be engaged with a top portion of a pedestal. The bottom indexing support structure may be formed with a generally vertical spine having at least one rail extending outward from a distal end thereof and may also include one or more ridges extending upward in a direction parallel to the spine. The spine and rail(s) may be configured to secure one or more bottom indexing tiles, which tiles may be formed with a groove on at least one edge thereof, and wherein one or more rails may be positioned within the groove. The bottom indexing tile may be formed with one or more channels on a bottom surface thereof, wherein each channel may correspond with a ridge of the bottom indexing support structure.

21 Claims, 71 Drawing Sheets

(51) Int. Cl.
*E04F 15/02* (2006.01)
*E04F 15/024* (2006.01)

(56) References Cited

U.S. PATENT DOCUMENTS

RE16,416 E 9/1926 Whittaker
2,033,404 A 3/1936 Charles
2,063,457 A 12/1936 Nold et al.
2,183,450 A 12/1939 Domenico
2,382,761 A 8/1945 Wilks
2,665,104 A 1/1954 Myers
3,027,140 A 3/1962 Holzbach
3,061,055 A 10/1962 Nijhuis
3,065,506 A 11/1962 Tremer
3,180,460 A 4/1965 Liskey, Jr.
3,271,916 A 9/1966 Omholt
3,295,272 A 1/1967 Tomonobu
3,348,459 A 10/1967 Harvey
3,379,104 A 4/1968 Scholl
3,385,183 A 5/1968 Kortz
3,398,933 A 8/1968 Haroldson
3,443,350 A 5/1969 Birum, Jr.
3,487,756 A 1/1970 Glaza et al.
3,553,919 A 1/1971 Omholt
3,555,762 A 1/1971 Costanzo, Jr.
3,557,670 A 1/1971 Sutton
3,566,561 A 3/1971 Tozer
3,645,054 A 2/1972 Olvera
3,712,016 A * 1/1973 Reeve ..... E04F 15/02194 52/741.4
3,757,485 A 9/1973 Vincens
3,784,312 A 1/1974 Gordon
3,840,908 A 10/1974 Greene
3,902,215 A 9/1975 Waldrop et al.
3,909,145 A 9/1975 Ayer et al.
3,961,453 A 6/1976 Couwenbergs
3,979,866 A 9/1976 Prescott
4,024,683 A 5/1977 Kilian
4,067,161 A 1/1978 Rensch
4,077,334 A 3/1978 Svirklys
4,220,378 A 9/1980 Bienek
4,266,381 A 5/1981 Deller
4,320,613 A 3/1982 Kaufman
4,395,858 A 8/1983 Gwyther
4,400,925 A 8/1983 Van Loghem et al.
4,408,427 A 10/1983 Zilch
4,432,177 A 2/1984 Amesso et al.
4,546,580 A 10/1985 Ueno et al.
4,573,299 A 3/1986 Meroni
4,599,842 A 7/1986 Counihan
4,601,137 A 7/1986 Bates
4,624,084 A 11/1986 Esposito
4,648,231 A 3/1987 Laroche
4,716,704 A 1/1988 Murr
4,719,127 A 1/1988 Greenberg
4,719,727 A 1/1988 Cooper et al.
4,736,555 A 4/1988 Nagare et al.
4,835,924 A 6/1989 Blacklin et al.
4,895,335 A 1/1990 Oliver
4,911,971 A 3/1990 McCue et al.
RE33,220 E 5/1990 Collier
4,947,610 A 8/1990 Koerner
5,050,361 A 9/1991 Hallsten
D320,685 S 10/1991 Huang
5,083,410 A 1/1992 Watson
5,090,170 A 2/1992 Propst
5,111,627 A 5/1992 Brown
5,205,942 A 4/1993 Fitzgerald
5,325,646 A 7/1994 Hallsten et al.
5,333,423 A 8/1994 Propst
5,361,554 A 11/1994 Bryan
5,390,468 A 2/1995 Probst
5,394,667 A 3/1995 Nystrom
5,396,734 A 3/1995 Frey
5,409,192 A 4/1995 Oliver
5,456,189 A 10/1995 Belle Isle
5,483,776 A 1/1996 Poppe
5,497,593 A 3/1996 Riesberg
5,501,754 A 3/1996 Hiraguri
5,553,427 A 9/1996 Andres
5,588,264 A 12/1996 Buzon
5,606,840 A 3/1997 Hase
5,623,803 A 4/1997 Willis
5,660,016 A 8/1997 Erwin et al.
5,729,948 A 3/1998 Levy et al.
5,758,467 A 6/1998 Snear et al.
5,765,329 A 6/1998 Huang
5,775,048 A 7/1998 Orchard
5,778,621 A 7/1998 Randjelovic
5,806,897 A 9/1998 Nagai et al.
5,813,180 A 9/1998 Whitney et al.
5,840,078 A 11/1998 Yerys
5,850,720 A 12/1998 Willis
5,881,508 A 3/1999 Irvine et al.
5,906,082 A 5/1999 Counihan
5,913,784 A 6/1999 Hite
5,921,030 A 7/1999 Ducotey et al.
5,927,041 A 7/1999 Sedlmeier et al.
5,953,878 A 9/1999 Johnson
5,992,109 A 11/1999 Jonker
5,997,209 A 12/1999 Sachs
6,044,598 A 4/2000 Elsasser et al.
6,050,034 A 4/2000 Krinner
6,122,873 A 9/2000 Randjelovic
6,170,212 B1 1/2001 Suchyna et al.
6,189,289 B1 2/2001 Quaglia et al.
6,199,340 B1 3/2001 Davis
6,226,950 B1 5/2001 Davis
6,233,886 B1 5/2001 Andres
6,279,282 B1 8/2001 Krionidis
6,338,229 B1 1/2002 Botzen
6,363,674 B1 4/2002 Carver
6,430,883 B1 8/2002 Paz et al.
6,470,641 B1 10/2002 Faure
6,502,791 B2 1/2003 Parker
D470,039 S 2/2003 Pelc
6,550,206 B2 4/2003 Lee
6,584,748 B2 7/2003 Bresnahan
6,594,961 B2 7/2003 Leines
6,694,691 B2 2/2004 Ku
6,695,541 B1 2/2004 Spence
6,711,864 B2 3/2004 Erwin
6,729,097 B2 5/2004 Patel et al.
6,863,768 B2 3/2005 Haffner et al.
6,871,467 B2 3/2005 Hafner
6,883,287 B2 4/2005 Niese et al.
6,901,715 B2 6/2005 Brown et al.
6,941,715 B2 9/2005 Potter
6,973,881 B2 12/2005 Bianchi
D522,147 S 5/2006 Morton et al.
7,047,697 B1 5/2006 Heath
7,171,790 B2 * 2/2007 Mei ..... E04F 15/04 52/584.1
7,409,803 B2 8/2008 Grohman
7,454,869 B2 11/2008 Owen
7,600,353 B2 10/2009 Hafner
7,621,089 B2 11/2009 Potter
7,730,693 B2 6/2010 Schrotenboer
7,818,925 B2 10/2010 Benedict
7,836,659 B1 11/2010 Barnes
7,908,812 B2 3/2011 Eberle, III
7,958,688 B2 6/2011 Lop et al.
7,984,599 B2 7/2011 Snell et al.
8,002,943 B2 8/2011 Brown et al.
8,006,458 B1 8/2011 Olofsson
8,011,153 B2 9/2011 Orchard
8,056,303 B2 11/2011 Frobosilo
8,066,464 B1 11/2011 Van Dyke
8,087,206 B1 1/2012 Worley et al.
8,127,505 B2 3/2012 Lu et al.
8,156,694 B2 4/2012 Knight, III et al.
8,177,385 B2 5/2012 Porciatti
8,225,581 B2 7/2012 Strickland et al.
D667,143 S 9/2012 Swanson

(56) References Cited

U.S. PATENT DOCUMENTS

| | | | |
|---|---|---|---|
| 8,256,172 | B2 | 9/2012 | Benson |
| 8,297,004 | B2 | 10/2012 | Knight, III et al. |
| 8,302,356 | B2 | 11/2012 | Knight et al. |
| 8,375,672 | B2 | 2/2013 | Hannig |
| 8,381,461 | B2 | 2/2013 | Repasky |
| 8,387,317 | B2 | 3/2013 | Kugler et al. |
| 8,464,488 | B2 | 6/2013 | Pelc, Jr. |
| 8,505,257 | B2 | 8/2013 | Boo et al. |
| 8,511,014 | B2 | 8/2013 | Delforte |
| 8,516,762 | B1 | 8/2013 | Jendusa |
| D704,864 | S | 5/2014 | Chang |
| 8,769,895 | B2 | 7/2014 | Amend |
| 8,806,826 | B2 | 8/2014 | Mann |
| 8,844,243 | B1 | 9/2014 | Gillman |
| 8,869,481 | B2 | 10/2014 | Dzigava |
| 8,919,068 | B2 | 12/2014 | Wright et al. |
| 8,925,263 | B2 | 1/2015 | Haddock et al. |
| 8,984,818 | B2 | 3/2015 | McPheeters et al. |
| D728,185 | S | 4/2015 | Pelc et al. |
| 9,010,068 | B2 | 4/2015 | Sullivan et al. |
| 9,109,367 | B2 | 8/2015 | Plozner |
| 9,151,063 | B2 | 10/2015 | McManus |
| 9,180,941 | B1 | 11/2015 | Vandenworm |
| 9,181,715 | B2 | 11/2015 | Orchard |
| 9,181,717 | B1 | 11/2015 | Jamison |
| 9,187,899 | B2 | 11/2015 | Nam |
| 9,290,889 | B2 | 3/2016 | Choo |
| 9,314,936 | B2 | 4/2016 | Pervan |
| 9,347,227 | B2 | 5/2016 | Ramachandra et al. |
| 9,410,296 | B2 | 8/2016 | Tabibnia |
| 9,435,113 | B2 | 9/2016 | Brandt et al. |
| 9,447,643 | B2 | 9/2016 | Jack et al. |
| 9,534,377 | B2 | 1/2017 | Lee |
| 9,551,158 | B1 | 1/2017 | Leines |
| 9,580,914 | B2 | 2/2017 | Fountain |
| 9,624,677 | B2 | 4/2017 | Wright |
| 9,637,934 | B2 | 5/2017 | Wadsworth |
| 9,868,147 | B2 | 1/2018 | Wadsworth |
| 10,247,222 | B2 | 4/2019 | Bertovic |
| 10,415,191 | B2 | 9/2019 | Tabibnia |
| 10,605,288 | B2 | 3/2020 | Martel et al. |
| 2002/0059766 | A1 | 5/2002 | Gregori |
| 2002/0078638 | A1 | 6/2002 | Huang |
| 2003/0046895 | A1 | 3/2003 | Haffner et al. |
| 2003/0074853 | A1 | 4/2003 | Potter |
| 2003/0101673 | A1 | 6/2003 | West et al. |
| 2003/0154662 | A1 | 8/2003 | Bruchu et al. |
| 2003/0188500 | A1 | 10/2003 | Voegele |
| 2004/0244325 | A1 | 12/2004 | Nelson |
| 2006/0059822 | A1 | 3/2006 | Guffey |
| 2006/0220276 | A1 | 10/2006 | Giuliani |
| 2007/0113511 | A1 | 5/2007 | Greiner |
| 2009/0019805 | A1 | 1/2009 | Zanelli |
| 2009/0173018 | A1 | 7/2009 | Buzon |
| 2011/0315646 | A1 | 12/2011 | Otsubo |
| 2012/0047834 | A1 | 3/2012 | Stal et al. |
| 2012/0151867 | A1 | 6/2012 | Smith et al. |
| 2012/0291369 | A1 | 11/2012 | Knight, III et al. |
| 2013/0205703 | A1 | 8/2013 | Baumer |
| 2013/0283710 | A1 | 10/2013 | Laurin et al. |
| 2014/0007525 | A1 | 1/2014 | Wright |
| 2014/0349084 | A1 | 11/2014 | Patki et al. |
| 2015/0275500 | A1 | 10/2015 | Dalla et al. |
| 2017/0037631 | A1* | 2/2017 | McManus ..... E04F 15/082 |

FOREIGN PATENT DOCUMENTS

| | | | |
|---|---|---|---|
| EP | 2669444 | A2 | 12/2013 |
| FR | 2761095 | A1 | 9/1998 |
| GB | 2371609 | A | 7/2002 |
| JP | 4238954 | A | 8/1992 |
| JP | 09256603 | A * | 9/1997 |
| JP | 2008240417 | A | 10/2008 |
| JP | 2008285953 | A | 11/2008 |
| JP | 2010144372 | A | 7/2010 |
| WO | 2012060488 | A1 | 5/2012 |

* cited by examiner

TILE AND SUPPORT STRUCTURE

CROSS REFERENCE TO RELATED APPLICATIONS

This utility patent application claims priority from provisional U.S. Pat. App. Nos. 62/849,545 filed on May 17, 2019 and 62/884,964 filed on Aug. 9, 2019 all of which applications are incorporated by reference herein in their entireties.

FIELD OF THE INVENTION

The present disclosure relates to a tile and tile support structure allowing use of placement of porcelain tiles for tiled surfaces, such as outdoor deck systems and/or roof systems.

AUTHORIZATION PURSUANT TO 37 C.F.R. § 1.171 (c)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BRIEF DESCRIPTION OF FIGURES

The accompanying drawings, which are incorporated in and constitute a part of this specification, illustrate embodiments and together with the description, serve to explain the principles of the methods and systems.

FIG. 22B-23B provide various top views of a support system that may be engaged with a pedestal.

DETAILED DESCRIPTION-LISTING OF THE ELEMENTS

Figure 1:
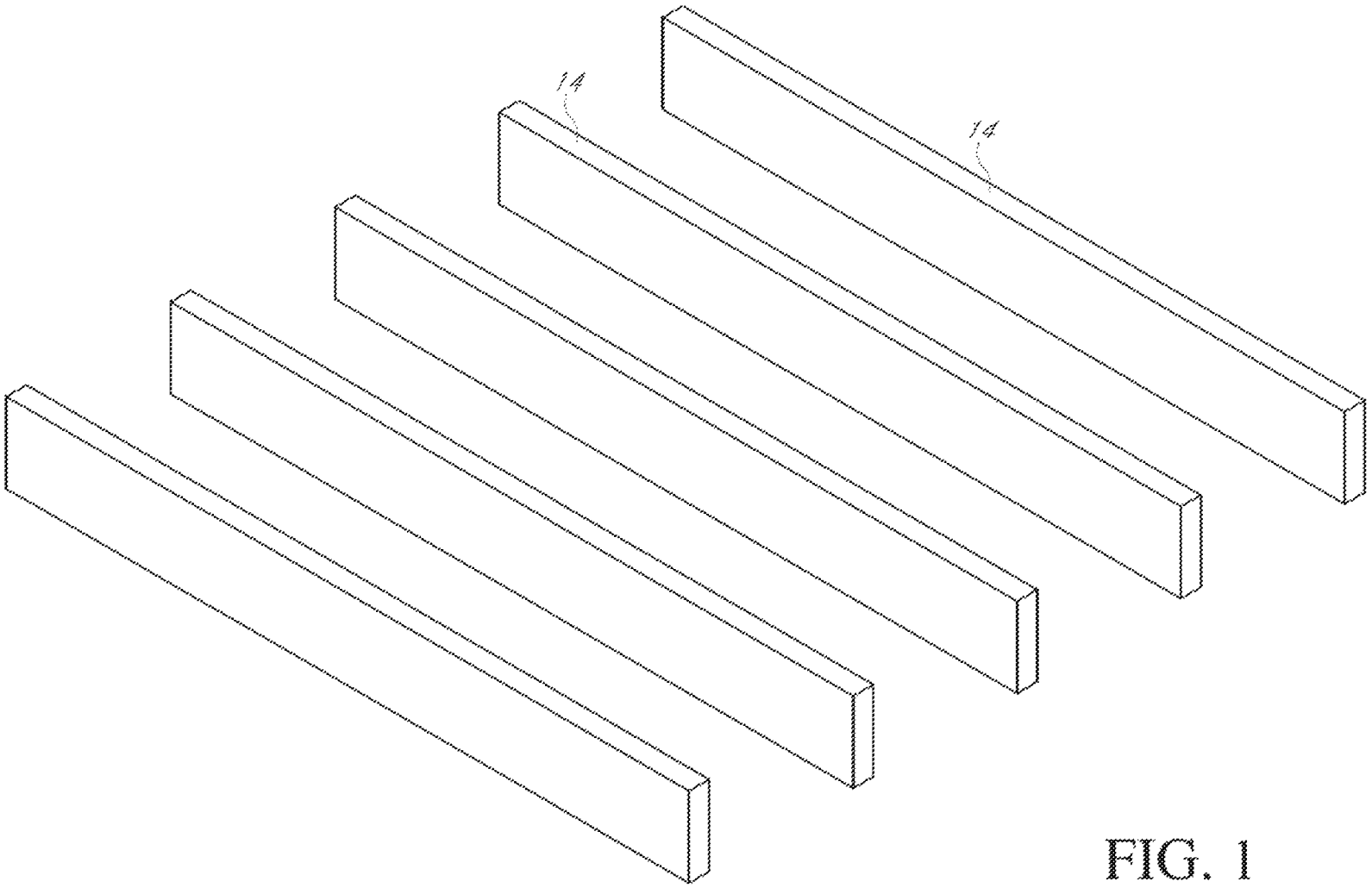
FIG. 1 (PRIOR ART)
FIG. 1 is a perspective view of one arrangement of a plurality of illustrative joists configured in a manner that is typical for a building structure.

| Element Description | Element Number |
|---|---|
| Tile & support structure | 10 |
| Deck | 12 |
| Joist | 14 |
| Fastener | 16 |
| Substrate | 18 |
| Lath | 19 |
| Tile | 20 |
| Face | 22 |
| Edge | 24 |
| Groove | 24a |
| Protrusion | 24b |
| Clearance | 25 |
| Support structure | 30 |
| Edge support structure | 30a |
| Base | 31 |
| Flange | 32 |
| Trough | 32a |
| Aperture | 32b |
| Lip | 33 |
| Spine | 34 |
| Tip | 34a |
| Rail | 36 |
| Anchor | 38 |
| Roof support structure | 30' |
| Roof edge support structure | 30a' |
| Base | 31' |
| Flange | 32' |
| Trough | 32a' |
| Aperture | 32b' |
| Lip | 33' |
| Spine | 34' |
| Tip | 34a' |
| Rail | 36' |
| Channel portion | 37' |
| Side member | 37a' |
| Notch | 37b' |
| Bottom member | 37c' |
| Inner member | 40 |
| Inner member bottom | 42 |
| Inner member side | 44 |
| Pedestal | 50 |
| Pedestal base | 52 |
| Adjustment portion | 53 |
| Pedestal upper surface | 54 |
| Lug | 55 |
| Retaining element | 60 |
| Neck | 62 |
| Retaining element | 60' |
| Neck | 62' |
| Securement clip | 70 |
| Vertical member | 72 |
| Ramp | 72a |
| Catch | 72b |
| Base member | 74 |
| Reinforced tile | 120 |
| Substrate | 120a |
| Support structure | 130 |
| Base | 131 |
| Flange | 132 |
| Trough | 132a |
| Aperture | 132b |
| Lip | 133 |
| Spine | 134 |
| Tip | 134a |
| Rail | 136 |
| Receiver portion | 137 |
| Groove | 137a |
| Engagement surface | 137b |
| Vertical limiter | 137c |
| Tile and support structure | 210 |
| Riser tile | 220a |
| Horizontal end tile | 220b |

-continued

| DETAILED DESCRIPTION-LISTING OF THE ELEMENTS | |
|---|---|
| Element Description | Element Number |
| Face | 222 |
| Edge | 224 |
| Groove | 224a |
| Substrate | 228 |
| Upper riser support structure | 230a |
| Lower riser support structure | 230b |
| Base | 231 |
| Flange | 232 |
| Trough | 232a |
| Aperture | 232b |
| Lip | 233 |
| Spine | 234 |
| Tip | 234a |
| Rail | 236 |
| Bottom indexing tile and support structure | 310 |
| Plug | 312 |
| Bottom indexing tile | 320 |
| Substrate | 320a |
| Face | 322 |
| Bracket | 323 |
| Edge | 324 |
| Groove | 324a |
| Protrusion | 324b |
| Clearance | 325 |
| Channel | 326 |
| Cavity | 328 |
| Bottom indexing support structure | 330 |
| Wing portion | 330a |
| Base | 331 |
| Flange | 332 |
| Trough | 332a |
| Drain | 332b |
| Lip | 333 |
| Spine | 334 |
| Tip | 334a |
| Ridge | 335 |
| Rail | 336 |
| Channel portion | 337 |
| Side member | 337a |
| Notch | 337b |
| Bottom member | 337c |
| Center portion | 338 |
| Aperture | 338a |
| Center wall | 338b |
| Bottom indexing pedestal | 350 |
| Pedestal base | 352 |
| Adjustment portion | 353 |
| Pedestal upper surface | 354 |

DETAILED DESCRIPTION OF INVENTION

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes¬from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed herein are various components that may be used to perform the disclosed methods and provide the disclosed systems. These in addition to other components that may be compatible with the disclosed methods and systems, and it is understood that when combinations, subsets, interactions, groups, etc. of these components are disclosed, that while specific reference of each various individual and collective combinations and permutation of these may not be explicitly disclosed, each is specifically contemplated and described herein, for all methods and systems of the present disclosure. This applies to all aspects of this disclosure including, but not limited to, steps in disclosed methods. Thus, if there are a variety of additional steps that may be performed, it is understood that each of these additional steps may be performed with any specific aspects or combination of aspects of the disclosed methods.

The present methods and systems may be understood more readily by reference to the following detailed description of systems and methods (including the various aspects thereof) and the examples included therein and to the Figures and their following description. Further, although some figures included herewith show various dimensions of some features of certain illustrative aspects of certain components of the present disclosure, such dimensions are for illustrative purposes only and in no way limit the scope of the present disclosure unless so indicated in the following claims.

The following detailed description is of the best currently contemplated modes of carrying out the present methods and systems. The description is not to be taken in a limiting sense, but is made merely for the purpose of illustrating the general principles of the various aspects of the present disclosure, since the scope of the invention is best defined by the appending claims. Various inventive features are described below herein that can each be used independently of one another or in combination with other features without limitation unless so indicated in the following claims.

A group of joists 14 in a typical arrangement is shown in FIG. 1, wherein the joists 14 are oriented parallel with respect to one another about their lengths. It is contemplated that in certain illustrative aspects of a tile and support structure 10 as disclosed herein, the tile and support structure 10 may be adapted for use with such joists 14 and/or arrangements thereof. However, the tile and support structure 10 may be used with other structures, structural components, and/or surfaces as described in detail below, and the use of joists 14 is therefore in no way limiting to the scope of the present disclosure unless so indicated in the following claims.

Figure 2:
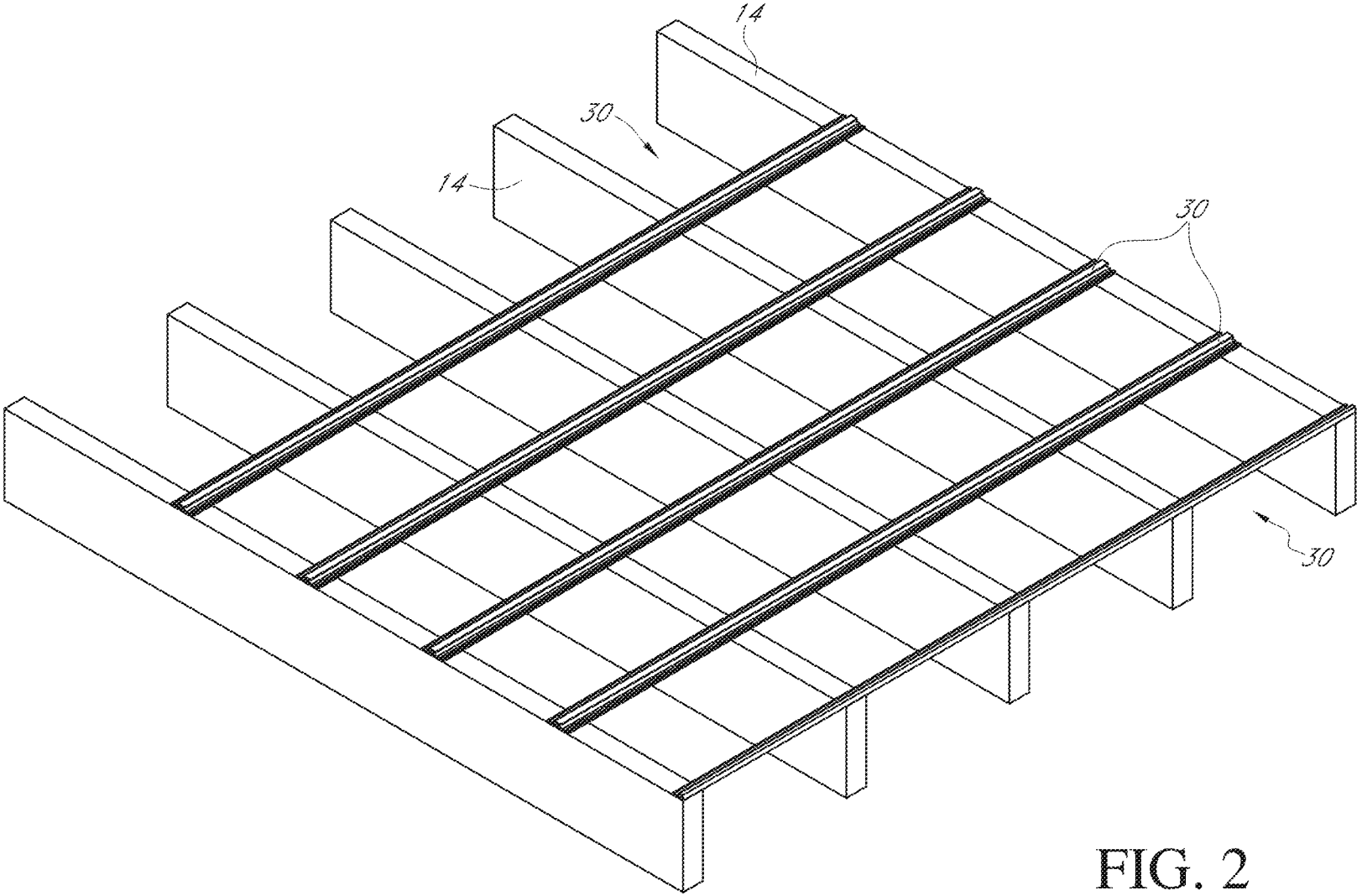
FIG. 2 is a perspective view of the joists from FIG. 1 having a plurality of illustrative support structures engaged with the joists.

As shown in FIG. 2, a plurality of support structures 30 may be engaged with the joists 14 such that the support structures 30 may be oriented parallel with respect to one another along their lengths. It is contemplated that the support structures 30 may be engaged with the top edge of the joists 14 via one or more fasteners 16 in a manner similar to that in which decking material may be engaged with joists 14. In one aspect, the fasteners 16 may be configured as wood screws. However, the specific method and/or structure used to engage the support structures 30 with the joists 14 (or other structure, structural component, and/or surface) in no way limits the scope of the present disclosure unless so indicated in the following claims. Additionally, the support structures 30 may be oriented such that they are not perpendicular with respect to the joists 14 (or other structure, structural component, and/or surface), but such that the support structures 30 are still oriented parallel with respect to one another without limitation unless so indicated in the following claims.

The support structures 30 may be configured such that they are oriented perpendicular with respect to the joists 14. In such a configuration, the joists 14 and support structures 30 may form a grid. In certain aspects it may be advantageous to position a cross lathe (not shown) under each support structure 30. In one aspect, the cross lathe may be configured as a wooden one-by-three inch board, a wooden one-by-four inch board, or any other suitable structure without limitation, including but not limited to plastic and/or polymer strips, unless so indicated in the following claims. The cross lathe and support structure 30 may be engaged with one another and the joists 14 and the relative positions thereof secured via one or more fasteners 16. It is contemplated that such a configuration may be especially useful if there is a reasonable likelihood that the position of the joists 14 and/or other underlying structure might shift over time. Accordingly, the scope of the present disclosure is in no way limited by whether a cross lathe is used unless so indicated in the following claims. Furthermore, the specific method and/or structure used to engage the cross lathes with the joists 14 and/or support structures 30 in no way limits the scope of the present disclosure unless so indicated in the following claims.

Figure 3:
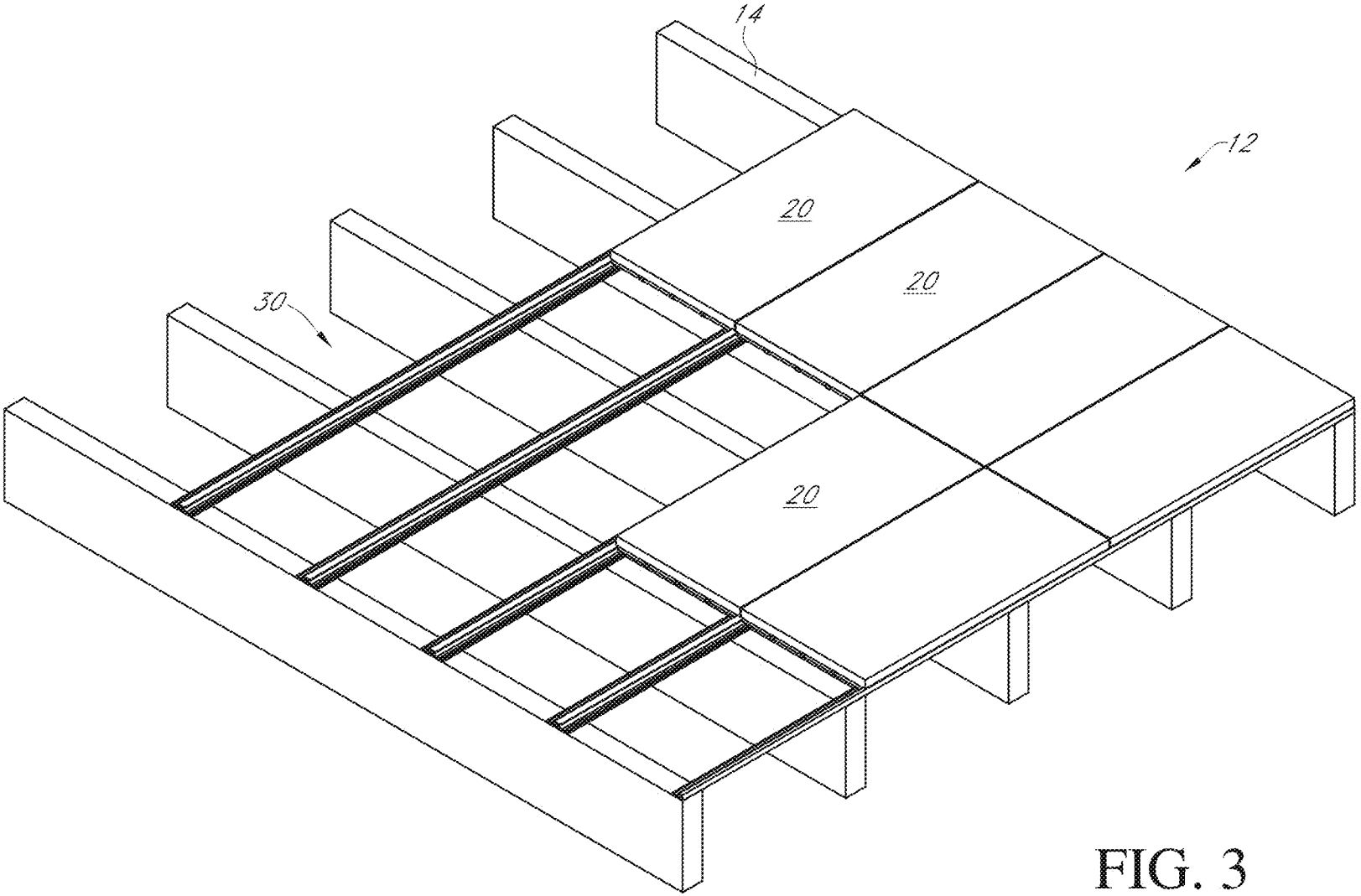
FIG. 3 is a perspective view of the joists and support structures from FIG. 2 wherein a plurality of illustrative tiles are engaged with the support structures.
Figure 4:
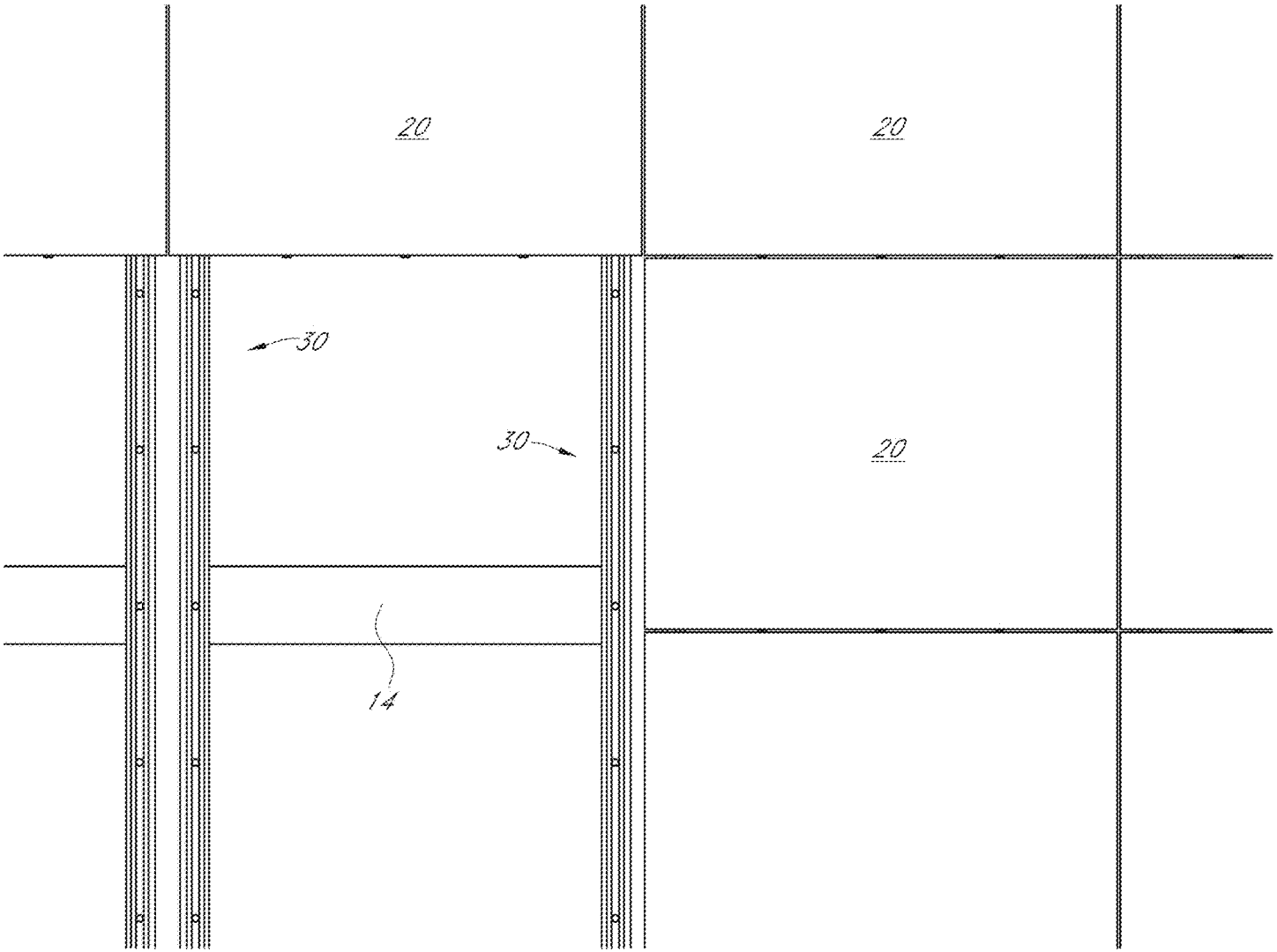
FIG. 4 is a top view of the support structures and tiles shown in FIG. 3.
Figure 5:
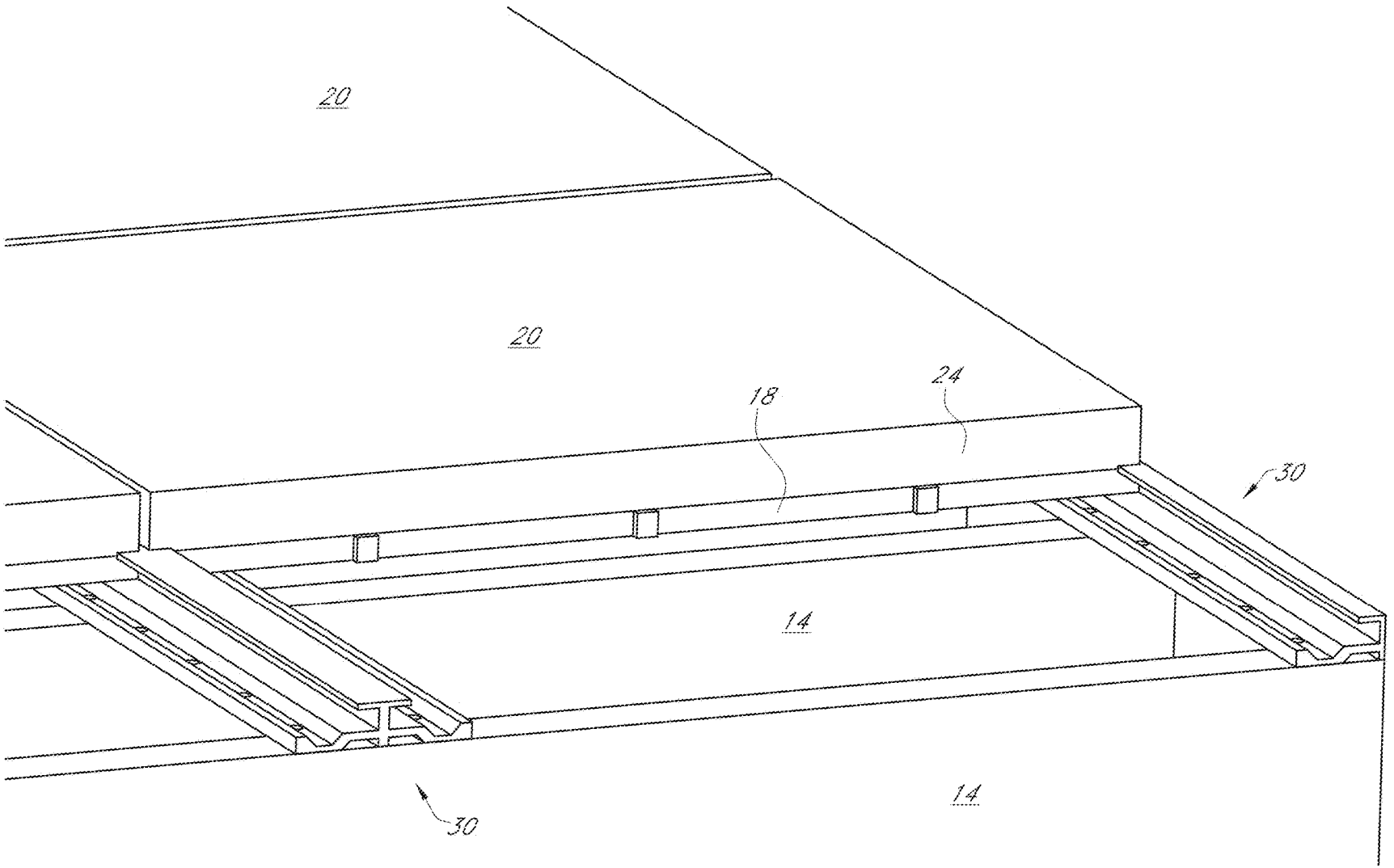
FIG. 5 is a detailed perspective view of a portion of the joists, support structures, and tiles shown in FIGS. 3 and 4.
Figure 6:
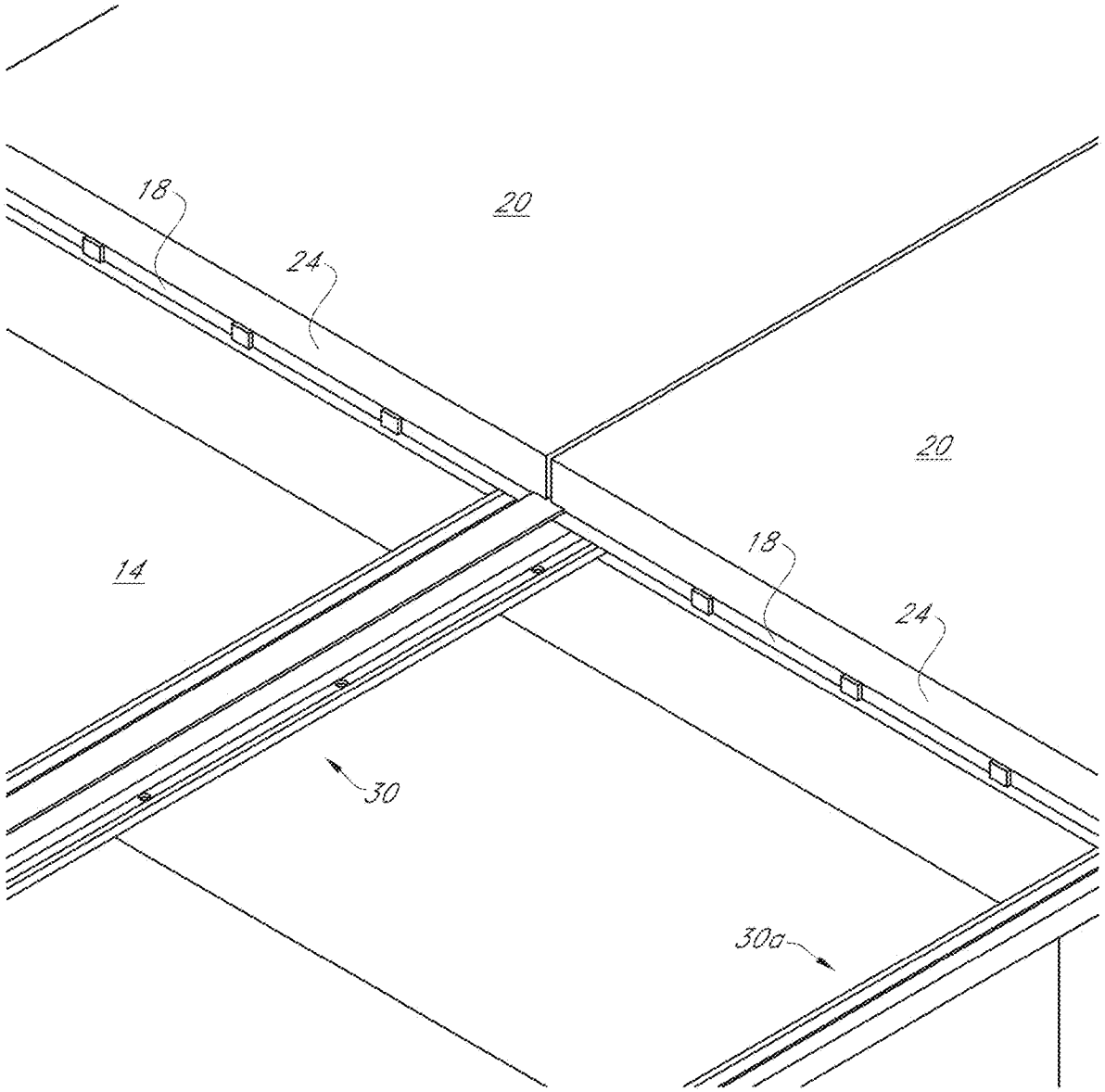
FIG. 6 is another detailed perspective view of a portion of the joists, support structures, and tiles shown in FIGS. 3 and 4.

A perspective view of the joist 14 and support structure 30 grid after a plurality of tiles 20 have been engaged with the support structures 30 is shown in FIG. 3. A top view is shown in FIG. 4, and FIGS. 5 and 6 provide two detailed perspective views. Those of ordinary skill in the art will recognize the arrangement in FIG. 3 as one arrangement of a deck 12 that may be constructed according to various aspects of the present disclosure. Although the tiles 20 pictured in FIG. 3 are configured as rectangles, the scope of the present disclosure is not so limited unless so indicated in the following claims. In another aspect not pictured herein, the shape of the tiles 20 is square. In still another aspect not pictured herein, the shape of the tiles 20 is a parallelogram, and in still another aspect the shape of the tiles 20 is a rhombus. As described in detail below, other aspects of the present disclosure may be configured to accommodate tiles 20 having one or more non-linear edge. Additionally, in certain aspects of a deck 12 constructed using the tile and support structure 10 disclosed herein, certain tiles 20 at the edges and/or corners of the deck 12 may be irregularly shaped, and may have more than four sides or fewer than four sides without limitation unless so indicated in the following claims, and which will depend at least upon the configuration of the deck 12.

Figure 7:
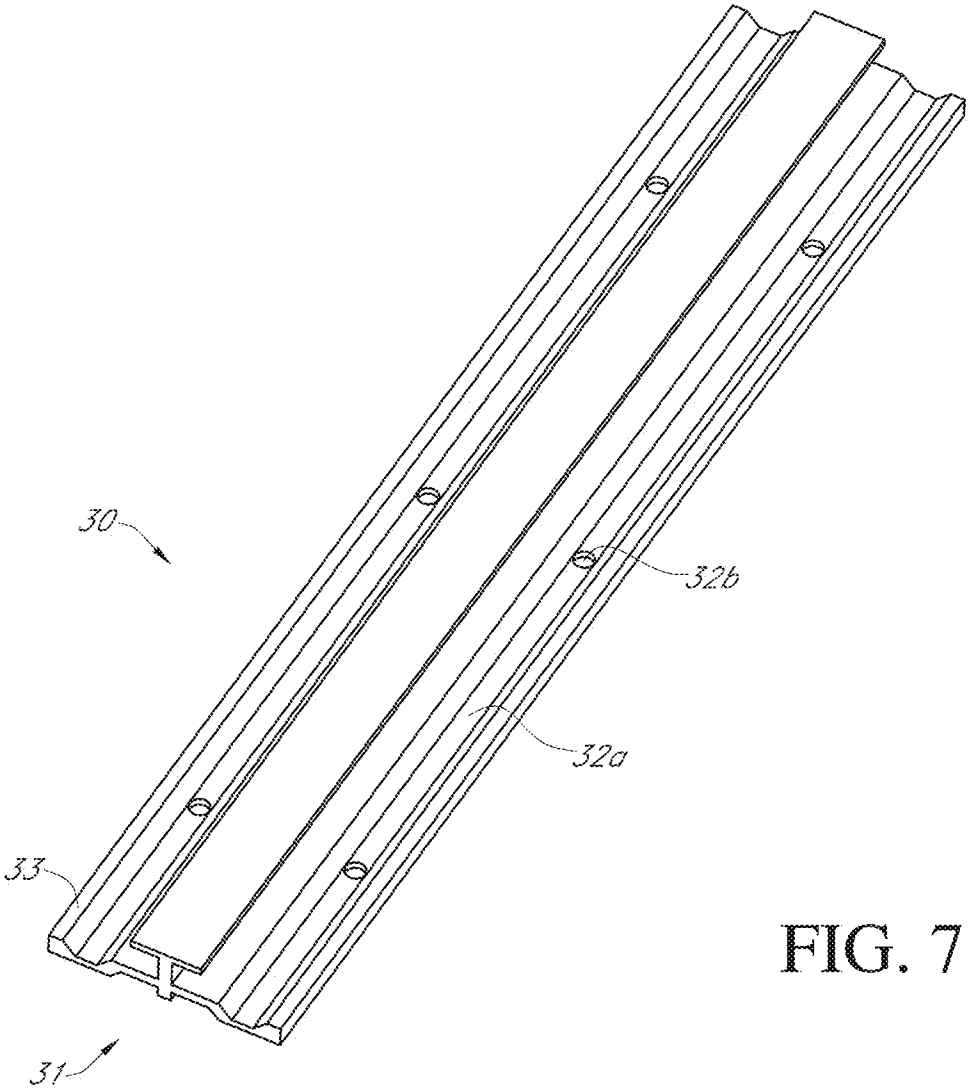
FIG. 7 is a perspective view of the illustrative support structure shown in FIGS. 2-6.
Figure 8:
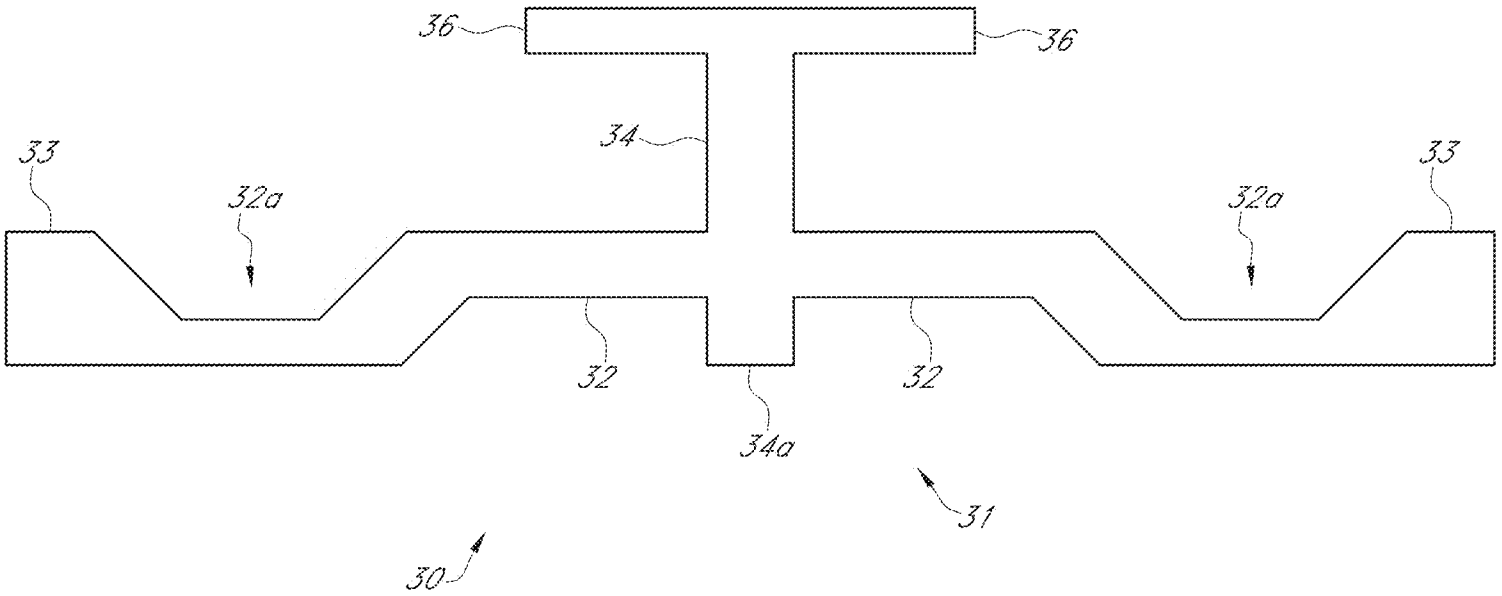
FIG. 8 is a cross-sectional view of the illustrative support structure shown in FIGS. 2-7.

A perspective view showing various illustrative aspects of a support structure 30 according to the present disclosure is shown in FIG. 7, and a cross-sectional view thereof is shown in FIG. 8. The support structure 30 may include a base 31 having a first and second flange 32 extending outward from a generally vertical centerline of the support structure 30. Each flange 32 may be formed with a trough 32*a* therein, and each trough 32*a* may be formed with a plurality of apertures 32*b* therein, as shown at least in FIG. 7. The distal edge of each trough 32*a* may be bound by a lip 33, wherein the top surface of each lip 33 may be coplanar with the top surface of each flange 32. Such a configuration may spread the force associated with a tile 20 engaged with a given support structure 30 over a larger area, as explained in further detail below.

In one illustrative aspect, the apertures 32*b* formed in a given trough 32*a* may be spaced from one another by a distance of four inches such that a support structure 30 may be engaged with joists 14 spaced twelve or sixteen inches from adjacent joists 14 without need to modify the support structure 30. In such a configuration, it is contemplated that multiple apertures 32*b* will not have a fastener 16 positioned therein, such that those apertures 32*b* may serve as an egress point for water and/or other liquid and/or precipitation in the trough 32*a*, and the trough 32*a* may serve as a fluid conduit (e.g., gutter) for water and/or other precipitation and/or liquids. However, the spacing of the apertures 32*b* in no way limits the scope of the present disclosure unless so indicated in the following claims. Additionally, the apertures 32*b* may be tapered such that the head of a fastener 14 configured as a screw may seat within the aperture 32*b*, and such that in certain aspects the head of a fastener 14 may be flush with the bottom of the trough 32*a*, and/or such that the head of a fastener 14 may be positioned below the upper surface of the flange 32. However, other aspects of the apertures 32*b* may be differently configured without limitation unless so indicated in the following claims.

A spine 34 may extend upward from the base 31 along the vertical centerline of the support structure 30. At the top distal end of the spine 34, two corresponding rails 36 may extend outward from the spine 34 in a generally horizontal dimension. A tip 34*a* that may be collinear with the spine 34 may extend downward from the spine 34 such that the distal end of the tip 34*a* is coplanar with the bottom surface of the base 31. Such a configuration may allow the tip 34*a* to abut a joist 14 and/or cross lathe during use. In certain aspects, it may be advantageous to construct the support structure 30 of a metal or metallic alloy. However, the support structure 30 may be constructed of any suitable material, including but not limited to plastic, polymers, natural materials, and/or combinations thereof without limitation unless so indicated in the following claims.

Figure 9:
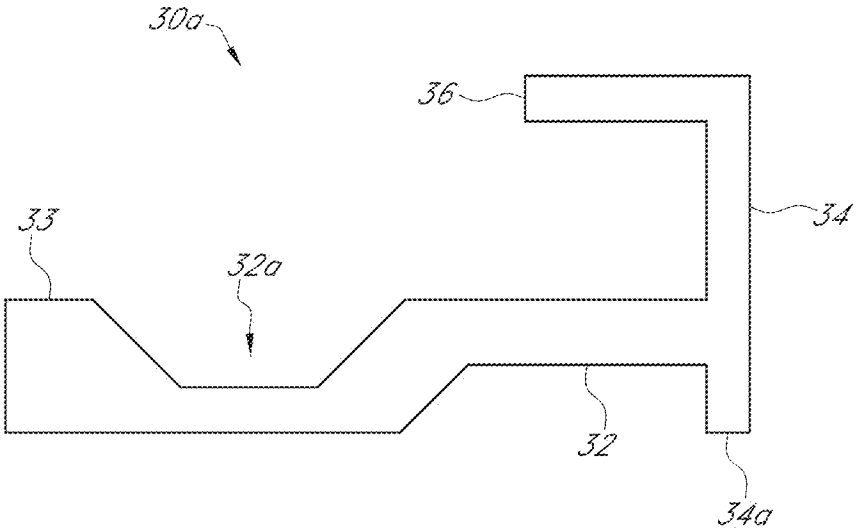
FIG. 9 is a cross-sectional view of an illustrative edge support structure.

A cross-sectional view showing various illustrative aspects of an edge support structure 30*a*, which may be correlative to various illustrative aspects of a support structure 30 shown in FIGS. 7 and 8, is shown in FIG. 9. The edge support structure 30*a* may include a base 31 having a first flange 32 extending outward therefrom. The flange 32 may be formed with a trough 32*a* therein, and the trough 32*a* may be formed with a plurality of apertures 32*b* therein. The distal edge of the trough 32*a* may be bound by a lip 33, wherein the top surface of each lip 33 may be coplanar with the top surface of the flange 32. Such a configuration may spread the force associated with a tile 20 engaged with a given edge support structure 30*a* over a larger area, as explained in further detail below.

In an illustrative aspect, the apertures 32*b* formed in the trough 32*a* of the edge support structure 30*a* may be spaced from one another by a distance of four inches, such that an edge support structure 30*a* may be engaged with joists 14 spaced twelve or sixteen inches from adjacent joists 14 without need to modify the edge support structure 30*a*.

However, the spacing of the apertures 32*b* in no way limits the scope of the present disclosure unless so indicated in the following claims. Additionally, the apertures 32*b* may be tapered such that the head of a fastener 14 configured as a screw may seat within the aperture 32*b*, and such that in certain aspects the head of a fastener 14 may be flush with the bottom of the trough 32*a*. However, other aspects of the apertures 32*b* may be differently configured without limitation unless so indicated in the following claims.

A spine 34 may extend upward from the base 31 in a generally vertical dimension. At the top distal end of the spine 34, a rail 36 may extend outward from the spine 34 in a generally horizontal dimension, wherein the rail 36 may be generally parallel with respect to the flange 32 and generally perpendicular with respect to the spine 34. A tip 34*a* that may be collinear with the spine 34 may extend downward from the spine 34 such that the distal end of the tip 34*a* is coplanar with the bottom surface of the base 31. Such a configuration may allow the tip 34*a* to abut a joist 14 and/or cross lathe during use.

The various relative dimensions of the components of the support structure 30 may be infinitely varied depending on the specific application of the support structure 30. Several illustrative aspects of different support structures 30 according to the present disclosure and dimensions of the components of the support structure 30 are shown in FIGS. 11A-11E. However, these aspects and dimensions are not meant to be limiting in any sense, but rather are provided to show how the various dimensions of the support structure 30 may be manipulated without departing from the spirit and scope of the present disclosure unless so indicated in the following claims.

Figure 10:
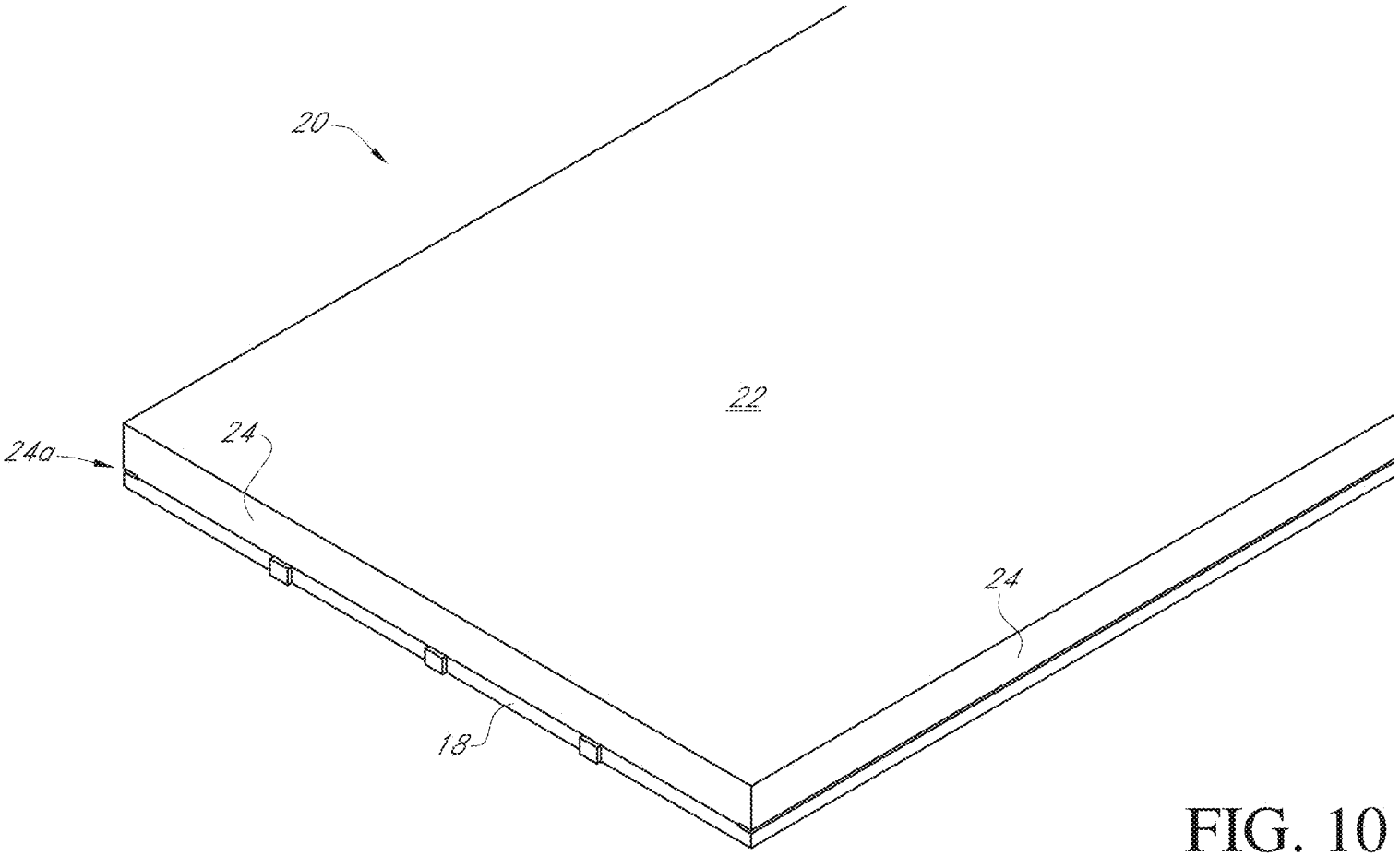
FIG. 10 is a perspective view of an illustrative tile that may be used with various aspects of a support structure.
Figure 11A:
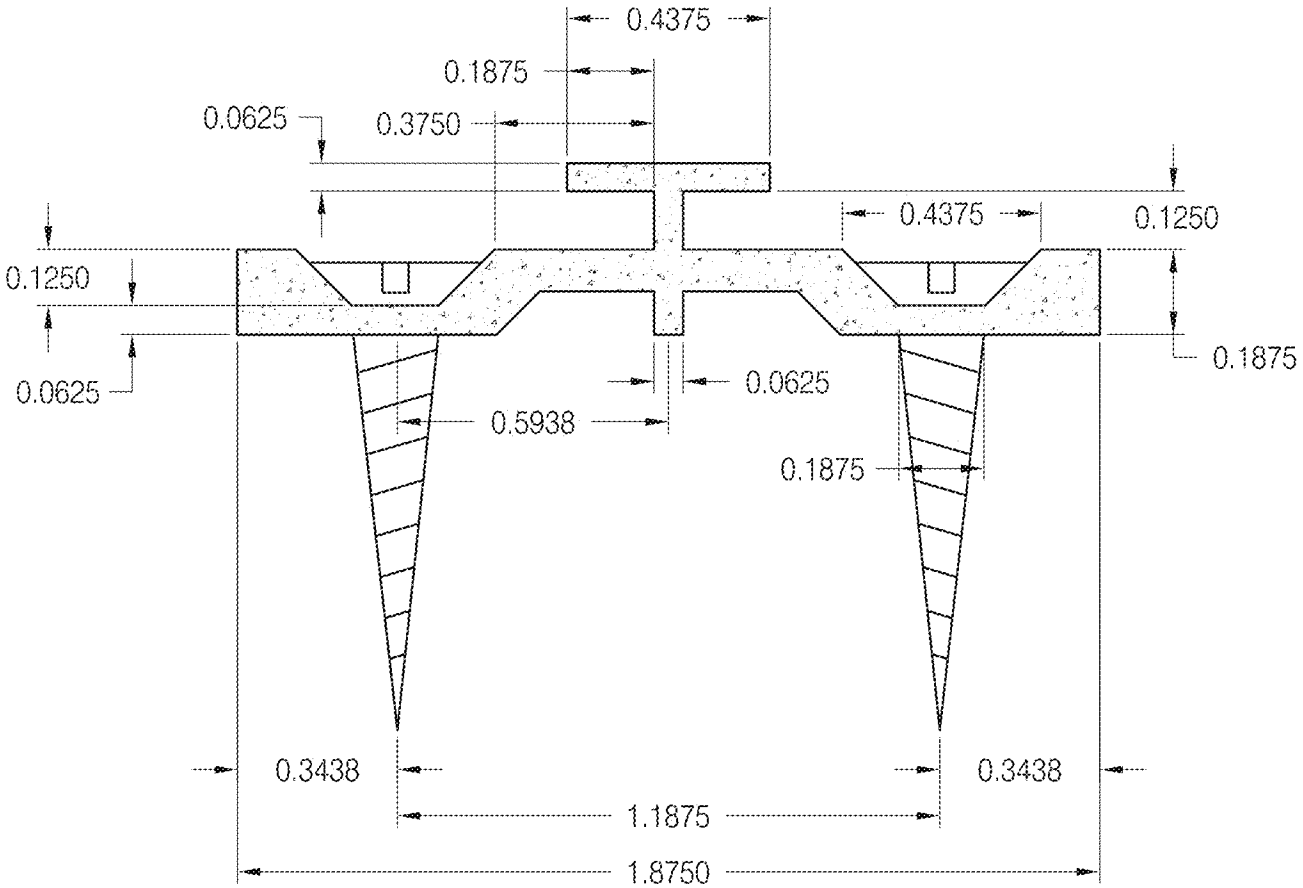
FIG. 11A is a cross-sectional view of another illustrative support structure showing dimensions of various elements thereof.
Figure 11B:
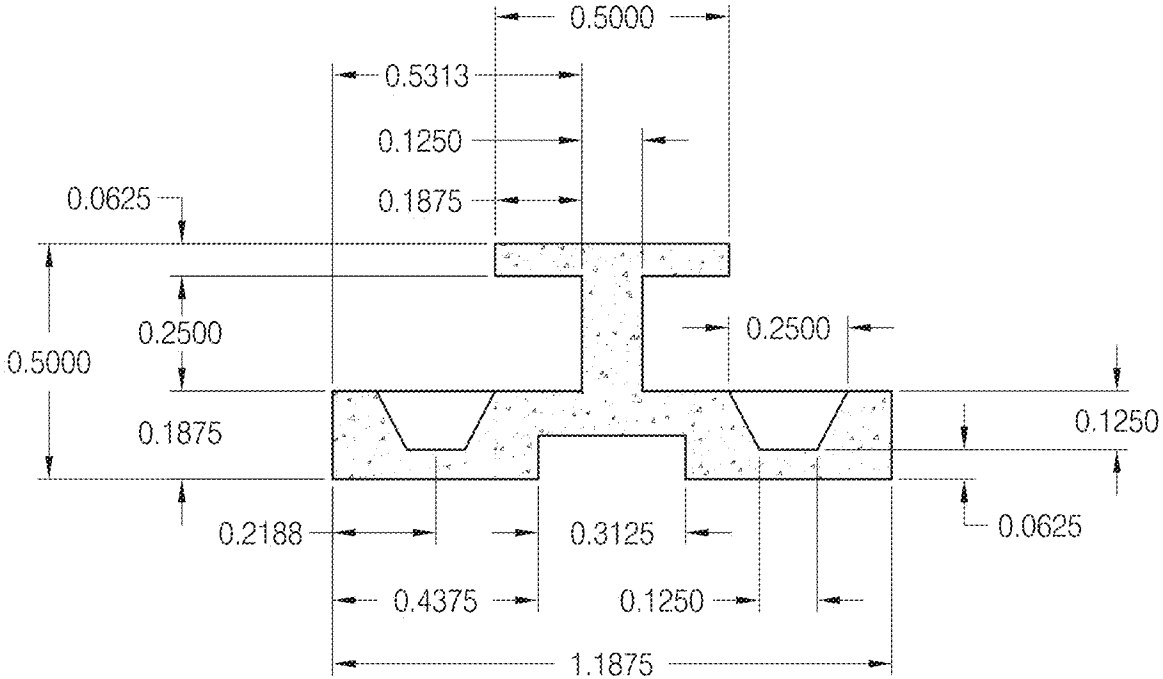
FIG. 11B is a cross-sectional view of another illustrative support structure showing dimensions of various elements thereof.
Figure 11C:
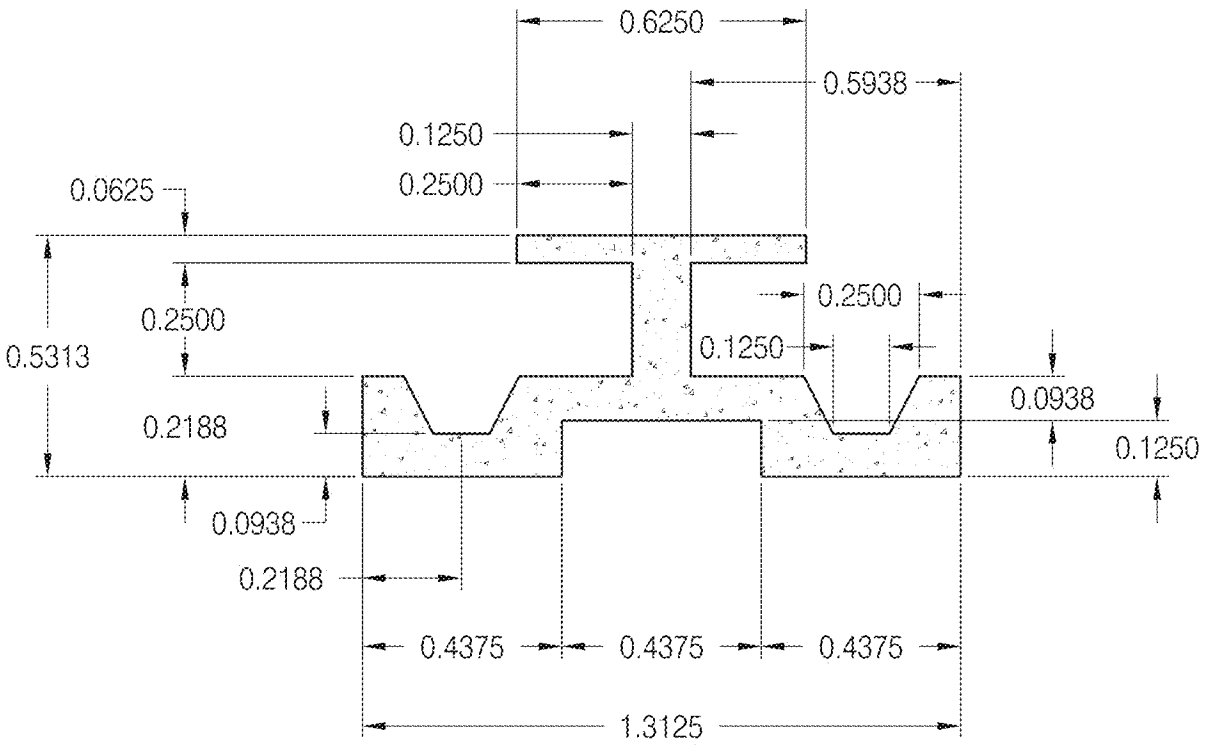
FIG. 11C is a cross-sectional view of another illustrative support structure showing dimensions of various elements thereof.
Figure 11D:
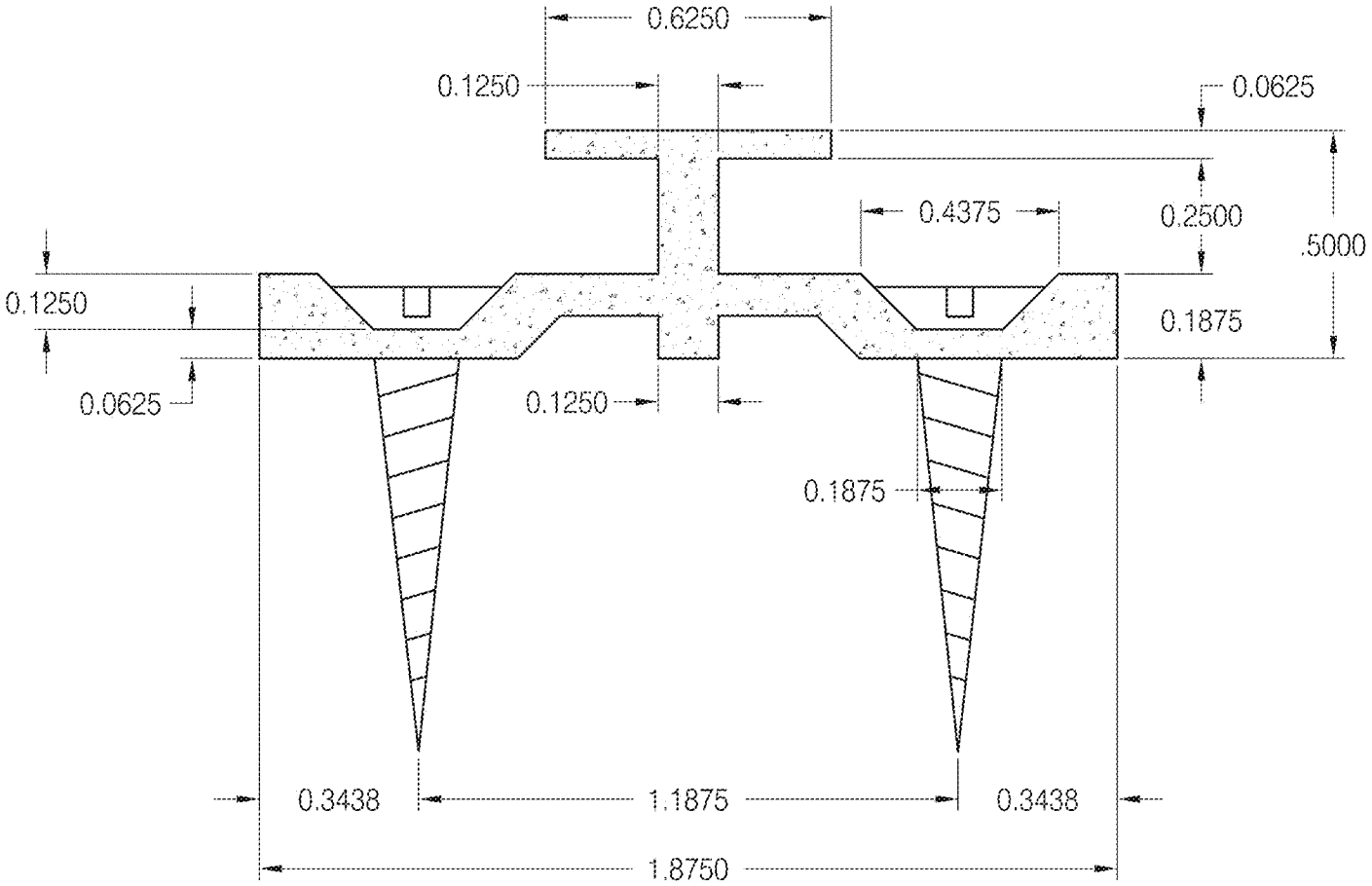
FIG. 11D is a cross-sectional view of another illustrative support structure showing dimensions of various elements thereof.
Figure 11E:
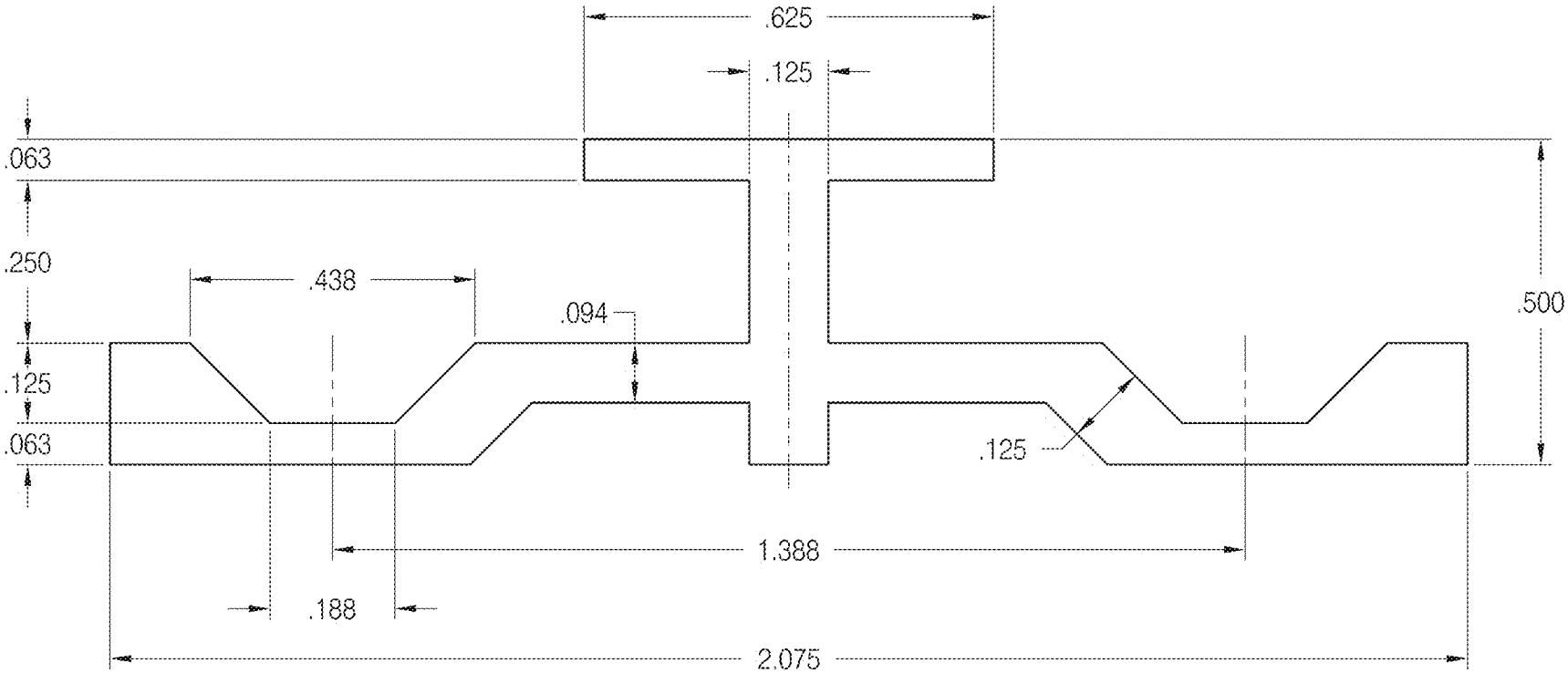
FIG. 11E is a cross-sectional view of another illustrative support structure showing dimensions of various elements thereof.

Various illustrative aspects of a tile 20 that may be engaged with the illustrative embodiment of a support structure 30 are shown in FIG. 10. The tile 20 may be generally rectangular in shape (as shown in FIG. 3), such that two rectangular-shaped faces 22 are spaced from one another by the height of an edge 24 of the tile 20. In one aspect, the height of an edge 24 may be 20 millimeters, and in another aspect the height thereof may be 30 millimeters. However, as previously mentioned, the scope of the present disclosure is not limited by the specific shape, dimensions, and/or configuration of the tile 20 unless so indicated in the following claims. The bottom face 22 may be engaged with a substrate 18, which may be configured as a synthetic (e.g., fiberglass, plastic, etc.) sheet having a periphery equal to or approximately equal to that of the tile 20. In one aspect, the thickness of a substrate may be ¼ of an inch, but the specific dimensions of the substrate 18, if used for that aspect of a tile 20, is in no way limiting to the scope of the present disclosure unless so indicated in the following claims. If a substrate 18 is used, it may be engaged with the tile 20 using any suitable structure and/or method suitable for the particular application of the tile 20, including but not limited to chemical adhesives, mechanical fasteners, and/or combinations thereof. The scope of the present disclosure is in no way limited by whether a substrate 18 is engaged with a tile 20 unless so indicated in the following claims.

Figure 12A:
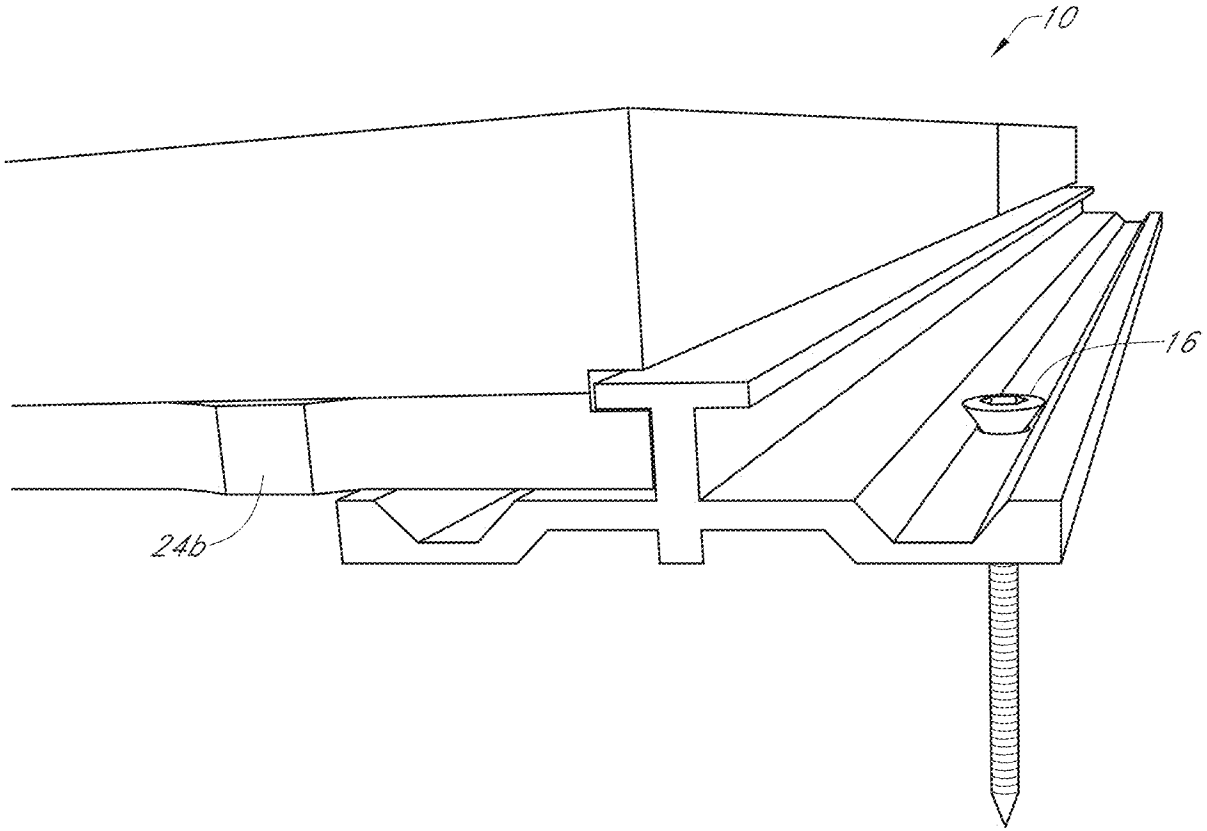
FIG. 12A is a detailed perspective view showing various aspects of a tile engaged with an illustrative support structure.
Figure 12B:
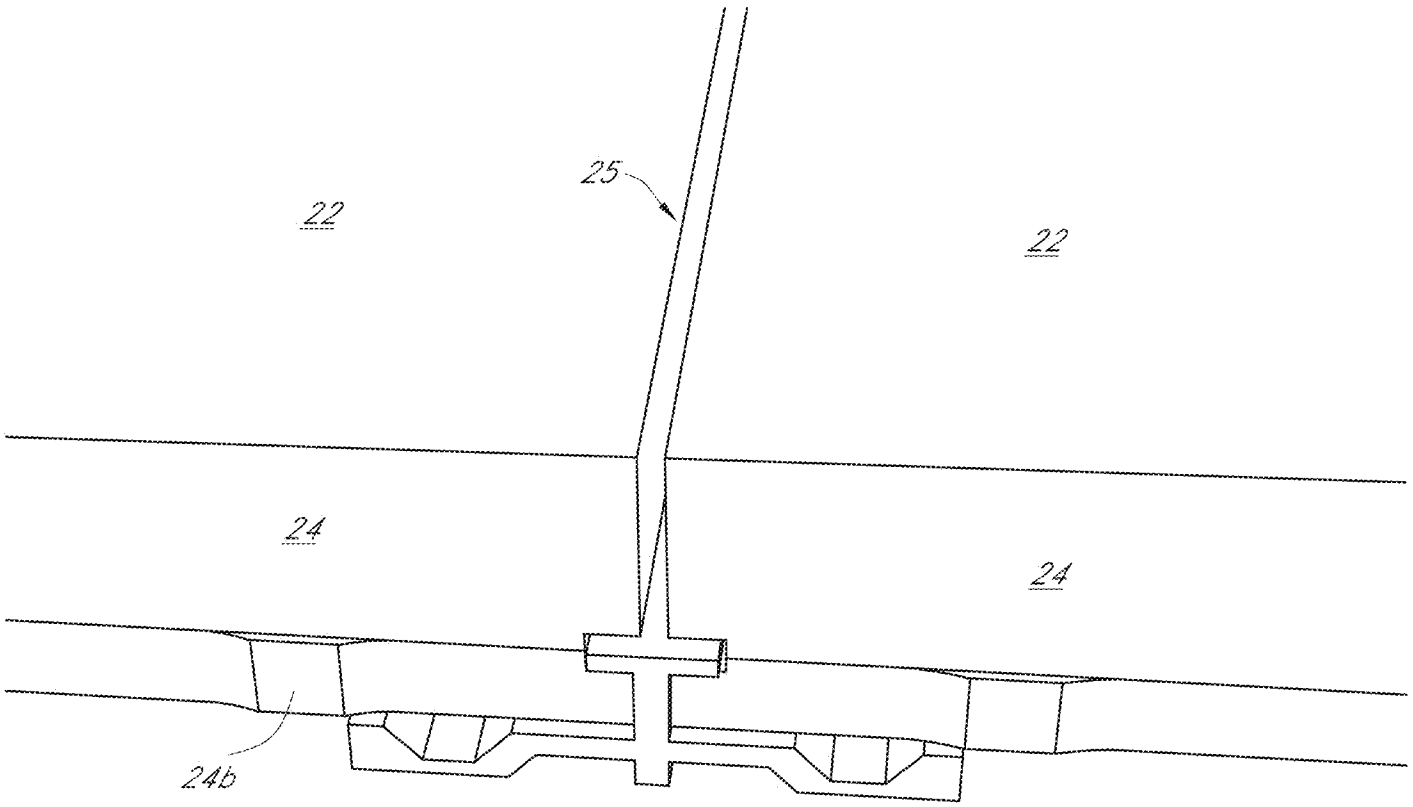
FIG. 12B is a detailed perspective view showing various aspects of two illustrative tiles engaged with an illustrative support structure.

Opposite edges 24 of a tile 20 may be formed with a groove 24*a* therein, as shown in FIGS. 10, 12A, and 12B. The groove 24*a* may be formed in the edge 24 of the tile 20, in a portion of the edge 24 of the tile 20, in a portion of a surface of a substrate 18 (if present), and/or a combination of a portion of the tile 20 and a portion of the substrate 18. The groove 24*a* may be configured such that it cooperates with the rail 36 at the top distal end of the spine 34, and such that the bottom face 22 of the tile 20 (or bottom surface of the substrate 18, if present for that embodiment of a tile 20) rests upon the top surface of the flange 32 and lip 33, as clearly shown at least in FIGS. 12A and 12B. Accordingly, one tile 20 may be engaged on opposing edges 24 of the tile 20 with adjacent support structures 30. In this manner, the tile 20 may slide with respect to the support structures 30 along the lengths of the support structures 30. Such a configuration allows adjacent tiles 20 between corresponding support structures 30 to be slid into place from an open end of the support structures 30 until the final tile 20 is positioned. Simultaneously, this configuration may secure the relative position of the tile 20 with respect to the support structures 30 in all other dimensions (e.g., a vertical dimension and a horizontal dimension perpendicular with respect to the length of the support structures 30). It is contemplated that the dimensions of the groove 24*a* may be selected such that a common blade and/or tool may be used to form the required groove 24*a* in a given edge 24. It is also contemplated that in certain aspects of a tile and support structure 10, a predetermined amount of space may exist between the surfaces of a groove 24*a* and the surfaces of a rail 36, between the edge 24 and the spine 34, and between the bottom face 22 and flange 32 such that water and/or other liquids and/or other precipitation may flow via gravity between the groove 24*a* and the rail 36, between the edge 24 and spine 34, and/or between the bottom face 22 and flange 32.

Referring now specifically to FIG. 12B, the grooves 24*a* and the support structure 30 may be configured such that a clearance 25 exists between adjacent tiles 20 on opposing sides of a support structure 30. In an illustrative aspect, the width of the clearance 25 may be ⅛ of an inch. The various dimensions of the tile (e.g., edge 24, groove 24*a*, etc.) and support structure 30 (e.g., height and width of spine 34, length of rail 36, etc.) may be varied to change the width and depth of the clearance 25, and the optimal width and depth of the clearance 25 may vary from one application of the tile and support structure 10 to the next. Accordingly, the scope of the present disclosure is in no way limited by the specific dimensions and/or configuration of the clearance 25 unless so indicated in the following claims.

Figure 12C:
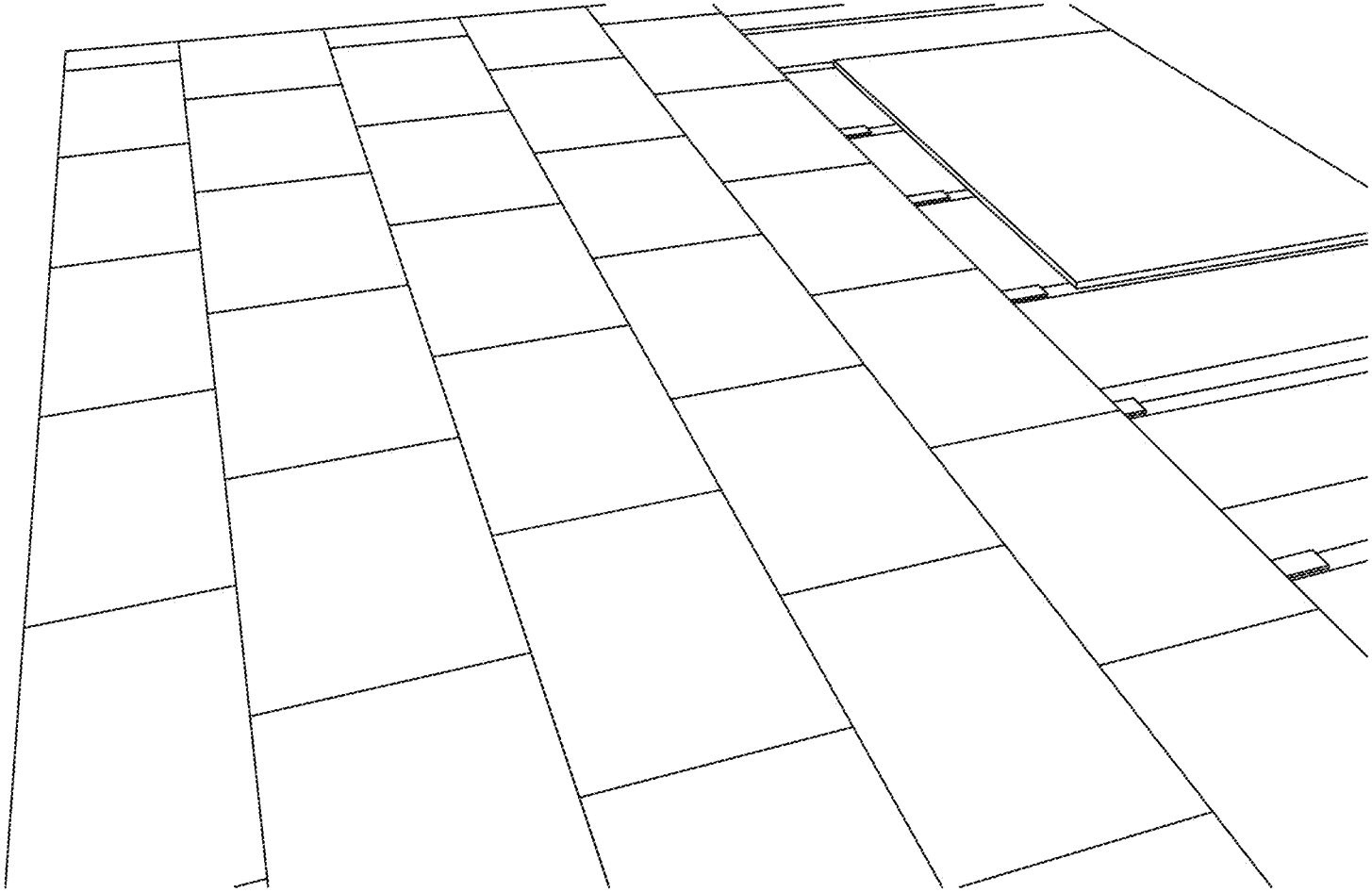
FIG. 12C is a perspective view of a portion of a deck constructed according to various aspects of the present disclosure.

Still referring to FIGS. 12A and 12B, the tile 20 may be formed with a protrusion 24*b* on an edge 24 thereof not configured with a groove 24*a*. The protrusions 24*b* may be configured such that when protrusions 24*a* of adjacent tiles 20 abut one another, the space between the edges 24 thereof is equal or approximately equal to the width of the clearance 25 between edges 24 of adjacent tiles 20 having grooves 24*a* formed therein. Various illustrative aspects of a portion of a deck 12 employing a tile and support structure 10 so configured is shown in FIG. 12C. However, in other aspects not pictured herein, the space between adjacent tiles 20 along edges 24 thereof having protrusions 24*b* may be different that the width of the clearance 25 without limitation unless so indicated in the following claims. It is contemplated that the clearance 25 and/or space between the edges 24 of adjacent tiles 20 having protrusions 24*b* formed therein may facilitate drainage of water and/or other liquids from the top face 22 of the tile 20 (and/or an area adjacent thereto) to an area below the tile 20, the path for which may proceed into the trough 32*a* and out through one or more apertures 32*b*. However, the specific spacing between any edge 24 of adjacent tiles 20 may vary according to the present disclosure without limitation unless so indicated in the following claims.

It is contemplated that for certain applications of the tile and support structure 10, it may be especially advantageous to construct the tile 20 from porcelain or stone, the substrate 18 (if present) from fiberglass, and the support structure 30 from aluminum. However, the tile and support structure 10 and various elements thereof may be constructed of any suitable material known to those skilled in the art without limitation unless so indicated in the following claims. Accordingly, the present methods and systems may work with any tile-based product, particularly tile made of clay. As disclosed herein, a tile 20 suitable for use as a deck tile may be comprised of fiber glass fiber and clay. For certain applications it may be desirable to configured the tile 20 such that not less than one-percent is fiberglass fiber by weight. Another tile 20 that may be suitable for certain applications according to the present disclosure may be comprised of fiber glass fiber and clay, with not less than twenty-five percent fiberglass fiber by weight. For certain applications, it may be advantageous for a tile 20 to have a width of approximately twelve inches, a length of approximately twenty-four inches, and a thickness of one to one and one half inches, without limitation unless so indicated in the following claims.

Illustrative Aspects of a Roofing Application

Figure 13:
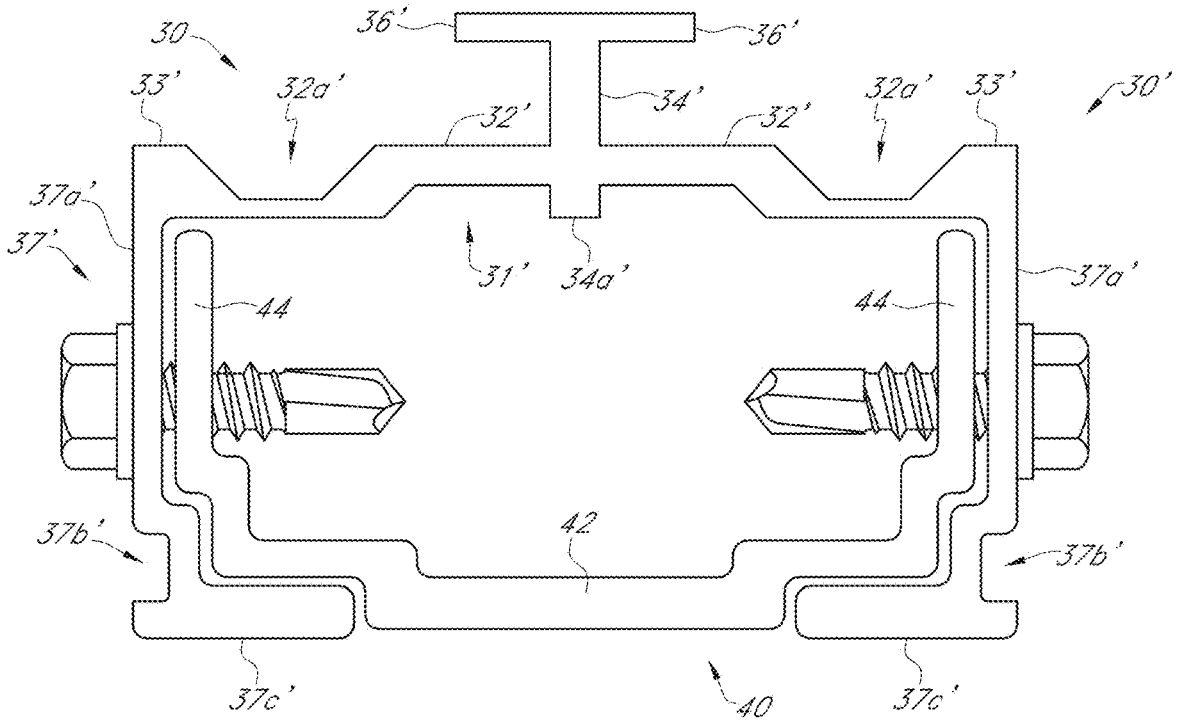
FIG. 13 is an end view showing various aspects of a roof support structure.

In another aspect of a tile and support structure 10 disclosed herein, the tile and support structure 10 may be configured for use in a roofing application. End views showing various aspects of a tile and support structure 10 configured for use in a roofing application are shown in FIGS. 13-16. The upper surface of a roof support structure 30' may be configured in a manner similar to that as previously described herein for a support structure 30. As shown in FIG. 13, which provides a cross-sectional view showing various aspects of a roof support structure 30', a roof support structure 30' may be comprised of a channel portion 37' to which a support structure 30 may be engaged. It is contemplated that the roof support structures 30' shown in FIGS. 13-15 may be configured as elongate members, such as rails. However, the scope of the present disclosure is not so limited unless so indicated in the following claims.

The support structure 30 and channel portion 37' may be separately formed and then later engaged with one another (e.g., via welding, mechanical fasteners, chemical adhesives, etc.) or integrally formed with one another during manufacturing without limitation unless so indicated in the following claims. Any suitable structure and/or method may be used to engage the support structure 30 with the channel portion 37' without limitation unless so indicated in the following claims. Any of the various aspects, features, configurations, etc. of a support structure 30 disclosed herein may be engaged with a channel portion 37' to form a roof support structure 30' without limitation unless so indicated in the following claims. Additionally, any of the various aspects, features, configurations, etc. of an edge support structure 30*a* disclosed herein may be engaged with a channel portion 37' and/or corresponding portion thereof to form an edge roof support structure 30*a'* without limitation unless so indicated in the following claims.

Referring still to FIG. 13, in an aspect of a roof support structure 30', the bottom surface of the base 31' may be configured in a manner that is similar to the support structures 30 previously disclosed herein, wherein two opposing flanges 32' may extend outward from a center of the base 31', and such that a tip 34*a'* may extend downward from the base 31'. That is, there may be open areas on either side of the tip 34*a'* on the bottom side of each flange 32. The tip 34*a'* may be collinear with the spine 34', and a trough 32*a'* may be formed in each flange 32'. A plurality of apertures 32*b'* may be formed each either trough 32*a'*. Each flange 32' may terminate at a lip 33', and to top surface of each flange 32' at the lip 33' and adjacent the spine 34' may be collinear as previously described for other aspects of a tile and support structure 10.

The channel portion 37' may include one or more side members 37*a'*, which may extend downward from the either distal end of the base 31' (which distal end may be adjacent a lip 33') of the roof support structure 30'. The side members 37*a'* may terminate at a bottom member 37*c'*, which bottom member 37*c'* may be configured such that it is generally perpendicular with respect to the side members 37*a'*. A notch 37*b'* may be formed in a side member 37*a'* between the bottom member 37*c'* and the base 31'. In an aspect of a roof support structure 30', the roof support structure 30' may be formed with two distinct bottom members 37*c'* at the terminal end of two distinct side members 37*a'*, as shown at least in FIGS. 13, 14, & 15A, both of which are perpendicular with respect to the side members 37*a'* but parallel with respect to one another. In another aspect of a roof support structure 30', the roof support structure 30' may be formed with one continuous bottom member 37*c'* engaged with each side member 37*a'*, as shown at least in FIG. 15B, which continuous bottom member 37*c'* may be perpendicular with respect to either side member 37*b'*. Accordingly, the specific configuration of the bottom member(s) 37*c'* in no way limits the scope of the present disclosure unless so indicated in the following claims.

Figure 14:
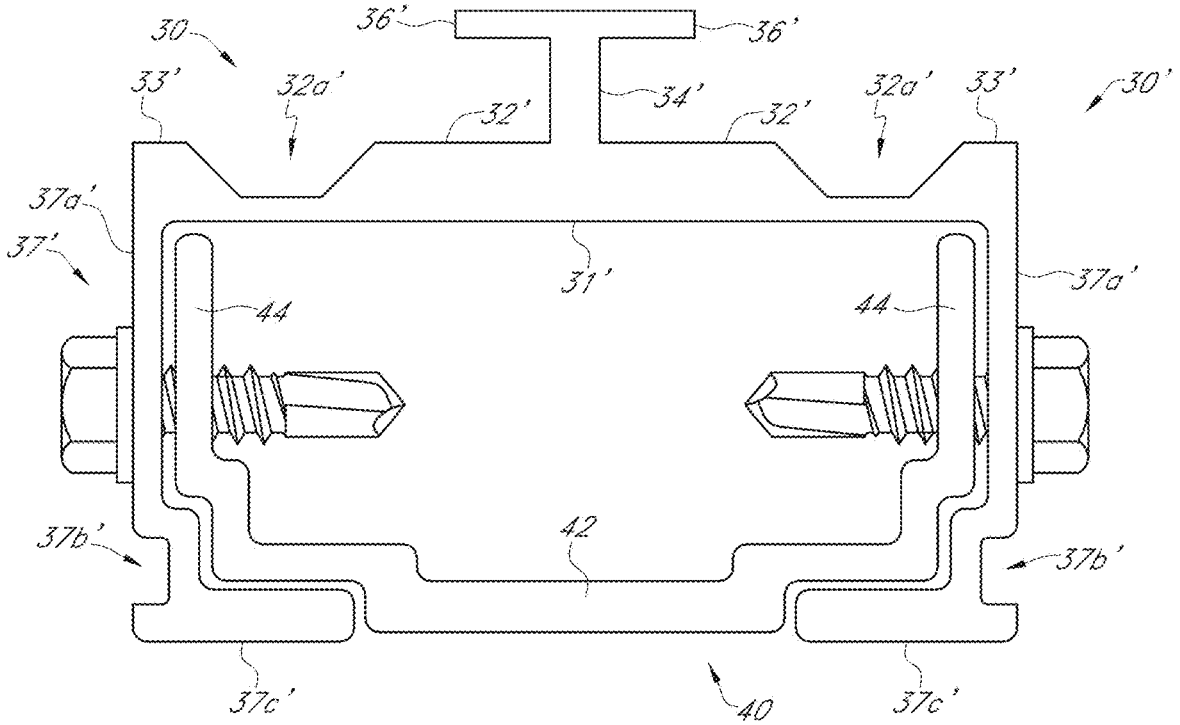
FIG. 14 is an end view showing other aspects of a roof support structure.
Figure 15A:
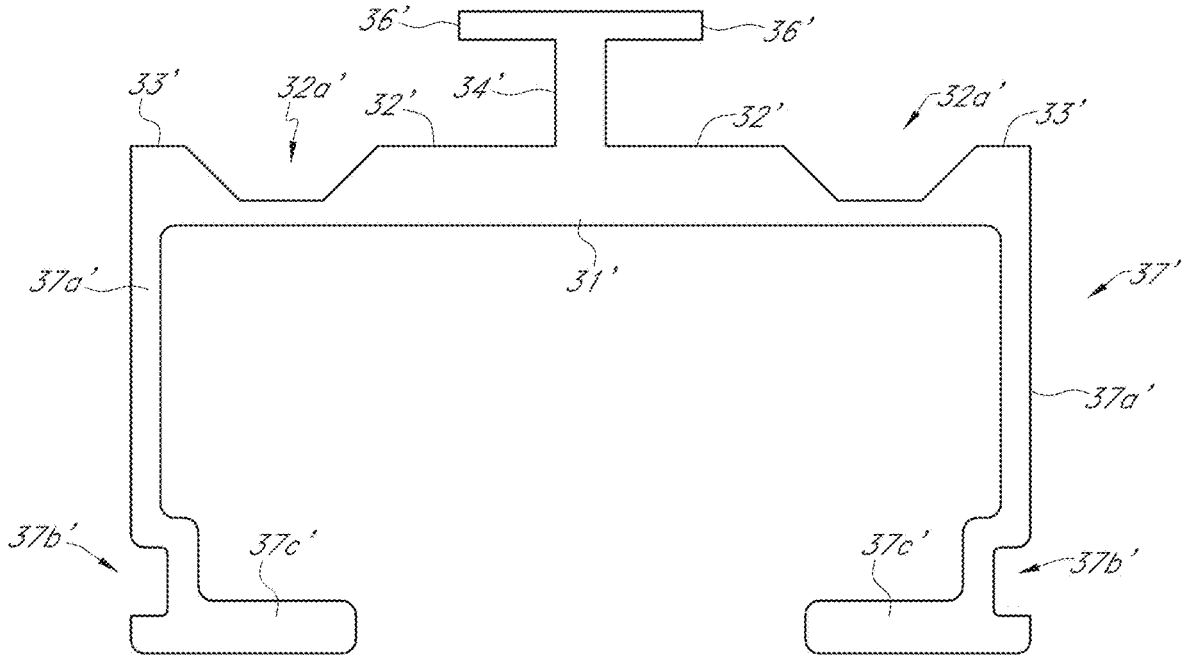
FIG. 15A is an end view showing other aspects of a roof support structure.
Figure 15B:
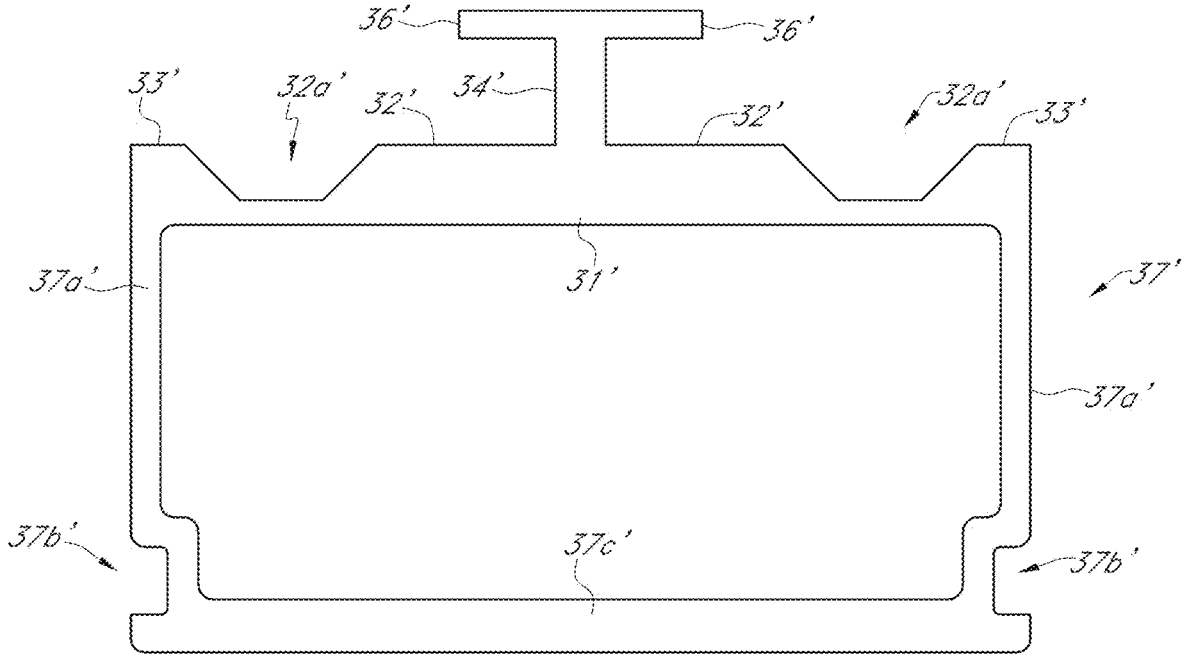
FIG. 15B is an end view showing other aspects of a roof support structure.

Referring now to FIG. 14, in an aspect of a roof support structure 30', the bottom surface of the base 31' may be configured such that it is planar. That is, the open areas on either side of the tip 34*a'* on the bottom side of each flange 32' (such as shown in FIG. 13) may be solid, which may be especially beneficial in aspects of a roof support structure 30' that is manufactured as an integral unit. In such a configuration, the roof support structure 30' may not include a tip 34*a'*. The channel portion 37' may include one or more side members 37*a'* extending downward from the distal ends of the base 31'(which distal end may be adjacent a lip 33'). The side members 37*a'* may terminate at a bottom member 37*c'*, which bottom member 37*c'* may be configured such that it is generally perpendicular with respect to the side members 37*a'*. A notch 37*b'* may be formed in a side member 37*a'* between the bottom member 37*c'* and the base 31'. As previously described with respect to FIG. 13, the roof support structure 30' may be formed with two distinct bottom members 37*c'* at the terminal end of two distinct side members 37*a'*, as shown at least in FIGS. 13, 14, & 15A, both of which are perpendicular with respect to the side members 37*a'* but parallel with respect to one another. In another aspect of a roof support structure 30', the roof support structure 30' may be formed with one continuous bottom member 37*c'* engaged with each side member 37*a'*, as shown at least in FIG. 15B, which continuous bottom member 37*c'* may be perpendicular with respect to either side member 37*b'*. Accordingly, the specific configuration of the bottom member(s) 37*c'* in no way limits the scope of the present disclosure unless so indicated in the following claims.

Referring now to FIGS. 13 & 14, a roof support structure 30' may utilize an inner member 40, a portion of which may be positioned within and engaged with a channel portion 37' of the roof support structure 30'. The inner member 40 may include an inner member bottom 42 and one or more inner member sides 44 extending upward from the inner member bottom 42. The inner member 40 may be engaged with the roof support structure 30', which engagement be via any suitable structures and/or methods without limitation unless so indicated in the following claims.

It is contemplated that in roof support structure 30' configured to use an inner member 40, the inner member 40 may be engaged with one or more pedestals 50. Additionally, it is contemplated that for roof support structures 30' configured without an inner member 40, such as those shown in FIGS. 15A & 15B, may be engaged with one or more pedestals 50. For example, Eurotec, GmbH from Germany manufactures pedestals that may be configured with a "click adaptor" on a portion of the top surface of the pedestal. With a pedestal so configured, a roof support structure 30' (or correlative support structure 30) may be engaged with the pedestal 50 and click adapter, wherein a portion of that engagement may occur at the notch(s) 37*b*', and another portion of the engagement may consist of the bottom member(s) 37*c*' resting on the top surface of the pedestal 50. Generally, in one aspect a pedestal 50 may be engaged with suitable structures, structural components, surfaces and/or methods for forming an underlying support for a tile and support structure 10, which suitable structures, structural components, surfaces, and/or methods for forming an underlying support for a tile and support structure 10 include but are not limited to steel, other metals, metallic alloys, synthetic materials, cement, concrete, wood, ceramics, etc. unless so indicated in the following claims.

Figure 16A:
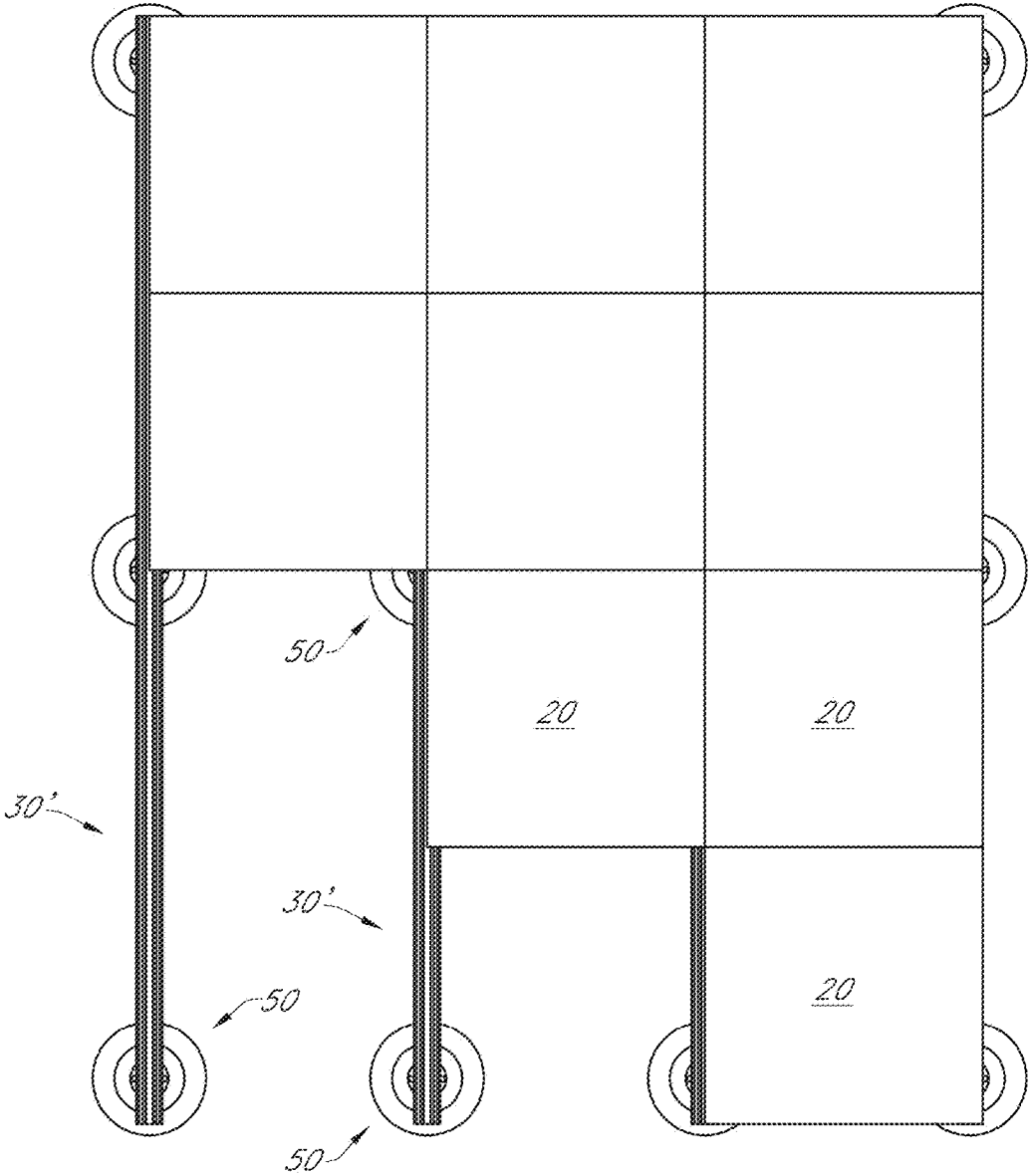
FIG. 16A is a top view of a tile and support structure that may be configured for use with pedestals.
Figure 16B:
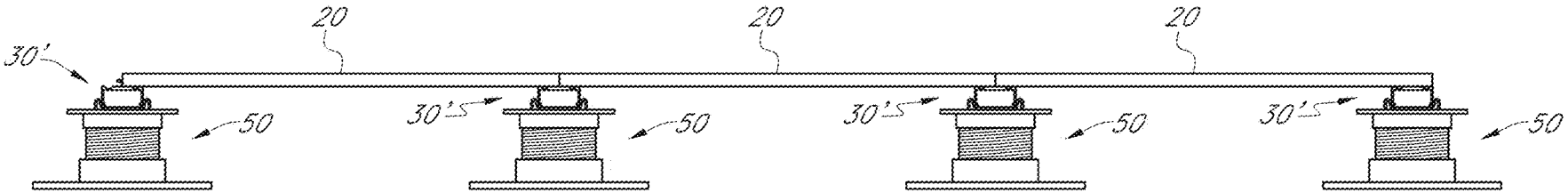
FIG. 16B is an end view of the tile and support structure shown in FIG. 16A.

Referring now to FIGS. 16A & 16B, an aspect of a roof support structure 30' may include one or more pedestals 50. It is contemplated that the pedestal base 52 may be engaged with a structure, such as a concrete surface, a wooden surface, or other structure, structural component, and/or surface on which a tile and support structure 10 may be positioned. However, any suitable structure and/or surface may be used, including but not limited to wooden surfaces, rock surfaces, ceramic surfaces, synthetic surfaces, etc. without limitation unless so indicated in the following claims. The roof support structure 30' may engage an upper portion of one or more pedestals 50 at the notches 37*b*' formed in either side member 37*a*' of the roof support structure 30' and at a top surface of the pedestal 50. After the pedestals 50 and roof support structures 30' are properly positioned and engaged with one another, one or more tiles 20 may be engaged with the roof support structures 30', various aspects of which engagement are described in further detail below. It is contemplated that the pedestals 50 may be adjustable for height and slope to accommodate variances in the structure, structural component, and/or surface to which the pedestals 50 are engaged, and/or to provide a slope to the tile 20 to adequately drain moisture from the tiles 20.

Illustrative Method of Use

Having described several preferred embodiments, an illustrative method of using the tile and support structure 10 will now be described. This method of use is not intended to limit the scope of the present disclosure in any way, but is instead provided for illustrative purposes only and may be applied and/or adapted to suit various aspects of the present systems and/or components thereof disclosed herein. Even though the foregoing illustrative method of use is primarily adapted for decks 12, the scope of the present disclosure is not so limited and a correlative method of using the roof support structure 30' with or without pedestals 50, and/or other systems and/or components within the spirit and scope of the present disclosure will occur to those having ordinary skill in the art in light of the present disclosure.

In one aspect, the tile and support structure 10 as disclosed herein may be used to build a deck 12, wherein the tread surface of the deck 12 may be comprised of the top faces 22 of the tiles 20. Generally, the supporting surface for a deck 12 may be a plurality of joists 14 arranged in a parallel fashion in a manner similar to that shown in FIG. 1. The use of joists 14 herein are for illustrative purposes only, and are in no way meant to be limiting. Accordingly, other suitable structures, structural components, surfaces and/or methods for forming a foundation and/or underlying support for a deck 12 may be used without limiting the scope of the present disclosure unless so indicated in the following claims.

An edge support structure 30*a* may be engaged with the joists 14 adjacent one end of the joists 14 (e.g., the end of the joists 14 engaged with the building or other structure adjacent the deck 12). Generally, "edge support structure 30*a*" and "support structure 30" may be used interchangeably throughout this description of an illustrative method of use. Accordingly, the scope of the present disclosure related to a method of using any system and/or component thereof disclosed herein is not limited by whether an edge support structure 30*a* or support structure 30 is used unless so indicated in the following claims. A support structure 30 may then be spaced from the edge support structure 30 by a predetermined amount and engaged with the joists 14 such that the position of the support structure 30 is fixed with respect thereto. As previously explained, a cross lathe may be positioned between the edge support structure 30*a* and the joist(s) 14 and/or between the support structure 30 and the joist(s) 14 if needed/desired.

The distance between the edge support structure 30*a* and the support structure 30 may be dependent at least upon the configuration of the tile 20 to be used with the deck 12, and more specifically at least upon the distance between edges 24 of the tile 20 having grooves 24*a* formed therein. Subsequent support structures 30 may be engaged with the joists 14 at predetermined distances from adjacent support structures 30 and/or edge support structures 30*a*. Depending at least upon the configuration of the tiles 20 to be used for the deck 12, the distance between adjacent support structures 30 may be generally uniform for all support structures 30 (e.g., for use with a deck 12 wherein most tiles 20 are generally of a similar shape), or some support structures 30 may be differently spaced with respect to adjacent support structures 30 (e.g., for use with a deck 12 wherein a certain number tiles 20 have different shapes). One end of the support structures 30 may be left accessible and another end thereof may be blocked and/or bound by another structure (which structure may include but is not limited to a wall of a building, a deck frame, joist 14 etc. unless so indicated in the following claims).

After the desired number of support structures 30 (and/or edge support structures 30*a*) have been engaged with the joists 14, a tile 20 may be positioned between adjacent support structures 30 (and/or between an edge support structure 30*a* and a support structure 30). The tile 20 may be slid along the length of the support structures 30 from an open end thereof to a blocked and/or bound end thereof. During this step, the rails 36 of the support structure 30 may be positioned within the groove 24*a* formed in one or more edges 24 of the tile 20. Another tile 20 may be slid along the length of the same support structures 30 until the protrusions 24*b* on the edges 24 of the tiles 20 engage one another. Subsequent tiles 20 may be positioned between other support structures 30 until a majority of the deck 12 is built.

In many instances it is contemplated that tiles 20 positioned on the periphery of the deck 12 may require cutting and/or resizing due to various factors, including but not limited to the shape of the periphery of the deck 12. Accordingly, after all or a majority of the standard sized and/or shaped tiles 20 have been properly positioned, specialized tiles 20 may be slid between adjacent support structures 30 and/or edge support structures 30*a*. After all desired tiles 20 have been properly positioned, the open ends of the support structures 30 and/or end support structures 30*a* may be blocked and/or bound by another structure (which structure may include but is not limited to a wall of a building, a deck frame, joist 14, specialized support structure 30 with suitable aesthetics, etc. unless so indicated in the following claims).

It is contemplated that for some aspects and/or applications it may be advantageous to use the tiles 20 to ensure that adjacent support structures 30 are properly spaced from one another. In such an embodiment, the support structures 30 may be engaged with a joist 14 only at one end of the support structures 30. As tiles 20 are positioned between the support structures 30, a user may ensure the proper position of the support structures 30 by placing a lateral force thereon such that the tiles 20 are effectively pinched between the support structures 30, at which point the support structures 30 may be engaged with the joist(s) 14 adjacent the most terminal tile 20. Those of ordinary skill in the art will appreciate that this may be done in a progressive manner. That is, as each row of tiles 20 is slid between the support structures 30, another fastener(s) 16 may be used to engage the support structure(s) 30 with the joist(s) 14.

Those of ordinary skill in the art will appreciate that a method similar to the immediately preceding method may be extrapolated therefrom for use with a roof support structure 30' such as those shown in FIGS. 13-16. In such a method, the pedestals 50 and roof support structures 30' may be engaged with a suitable structure, structural component, and/or surface. The tiles 20 may be slid along the length of the roof support structures 30' in a manner similar to that as previously described.

Alternatively, one or more pedestals 50 for supporting a first roof support structure 30' (which may constitute a roof edge support structure 30*a*' and/or border) may be positioned on a suitable structure, structural component, and/or surface. The height of the pedestals 50 may be adjusted as desired, and a roof edge support structure 30*a*' may be engaged with the pedestals 50. The user may now secure another pedestal 50 or row of pedestals 50 in a manner generally parallel to the first roof support structure 30' but spaced apart therefrom and adjust the height of those pedestals as desired. The user may engage a roof support structure 30' with the second pedestal 50 or row thereof. At this point one or more tiles 20 may be slide between the roof edge support structure 30*a*' and the roof support structure 30'. Alternatively, all the required pedestals 50 and roof support structures 30' and/or roof edge support structures 30*a*' may be properly positioned and secured prior to installation of any tiles 20.

Those of ordinary skill in the art will appreciate that at this point, the relative positions of the tiles 20, support structures 30, and joists 14 generally may fixed in three dimensions, but simultaneously incremental changes in those relative positions may be allowed via flexing, bending, and/or other allowed movement between one tile 20 and adjacent tiles 20, between a tile 20 and support structures 30 engaged with the tile 20, and/or between a support structure 30 and the joist(s) 14 (or other suitable structures, structural components, surfaces and/or methods for forming a foundation and/or underlying support for a deck 12) with which it is engaged. It is contemplated that at least the configuration of the tiles 20 may affect the amount of incremental changes in the above-referenced relative positions. It is contemplated that a configuration allowing some or all of the incremental changes in relative positions listed above may prevent cracking and/or other damage to the tiles 20, which may be manufacturing of a generally rigid, inflexible material.

Alternative Aspects of a Tile & Support Structure

Other aspects of a tile & support structure 10 employing a retaining element 60 are shown in FIGS. 17A-17D. As shown therein, a tile & support structure 10 may be configured for use with a retaining element 60, various illustrative aspects of which are shown in cross-section in FIGS. 17A-17D. Generally, it is contemplated that a portion of the retaining element 60 may be positioned in a groove 24*a* formed in an edge 24 of a tile 20 in a manner analogous to that in which the rail 36 may be positioned in a groove 24*a* as previously described herein for other aspects of a tile & support structure 10.

It is contemplated that a tile & support structure 10 employing a retaining element 60 may be adapted for use in a variety of applications using a variety of support structures 30 while simultaneously allowing relatively easy removal of a tile 20, as further described below. Additionally, an aspect of a tile & support structure 10 like those shown in FIGS. 17A-17D is that the tiles 20 may be configured in an orientation other than straight, such as curved, radiused, and/or an otherwise nonlinear fashion. This configuration may be a result of one or more edge 24 of a tile 20 being curved, radiused, an/or otherwise non-linear without limitation unless so indicated in the following claims. The tile & support structure 10 shown in FIG. 17C may be especially adapted for use in nonlinear tile 20 configurations, but other tile & support structures 10 may be configured for nonlinear tile 20 configurations without limitation unless so indicated in the following claims.

Figure 17A:
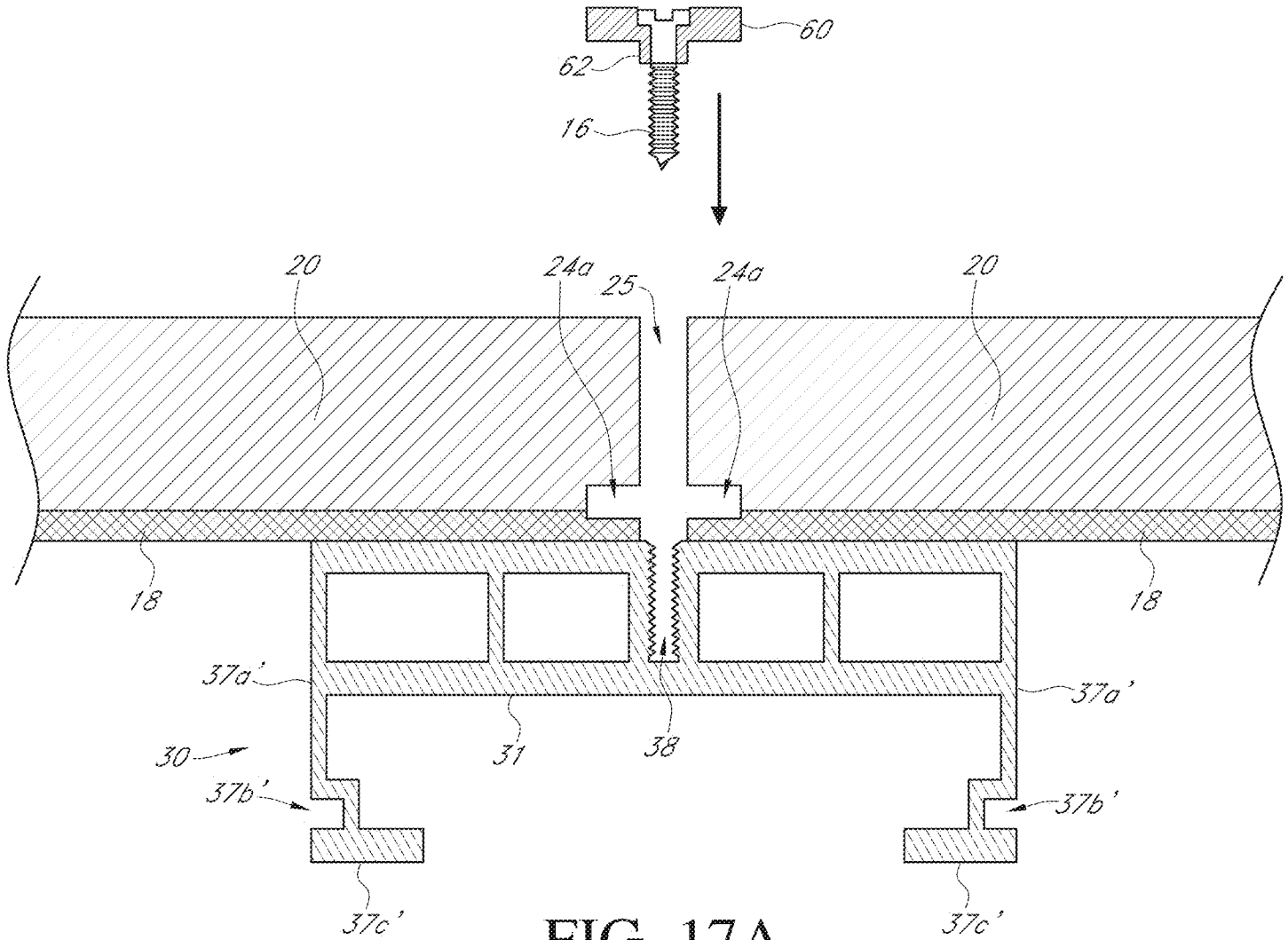
FIG. 17A is a cross-sectional view showing other aspects of a support structure.

Referring now to FIG. 17A, which provides a cross-sectional view of a tile & support structure 10, wherein the support structure 30 may be configured as an extruded rail-like structure having a base 31 with a generally planar upward-facing surface. Generally, it is contemplated that one or more tiles 20 may rest upon the generally planar upward-facing surface of the base 31. The support structure 30 may be configured in a manner that is somewhat similar to a bottom portion or rail portion 37' of the roof support structures 30 shown in FIGS. 13-16, wherein the support structure 30 may include one or more side members 37*a*' having a notch 37*b*' formed in a side member 37*a*', and wherein the side members 37*a*' may extend downward from the base 31. Additionally, one or more bottom members 37*c*' may be engaged with the bottom edge of either side members 37*a*' in a manner analogous to that previously described with respect to FIGS. 15A & B without limitation unless so indicated in the following claims.

The support structure 30 may be formed with various walls, supports, channels, angles, and/or other features therein to provide the required rigidity and/or structural integrity for the specific application of the tile & support structure 10. A support structure 30 such as that shown in FIG. 17A may be engaged with one or more joists 14 in an elevated deck application, with a flat floor and/or sub-floor structure, a flat roof and/or sub-roof structure, and/or any other suitable structures, structural components, and/or surfaces without limitation unless so indicated in the following claims.

The support structure 30 may be formed with one or more anchors 38, which anchor(s) 38 may be configured to securely engage a portion of a fastener 16. The fastener 16 may engage the retaining element 60 such that the relative positions of the fastener 16 and retaining element 60 are fixed with respect to one another. Alternatively, the fastener 16 may engage the retaining element 60 such that the retaining element 60 may rotate with respect to the fastener 60. Still further, the fastener 16 may engage the retaining element 60 such that the retaining element 60 may move longitudinally along the axis of the fastener 16 (but not radially with respect to the longitudinal axis of the fastener 16), which movement may be allowed alone or in conjunction with rotation of the retaining element 60 with respect to the fastener 16. Accordingly, the scope of the present disclosure is not limited by the relative movement between the fastener and retaining element 60 unless so indicated in the following claims.

The retaining element 60, 60' may include a neck 62, 62', which may be integrally formed with retaining element 60, 60'. The neck 62, 62' may provide a limit to the distance into a support structure 30 or other suitable structure, structural component, and/or surface that a fastener 16 associated with the retaining element 60, 60' may penetrate. The optimal length of the neck 62, 62' may vary from one application of the tile & support structure 10 to the next without limitation unless so indicated in the following claims. However, it is contemplated that in some applications it may be advantageous to configure the length of the neck 62, 62' to be approximately equal to the thickness of the substrate 18 adjacent the groove 24*a*. It is contemplated that such a configuration may ease installation of a tile 20 by providing a type of automatic stop for the depth of a fastener 16 associated with a retaining element 60, 60', such that the exposed side of the retaining element 60, 60' may be relatively easily engaged with the groove 24*a* in another tile 20.

Figure 17B:
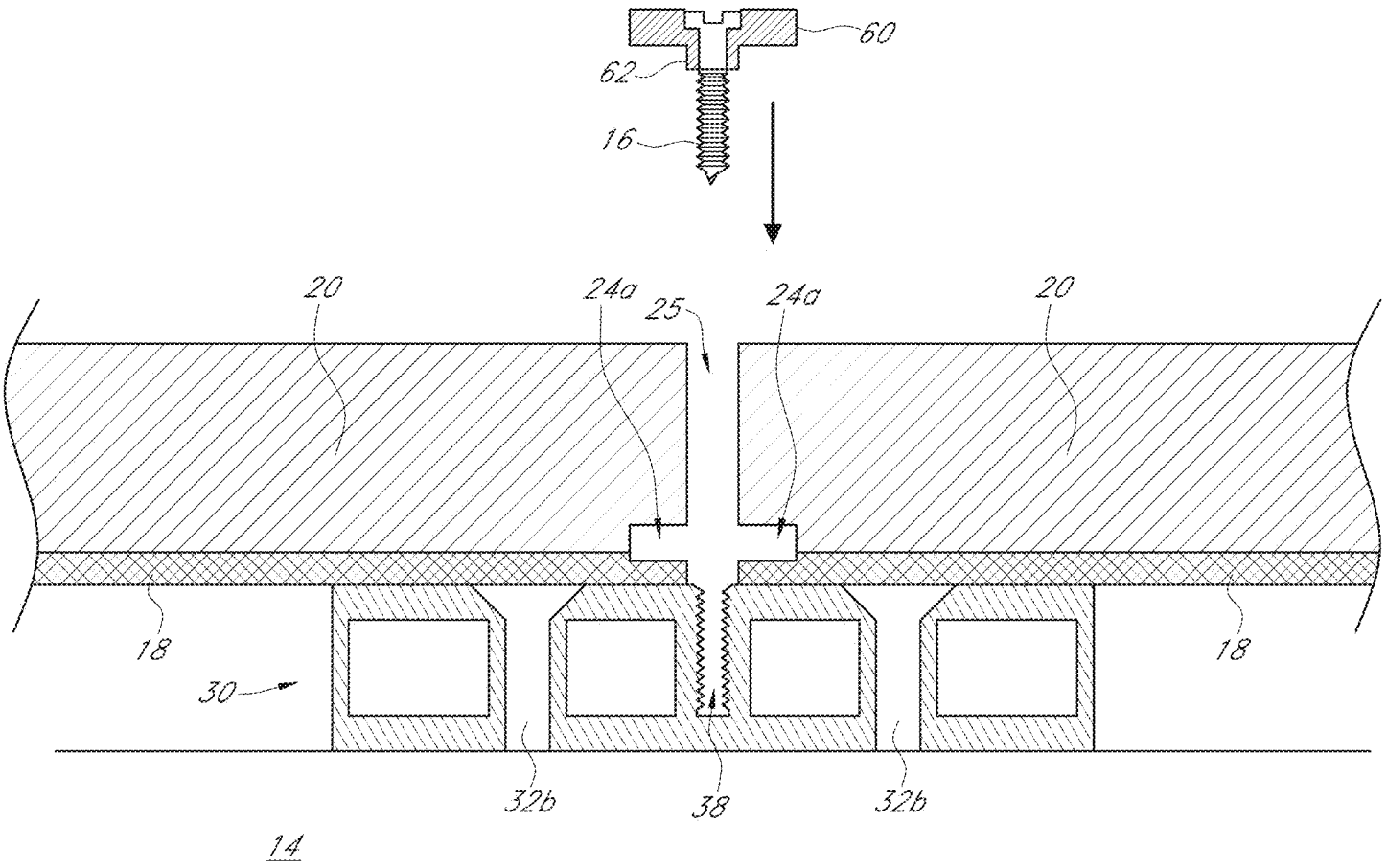
FIG. 17B is a cross-sectional view showing further aspects of a support structure.
Figure 17C:
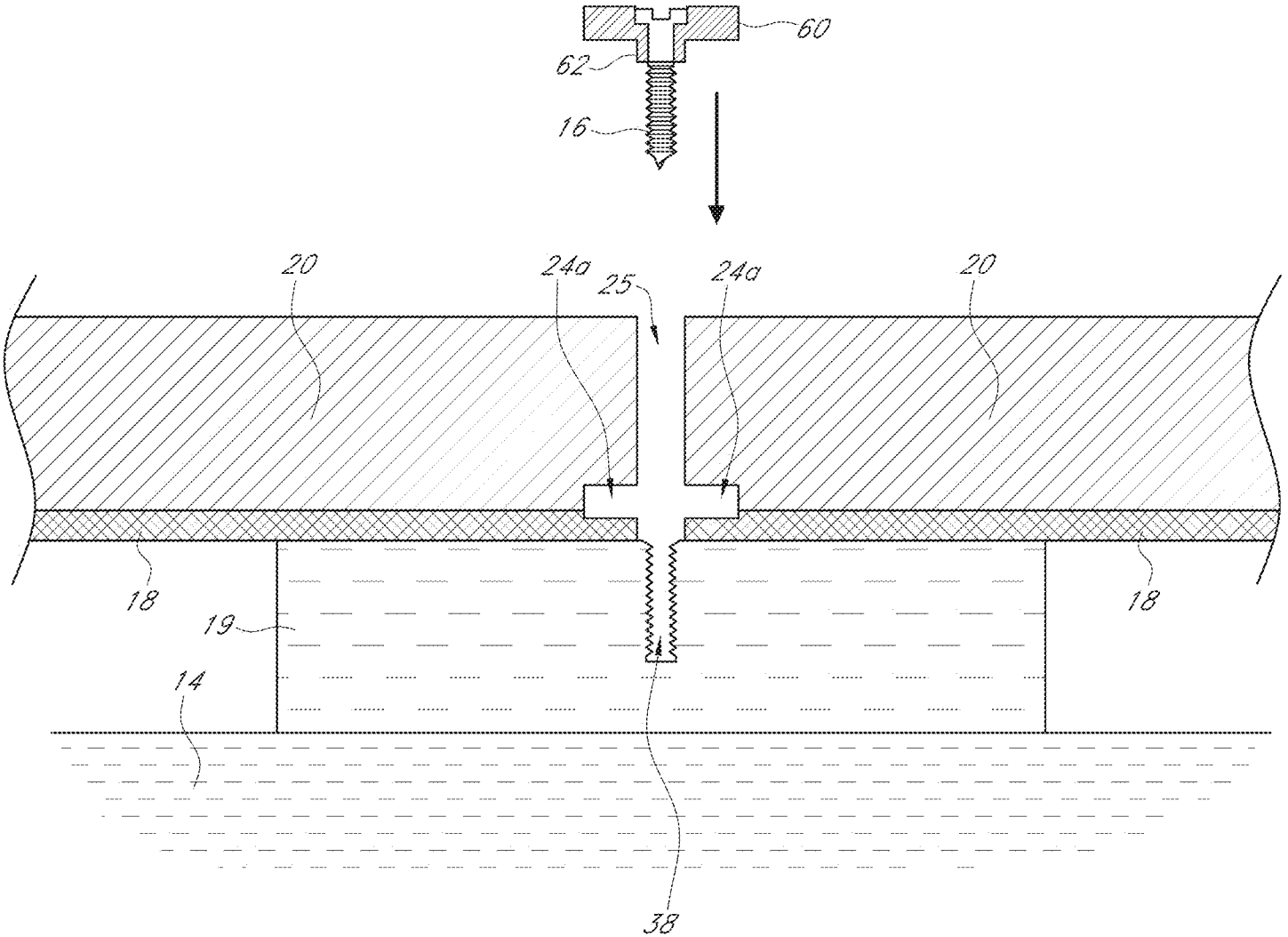
FIG. 17C is a cross-sectional view showing still further aspects of a support structure.
Figure 17D:
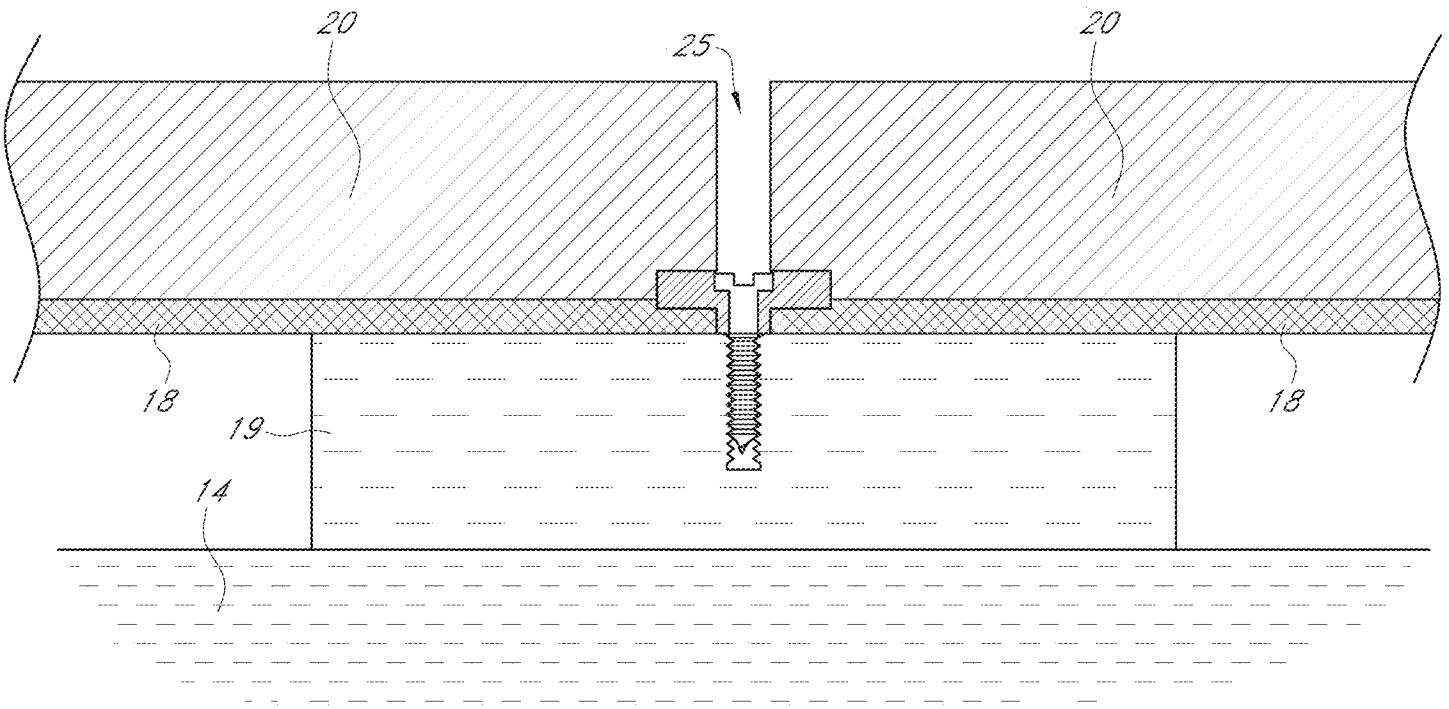
FIG. 17D is a cross sectional view of the support structure shown in FIG. 17C with the fastener and retaining element installed.
Figure 18:
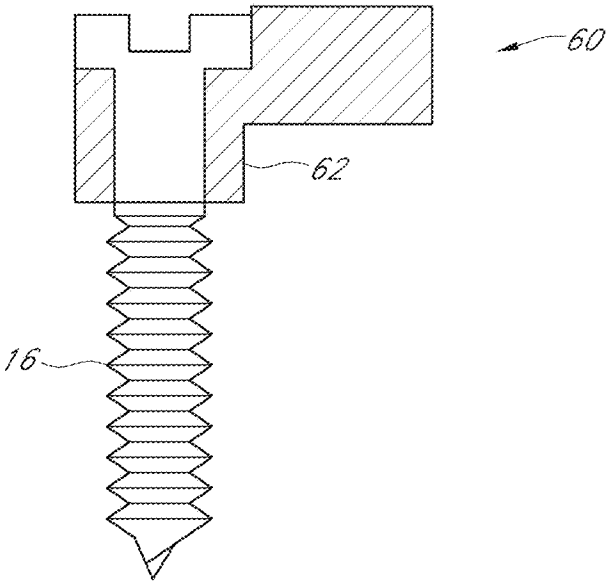
FIG. 18 is a cross-sectional view of a retaining element that may be used on a border.

Referring now to FIGS. 17A-17C, a portion of the retaining element 60 may be positioned in the groove 24*a* formed in the edges 24 of two adjacent tiles 20. It is contemplated that the retaining element 60 may be formed as a circle, an oval shape, or any other suitable shape without limitation unless so indicated in the following claims. For the tiles 20 and support structures 30 positioned at the borders, the retaining elements 60 may be configured such that the retaining elements 60 are asymmetrical in shape. Various aspects of a retaining element 60' that may be used on a border are shown in FIG. 18. That retaining element 60' may be configured to engage only one groove 24*a* in one tile 20 on a single side of the retaining element 60' as opposed to a retaining element 60 configured to engage a groove 24*a* in each of two adjacent tiles 20 on either side of the retaining element 60.

As shown in FIGS. 17A-17C, the anchor 38 may be configured as a threaded aperture and the fastener 16 may be configured as a screw and/or bolt with threads corresponding to those formed in the anchor 38. In an aspect, the threaded portion of the fastener 16 may pass through an aperture in the retaining element 60 and engage the anchor 38, thereby selectively securing the relative positions of the fastener 16, support structure 30, the retaining element 60, and the tiles 20 with grooves 24*a* in which the retaining element 60 is positioned. Alternatively, the various components may be configured such that after the threaded portion of the fastener 16 has passed through an aperture in the retaining element 60 and engaged the anchor 38, the tile(s) 20 with grooves 24*a* in which the retaining element 60 is positioned may be immobilized save for a dimension that is collinear with the length of the groove 24*a* for a specific tile 20. That is, the retaining element 60 and underlying support structure 30 may be configured such that tiles 20 may slide with respect to the retaining element 60 and support structure 30 during installation of the tile(s) 20, but such that after installation the relative positions of the retaining element 60 and support structure 30 are generally fixed with respect to the position of the tile(s) 20 in three dimensions. One or more retaining elements 60 may be configured such that in conjunction with an underlying structure (such as a support structure 30 or other suitable structures, structural components, surfaces) the retaining elements 60 prevents and/or mitigates uplift of one or more tiles 20 due to wind, prevents and/or mitigates unauthorized removal of a tile 20, and/or prevents and/or mitigates unwanted movement of the tile 20. It is contemplated that one or more retaining elements 60 may provide various benefits without the need for adhesive while simultaneously providing adequate securement of one or more tiles 20.

The width of the retaining element 60 and the width of the fastener 16 may be selected such that a clearance 25 exists between the edges 24 of adjacent tiles 20, wherein the clearance 25 is wide enough to allow access for selective removal of the fastener 16 by extending a tool (such as a screwdriver in one aspect) into the clearance 25 and engaging the tool with the fastener 16 to disengage the fastener 16 from the support structure 30. Alternatively, the tool may be extended into the clearance 25 and engage the fastener 16 to tighten the fastener 16 and/or engage the fastener 16 with the support structure 30. Accordingly, in an aspect a tile & support structure 10 utilizing retaining elements 60 as disclosed herein to secure the position of one or more tiles 20 with respect to a support structure 30, a user may selectively remove one or more tiles 20 singularly without removing unwanted tiles 20 and without cutting, breaking and/or otherwise altering the support structure 30 and/or tiles 20. It is contemplated that the ability to selectively remove one tile 20 at a time may be especially advantageous if one or more tiles 20 restrict access to certain items, such as ventilation ducts, electrical wiring, plumbing, etc.

Referring now to FIG. 17B, which shows a support structure 30 as it may be engaged with a joist 14, the tile & support structure 10 may be employed in a raised-deck application. It is contemplated that the tile & support structure 10 shown in FIG. 17A may provide the various benefits of other tile & support structures 10 disclosed herein, but which may be specifically adapted for use in a raised-deck application. The support structure 30 may be formed with one or more apertures 32*b* therein to provide a channel though which a fastener 16 may pass, which fastener 16 may be used to secure the support structure 30 to one or more joists 14 (or other suitable structure, structural component, and/or surface without limitation unless so indicated in the following claims).

Referring now to FIGS. 17A and 17B, it is contemplated that a plurality of tiles 20 may be installed using a retaining element 30 in a manner similar to that of installing tongue-and-groove coverings (e.g., flooring, ceilings, etc.). However, the scope of the present disclosure is not limited by the specific method of installation unless so indicated in the following claims. Still referring to FIGS. 17A and 17B, it is contemplated that for installation, a user may first secure a support structure 30 on a border, and then secure a second support structure 30 parallel to but spaced apart from the border support structure 30. The user may then install a row of tiles 20 with retaining elements 60' configured for border tiles 20 on the outer edge 24 of the tiles 20, wherein a fastener 16 associated with those retaining elements 60' may engage anchors 38 formed in the border support structure 30, and wherein a portion of the retaining element(s) 60' may be positioned in a groove 24*a* formed in the outer edge 24 of the border tile 20. The tile(s) 20 on either end of the row may be prevented from moving in at least two dimensions (e.g., the two horizontal dimensions) by a wall, baseboard, or other structure adjacent the row of tiles 20.

The user may then install retaining elements 60 on the inner edge 24 of the border tiles 20, wherein a fastener 16 associated with those retaining elements 60 may engage anchors 38 formed in the second support structure 30 that is adjacent to but spaced from the border support structure 30, and wherein a portion of the retaining element(s) 60 may be positioned in a groove 24*a* formed in the inner edge 24 of the border tile 20 (which inner edge 24 may rest on the second support structure 30). The optimum number of retaining elements 60, 60' engaged with a given tile 20 will vary from one application of the tile & support structure 10 to the next, and may be dependent at least upon the size of a tile 20, the number of tiles 20, and/or the elevation of the tile 20 from ground level. In an aspect, four retaining elements 60, 60' positioned approximately adjacent four corners of a tile 20 may be used to adequately fix the relative position of the tile 20. However, other numbers and/or relative positions of retaining elements 60, 60' may be used without limitation unless so indicated in the following claims, and the optimal number and/or relative positions may depend at least on the size and/or shape of the tile(s) 20.

At this point, the user may secure a third support structure 30 adjacent the second support structure 30 in an orientation that is parallel to but spaced from the second support structure 30. It is contemplated that for some applications, the distance between adjacent support structures 30 may be equal, while in other applications the distance between adjacent support structures 30 may vary at least depending on the uniformity of the size and/or shape of tiles 20 used therewith. Additionally, for certain applications it is contemplated that one or more of the support structures 30 may be radiused, curved, and/or otherwise non-linear. Accordingly, the scope of the present disclosure is in no way limited by the specific distance between adjacent support structures 30 or whether such support structures 30 are linear or non-linear unless so indicated in the following claims.

The user may place a first edge 24 of another tile 20 on the second support structure 30 such that a portion of the exposed retaining element(s) 60 slides into the groove 24*a* on the first edge 24 of the tile. A second edge 24 of the tile 20 that is parallel to but opposite of the first edge 24 may be placed on the third support structure 30 and one or more retaining elements 60 may be positioned in a groove 24*a* on the second edge 24, and the position of those retaining elements 60 relative to the tile 20 and third support structure 30 may be secured via engaging a fastener 16 with those retaining elements 60 and the third support structure 30. This process may continue until the desired number of tiles 20 are positioned on the support structures 30, at which time one or more retaining elements 60' may be engaged with a subsequent border support structure(s) 30 to secure the relative position of one or more subsequent border tiles 20. Because the support structures 30 may be configured as elongate, straight extrusions, it is contemplated that installation may be relatively expeditious.

Referring now to FIG. 17C, which shows various aspects of a tile & support structure 10 that may be configured for use with one or more laths 19 (which laths 19 include but are not limited to those constructed of wood unless so indicated in the following claims). It is contemplated that the method of installing a tile and support structure 10 such as that shown in FIG. 17C may be analogous to the method for the tile and support structure 10 shown in FIGS. 17A and 17B, wherein laths 19 are used in place of support structures 30. Accordingly, fasteners 16 associated with a retaining element 60, 60' may directly engage the lath 19, and the lath 19 may have predrilled holes for accepting fasteners 16, or the lathe 19 may be used without predrilled holes.

The optimal configuration (length, threads, diameter, etc.) of the fastener 16 associated with the retaining element 60, 60' may vary from one application of the tile & support structure 10 to the next, and may depend at least upon the configuration of the support structure 30 and/or other suitable structure, structural component, and/or surface to which the fastener 16 is secured during use. In another aspect, and without limitation unless so indicated in the following claims, the fastener 16 may be configured to engage a roof support structure 30', such as those shown in FIGS. 13-16B. In a specific illustrative example, a fastener 16 configured to engage a lath 19 may be configured with threads that are coarser and/or having a longer threaded portion than those on a fastener 16 configured to engage an anchor 38 in a support structure 30. Accordingly, the specific configuration of the fastener 16 in no way limits the scope of the present disclosure unless so indicated in the following claims.

The retaining elements 60, 60' may be constructed of any suitable material, including but not limited to metals, plastics, polymers, natural materials, and/or combinations thereof without limitation unless so indicated in the following claims. Additionally, it is contemplated that the thickness of a retaining element 60, 60' may optimally be slightly less than the thickness of the groove 24*a* in the edge 24 of a tile 20 for which the retaining element 60, 60' is designed, and that the shape may be any suitable shape (e.g., square, oblong, circular, rectangular, etc.). Accordingly, the retaining elements 60, 60' may be formed with any different thicknesses and/or shapes without limitation unless so indicated in the following claims.

Alternative Aspects of a Support System and Pedestal

Referring now to FIGS. 19A-23B, an aspect of a support structure 30 may include a pedestal 50. Such a support structure 30 may be configured as a roof support structure 30', but may also be configured for use with a deck, elevated patio, and/or any other surface without limitation unless so indicated in the following claims. It is contemplated that in an aspect, all or a portion of the support structure 30 may be engaged with a pedestal upper surface 54, which may be positioned opposite a pedestal base 52. As with other aspects of pedestals 50 previously described herein, it is contemplated that the pedestal base 52 may be engaged with an underlying supporting structure and/or surface, including but not limited to concrete unless so indicated in the following claims. Accordingly, any or other suitable structure, structural component, and/or surface may be used, including but not limited to wooden surfaces, synthetic surfaces, metallic surfaces, etc. without limitation unless so indicated in the following claims.

In an aspect, it is contemplated that a pedestal 50 may be adjustable for height via an adjustment portion 53 (which may be positioned between the pedestal base 52 and pedestal upper surface 54) and/or slope to accommodate variances in the structure, structural component, and/or surface to which the pedestals 50 are engaged and/or to provide a slope to the tile 20 engaged with the pedestal 50 so as to adequately drain moisture from the tiles 20. Further, it is contemplated that in an aspect all or a portion of what would constitute the support structure 30 may be integrally formed with a portion of the pedestal 50, such as the pedestal upper surface 54, as further described in more detail below. However, the scope of the present disclosure is not so limited unless so indicated in the following claims. For purposes of clarity, the term "pedestal 50" as used when referring to FIGS. 19A-23B may be used in a manner that is inclusive of the support structure 30.

As shown, a pedestal 50 may be configured with one or more spines 34 extending from a pedestal upper surface 54. In an aspect shown at least in FIGS. 19A-22A, one or more spines 34 may extend upward from the pedestal upper surface 54 along and/or adjacent to a diameter of the pedestal upper surface. In an aspect of a pedestal 50 shown at least in FIGS. 19A-22B, this diameter may be collinear with a diameter of the pedestal base 52 and/or adjustment portion 53. That is, in one aspect a common line may pass through the geometric center point of the pedestal upper surface 54, the geometric center point of the adjustment portion 53, and/or the geometric center point of the pedestal base 52. In an aspect, as many as four spines 34 may extend from a single pedestal upper surface 54, various aspects of which are shown in FIG. 22B, or as few as one spine 34 may extend from a single pedestal upper surface 54, various aspects of which are shown in FIGS. 19A, 19B, and 21.

Figure 22B:
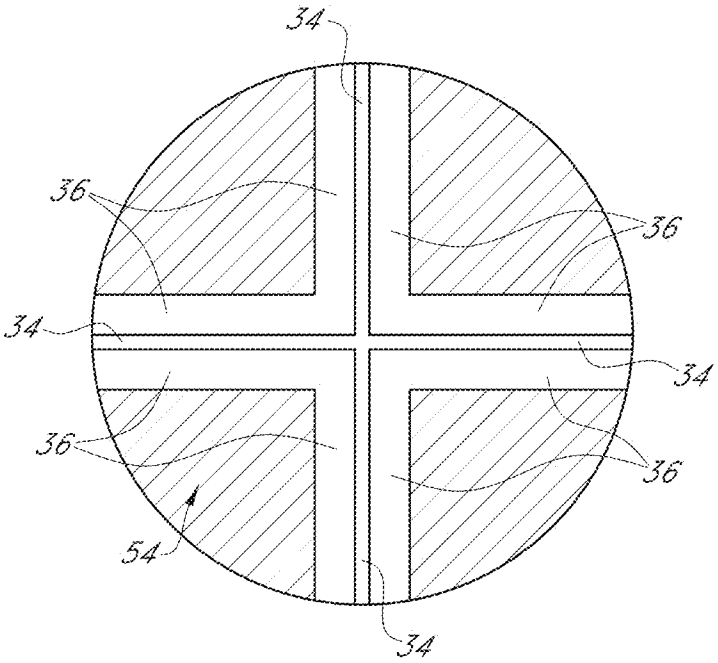
Figure 22A:
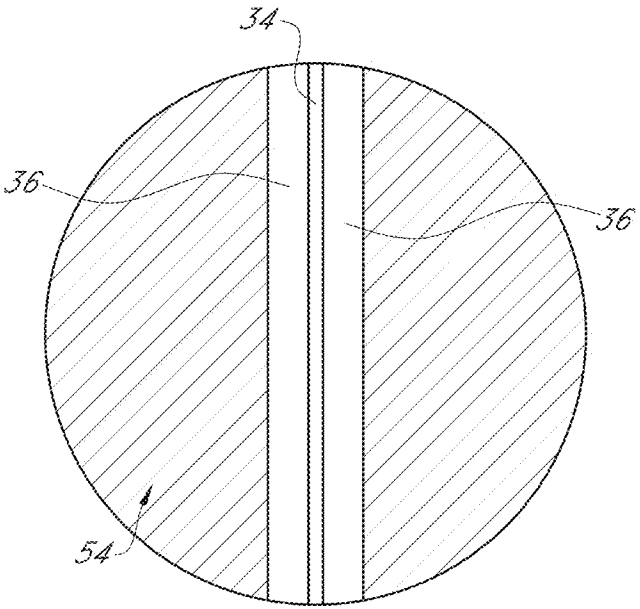
FIG. 22A provides a top view showing additional aspects of a support system that may be engaged with a pedestal.

The spines 34 may be configured such that the four spines 34 comprise two pairs of collinear spines 34 (which configuration is shown at least in FIG. 22B), wherein the two pairs may be perpendicular with respect to one another and positioned along diameters of the pedestal upper surface 54 intersecting one another at a right angle. The spines 34 may extend all the way to the center point of the pedestal upper surface 54 as shown in FIGS. 22A and 22B, or the spines 34 may extend only part way between the periphery of the pedestal upper surface 54 and the center point of the pedestal upper surface 54 (as shown in FIGS. 19A-20B).

Accordingly, the distance along the pedestal upper surface 54 that a given spine 34 extends in no way limits the scope of the present disclosure unless so indicated in the following claims.

Figure 19A:
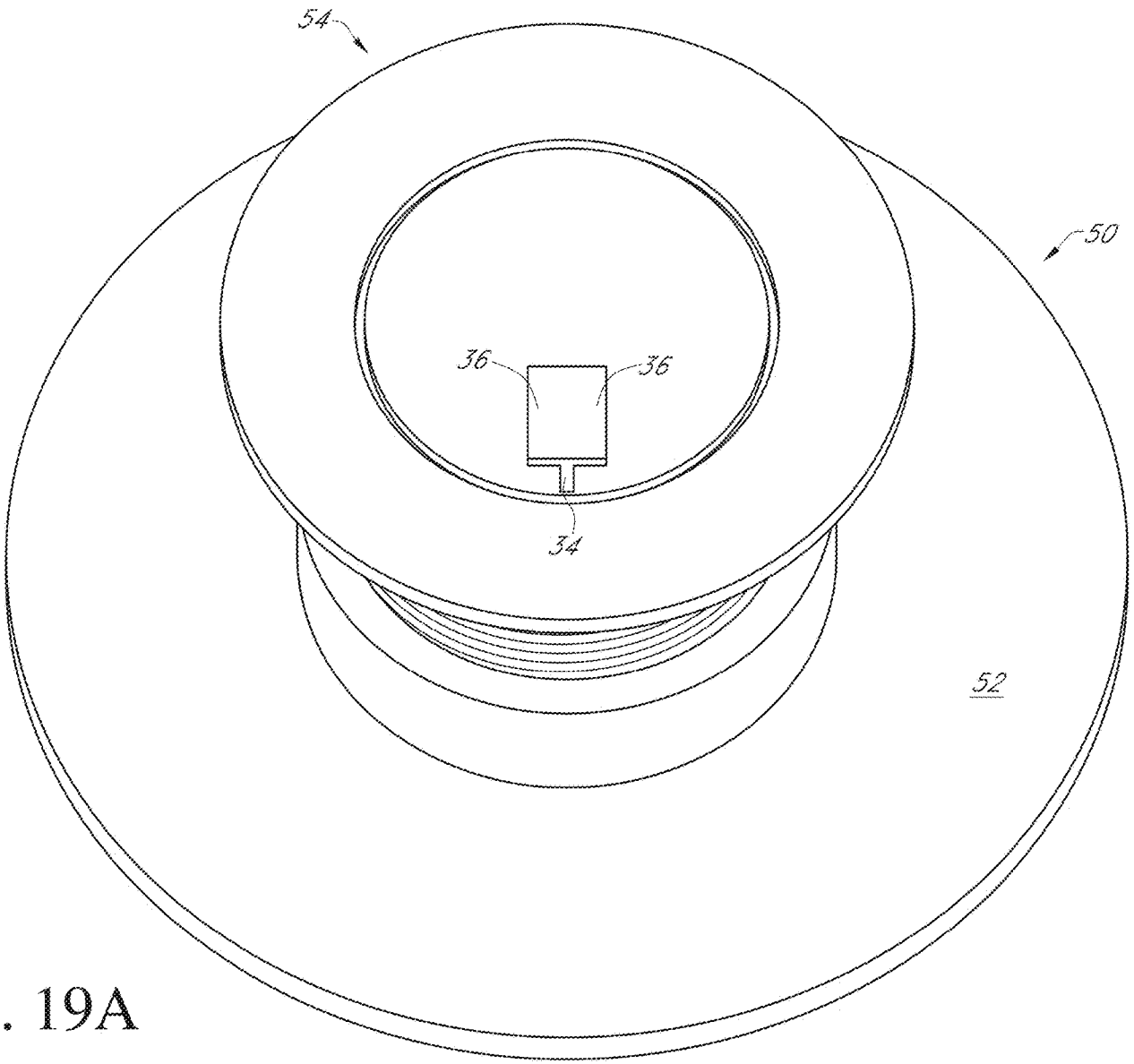
FIG. 19A provides an elevated perspective view showing aspects of a support system that may be engaged with a pedestal.
Figure 19B:
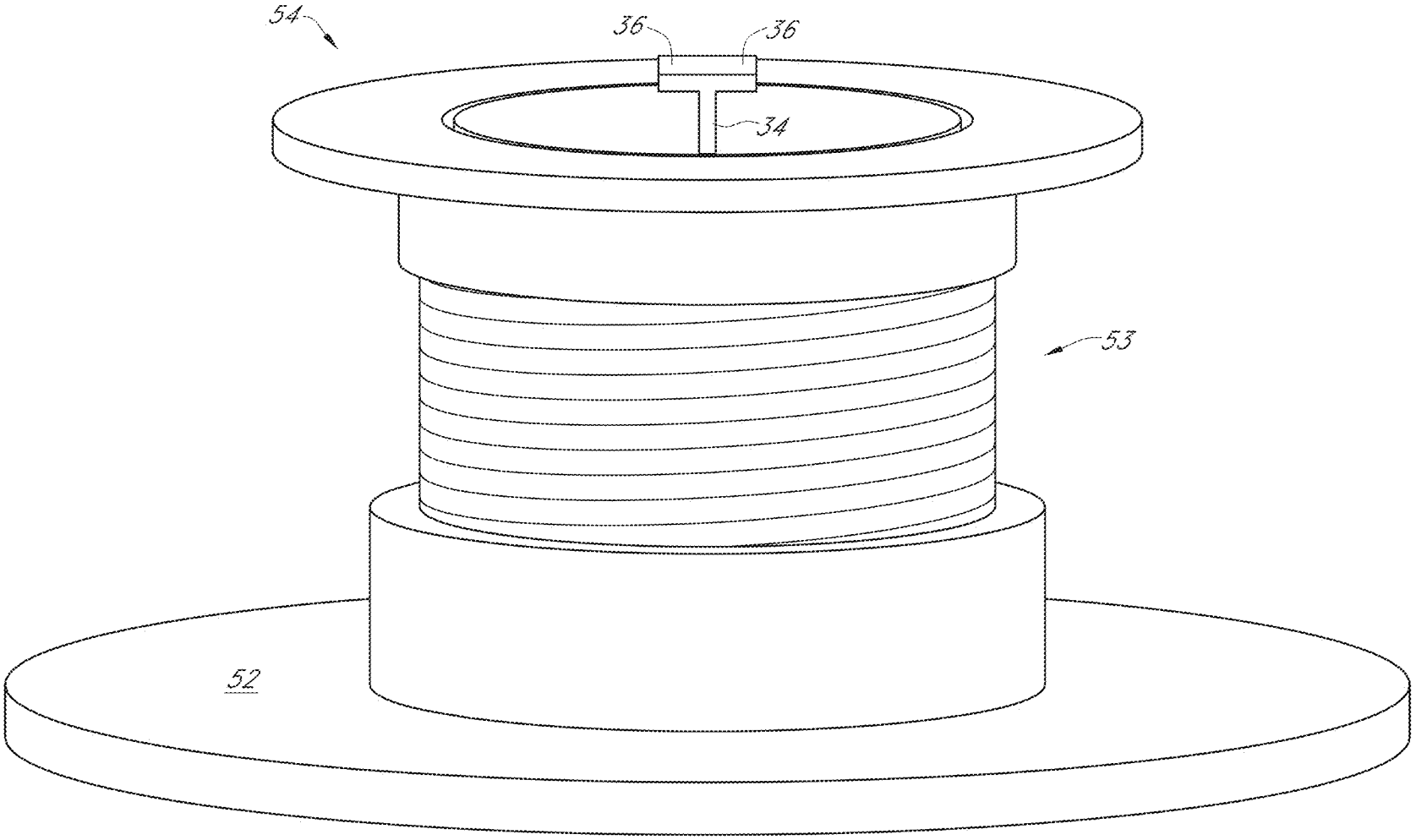
FIG. 19B provides a side view of the support system and pedestal shown in FIG. 19A.
Figure 20A:
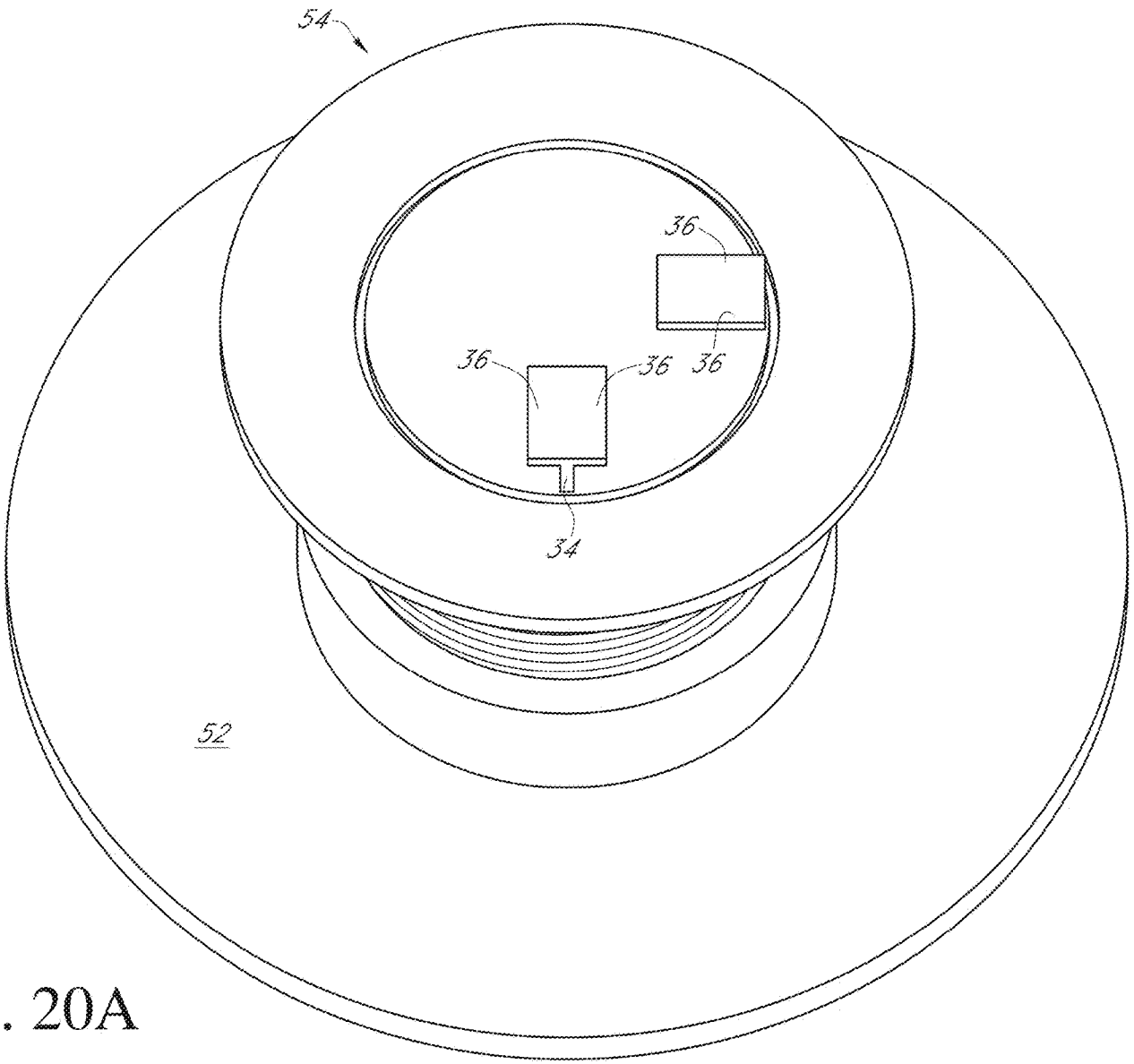
FIG. 20A provides an elevated perspective view showing further aspects of a support system that may be engaged with a pedestal.
Figure 20B:
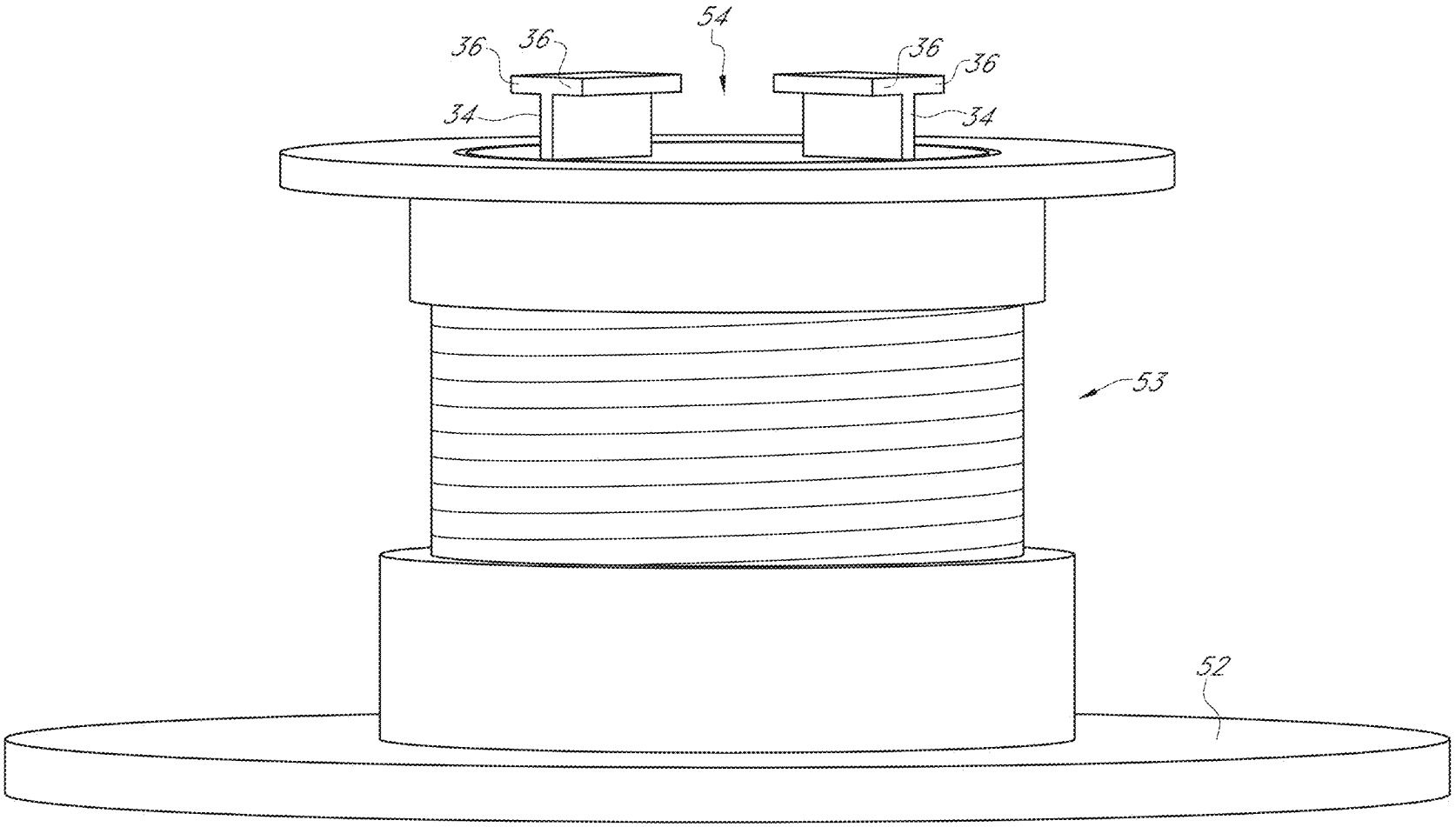
FIG. 20B provides a side view of the support system and pedestal shown in FIG. 20A.
Figure 21:
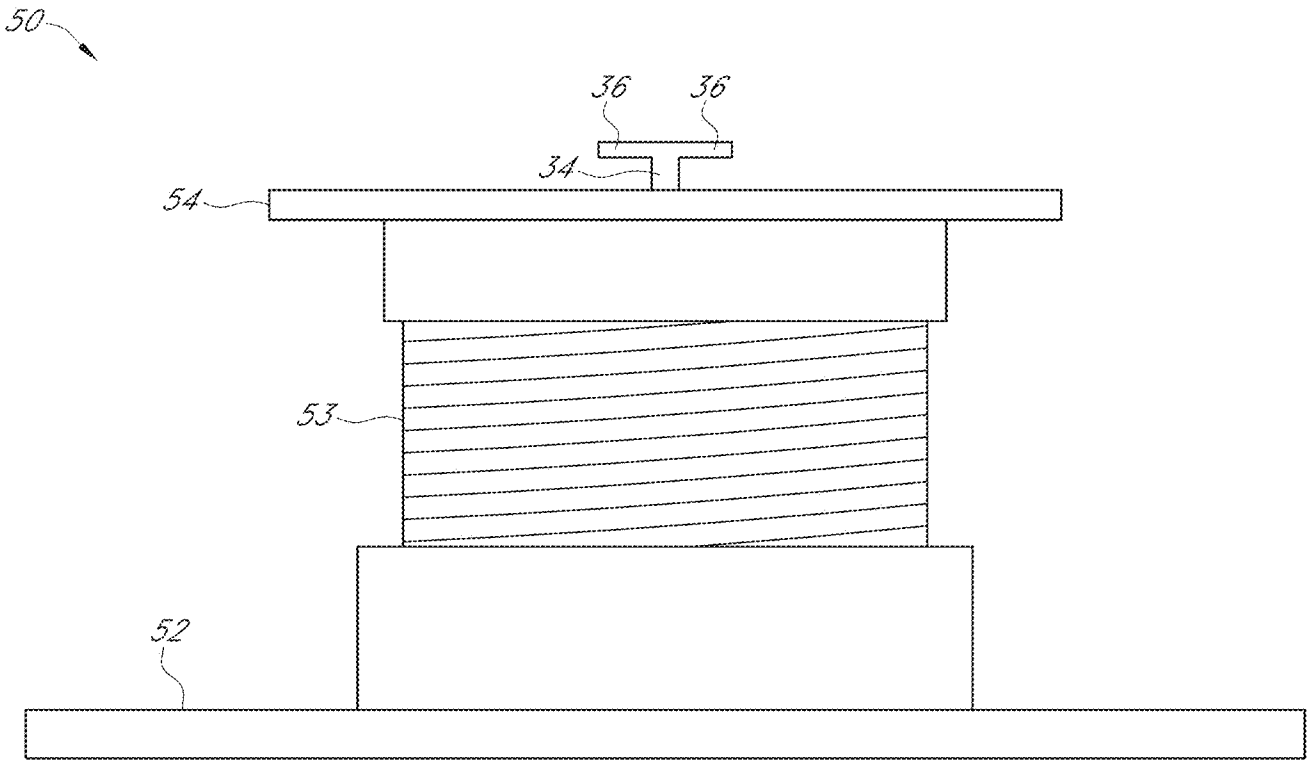
FIG. 21 provides a side view of another aspect of a support system that may be engaged with a pedestal.

In another aspect shown at least in FIGS. 19A, 19B, and 21, one spine 34 may extend from a pedestal upper surface 54 along a first diameter thereof. In still another aspect shown at least in FIGS. 20A and 20B, two spines 34 may extend from the pedestal upper surface 54, wherein a first spine 34 may be positioned on a first diameter of the pedestal upper surface 54 and a second spine 34 may be positioned on a second diameter of the pedestal upper surface 54, wherein the first and second diameters may be perpendicular with respect to one another. In still a further aspect, two spines 34 may extend upward from the pedestal upper surface 54 along a first diameter thereof, wherein a first spine 34 may be positioned on an opposite side of the center point of the pedestal upper surface 54 with respect to a second spine 34. Accordingly, the specific number, orientation, and/or configuration of spines 34 extending from a pedestal upper surface 54 in no way limits the scope of the present disclosure unless so indicated in the following claims.

At the top distal end of the spine 34, two corresponding rails 36 may extend outward from the spine 34 in a generally horizontal dimension. In this aspect, the spine 34 and rails 36 may correspond directly to the spine 34 and/or rail(s) 36 previously described regarding aspects of a support structure 30 in FIGS. 4-12C and/or to the spine 34' and rail(s) 36' previously described regarding aspects of a roof support structure 30' in FIGS. 13-16B. However the spine 34 and/or rail(s) 36 may be differently configured without limitation unless so indicated in the following claims.

In certain applications, it may be advantageous to construct the pedestal 50, spine 34, and/or rail(s) 36 of a plastic, polymer, or other synthetic material, or of a metal or metallic alloy. However, those elements may be constructed of any suitable material, including but not limited to plastic, polymers, natural materials, metals and their alloys and/or combinations thereof without limitation unless so indicated in the following claims. Additionally, in certain applications it may be advantageous to construct the pedestal 50 (and/or a portion thereof, such as the pedestal upper surface 54) integrally with the spine 34 and/or rail(s) 36, or it may be advantageous to construct certain portions separately and later join them together.

It is contemplated that in one aspect, the pedestal upper surface 54 may be removably engaged with another portion of the pedestal 50, such as a top part of the adjustment portion 53. For example, Eurotec, GmbH in Germany manufactures adjustable pedestals having an upper part, a threaded ring, an extension ring, and a baseplate. As mentioned above regarding a "click adapter," different adapters may be selectively engaged with the upper part of the pedestal to provide a modular system. In an aspect, the spine(s) 34 and/or rail(s) 36 may be formed on another adaptor for selective engagement with the upper part to make a pedestal 50 with a support structure 30 therein, which may share aspects with the pedestals 50 and support structures 30 shown in FIGS. 19A-23B. It is contemplated that the pedestal upper surface 54 (when using a pedestal such as that previously described and manufactured by Eurotec, GmbH) may comprise a portion of the upper part and a portion of an adaptor formed with one or more spines 34 and one or more rails 36. Accordingly, the scope of the present disclosure is not limited by whether the pedestal 50 having one or more spines 34 and one or more rails 36 is comprised of a separate pedestal portion and a selectively removable adaptor portion (on which adaptor portion the spine(s) 34 and rail(s) 36 are formed), or if the spine(s) 34 and rail(s) 36 are integrally formed with the pedestal 50 itself, thereby foregoing the requirement of a separate adapter portion unless so indicated in the following claims. Accordingly, the scope of the present disclosure is not limited by whether the various portions of a pedestal 50, spine(s) 34, and/or rail(s) 36 engaged therewith are integrally formed with one another or separately formed and later engaged with one another unless so indicated in the following claims.

As previously described in detail above, opposite edges 24 of a tile 20 may be formed with a groove 24*a* therein, as shown in FIGS. 10, 12A, and 12B. The groove 24*a* may be formed in the edge 24 of the tile 20, in a portion of the edge 24 of the tile 20, in a portion of a surface of a substrate 18 (if present), and/or a combination of a portion of the tile 20 and a portion of the substrate 18 without limitation unless so indicated in the following claims. The groove 24*a* may be configured such that it cooperates with the rail 36 at the top distal end of the spine 34, and such that the bottom face 22 of the tile 20 (or bottom surface of the substrate 18, if present for that embodiment of a tile 20) rests upon the pedestal upper surface 54. Again, the pedestal upper surface 54 may be comprised of a portion of the adaptor and a portion of the upper part of the pedestal if a pedestal and corresponding adaptor is employed. The configuration (e.g., size, dimensions, shape) of the pedestal upper surface 54, spine 34, and/or rails 36 may vary from one application of the tile and support structure 10 to the next, and may vary depending at least upon the size, shape, and weight of the tile(s) 20 engaged with the pedestal upper surface 54. In one aspect, it may be advantageous to configure the pedestal upper surface generally in a circular shape having a diameter of between 4 and 16 inches in diameter. However, the scope of the present disclosure is not so limited unless indicated in the following claims. This configuration may be especially useful in preventing wind uplift for tiled surfaces (e.g., deck, patio, roof surfaces, etc.) without the need for elongate support structures 30 such as those previously described and shown in FIGS. 2-7. Instead, pedestals 50 configured with one or more spines 34 and one or more rails 36 may be strategically positioned to support a plurality of tiles 20 as described in further detail below (which strategic positioning may be adjacent one or more corners of a tile 20 without limitation unless so indicated in the following claims).

In an aspect, the pedestal 50 shown in FIGS. 19A and 19B and the pedestal 50 shown in FIG. 21 may be used to support two tiles 20, wherein one rail 36 corresponds to each tile 20. In an aspect, each rail 36 may be positioned adjacent a corner of the tile 20 during use. However, in other aspects the rail 36 may be positioned on an interior portion of the tile 20 as described below. Accordingly, the optimal position along the edge 24 of a tile 20 at which a rail 36 engages the tile 20 may vary from one application of the present disclosure to the next, and is therefore in no way limiting to the scope of the present disclosure unless so indicated in the following claims. As previously described, it is contemplated that a rail 36 may optimally engage a tile 20 at a groove 24*a* formed in an edge 24 of the tile 20.

In an aspect of the pedestal 50 shown in FIG. 22A, the pedestal 50 may be used to support two tiles 20 positioned on either side of the spine 34. Alternatively, the pedestal 50 shown in FIG. 22A may be used to support four tiles 20, wherein corners of adjacent tiles 20 may be offset from one another, or wherein corners of adjacent tiles 20 may be positioned adjacent one another at or around the center point of the pedestal upper surface 54. In such a configuration, at least one edge 24 of a tile 20 may not require a groove 24*a* formed therein, as that edge 24 of a tile 20 may directly abut an edge 24 of an adjacent tile 20. It is contemplated that each rail 36 may be positioned at any point along the length of the tile 20, wherein a tile 20 may be positioned on either side of the spine 34. In an aspect, the spine 34 may extend along the entire width and/or length of the pedestal upper surface 54 (as depicted in at least FIG. 22A), or the spine 34 may extend along only a portion of the pedestal upper surface 54 (as depicted at least in FIGS. 19A-20B) without limitation unless so indicated in the following claims.

Referring now specifically to FIG. 22B, which provides a top view of a pedestal 50 having two pairs of collinear spines 34, wherein the two pairs may be perpendicular with respect to one another and positioned along diameters of the pedestal upper surface 54, the pedestal 50 may be configured to simultaneously engage up to four tiles 20. It is contemplated that the pedestal 50 depicted in FIG. 22B may optimally engage each tile 20 at or adjacent to the corner thereof. Grooves 24*a* formed in perpendicular edges 24 that intersect one another on a single tile 20 may by engaged with rails 36 extending toward the respective edges 24 from spines 34 that are oriented perpendicular with respect to one another (and parallel with respect edges 24 of the tile 20). The opposite rails 36 engaged with those spines 34 may engage grooves 24*a* formed in a second and a third tile 20, respectively, and other grooves 24*a* in the second and third tiles 20 may be engaged with other rails 36 extending from additional spines 34, respectively. Accordingly, in light of the present disclosure it will be apparent to those skilled in the art that the pedestal shown in FIG. 22B may simultaneously engage up to eight grooves 24*a* formed in eight respective edges 24 of four respective tiles 20 via eight respective rails 36 configured as pairs extending from four respective spines 34. However, the scope of the present disclosure is not so limited unless so indicated in the following claims.

Figure 23B:
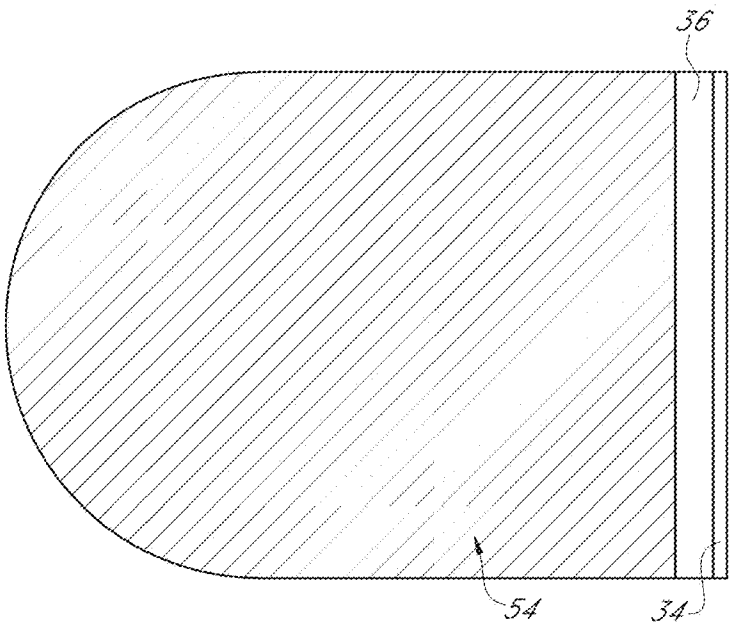
Figure 23A:
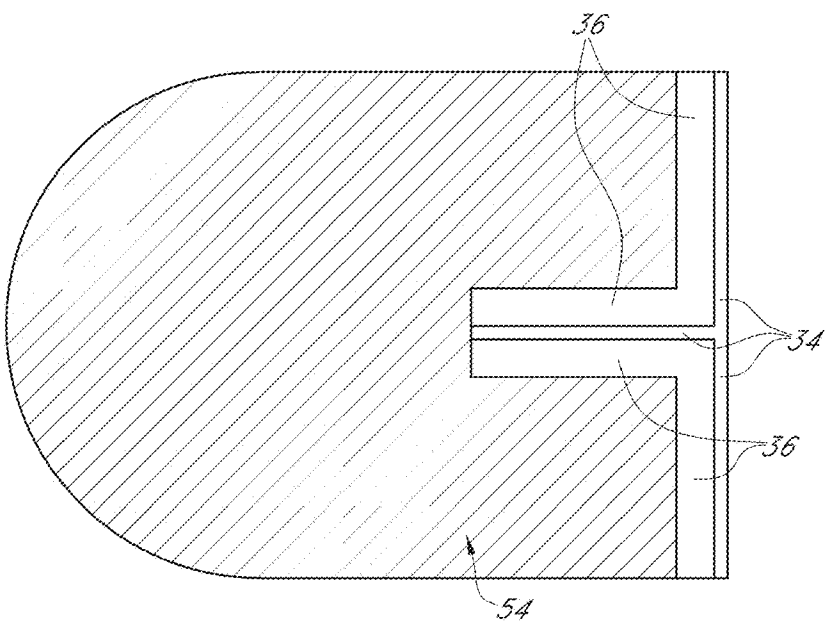
Figure 24:
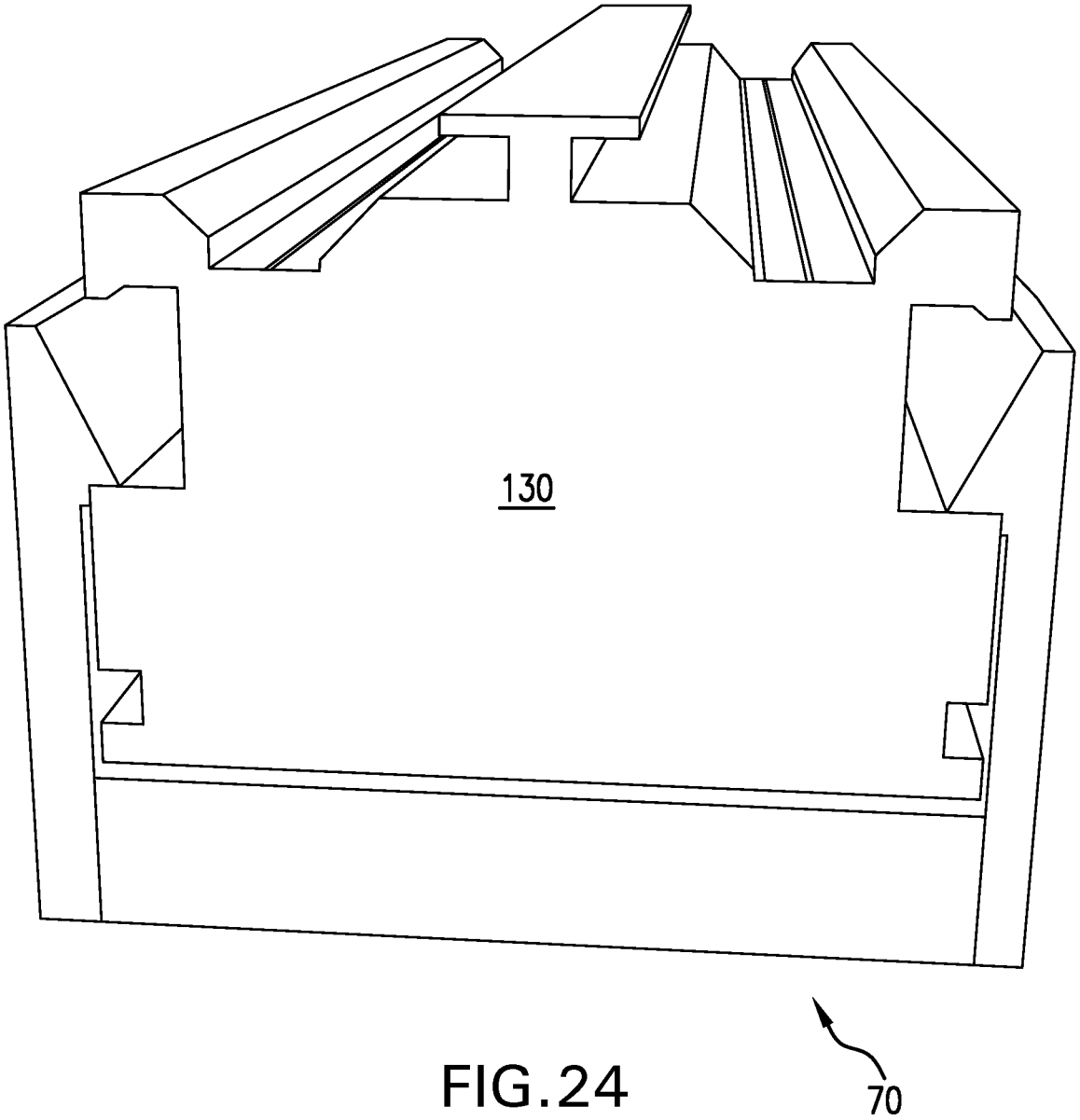
FIG. 24 provides an end view of a support structure engaged with a securement clip.

In an aspect of the pedestals 50 shown in FIGS. 23A and 23B, the pedestal base 52 may be offset from the spine 34, adjustment portion 53, and/or pedestal base 52. It is contemplated that pedestals 50 and/or spines 34 so configured may be especially useful at an edge or border of a tiled surface, such as adjacent a wall or edge of a roof. Again, a rail 36 extending outward from the spine 34 may engage a groove 24*a* formed in respective edges 24 of tiles 20. However, the scope of the present disclosure is not limited by the relative position of one pedestal 50 with respect to another and/or the number of tiles 20 engaged with a given pedestal 50 unless so indicated in the following claims.

Referring specifically to FIG. 23A, the pedestal 50 may be used to engage up to two tiles 20 at adjacent corners of those tiles 20. As with various other pedestals 50 disclosed herein, it is contemplated that a corner of a tile 20 may be positioned adjacent the intersection of two perpendicular spines 34. The pedestal 50 may be configured such that a first spine 34 along a straight edge of the pedestal upper surface 54 includes one rail 36 extending outward therefrom toward the center of the pedestal upper surface 54 and a second spine perpendicular to the first spine 34 includes two rails 36 extending outward therefrom. The rail 36 on the first spine 34 may engage grooves 24*a* on collinear edges 24 of the two adjacent tiles 20. Each rail 36 of the second spine 34 may engage parallel grooves 24*a* formed in parallel edges 24 of those tiles 20 (which parallel edges 24 may be perpendicular to the collinear edges 24). However, other configurations of spines 34, rails 36, and/or tiles 20 may be used without departing from the scope of the present disclosure unless so indicated in the following claims.

Referring specifically to FIG. 23B, the pedestal 50 may be used to engage up to two tiles 20 at adjacent corners of those tiles 20 via a single rail 36 extending from a single spine 34 in a direction toward the center point of the pedestal upper surface 54, wherein corners of adjacent tiles 20 may be adjacent. In such a configuration, at least one edge 24 of a tile 20 may not require a groove 24*a* formed therein, as that edge 24 of a tile 20 may directly abut an edge 24 of an adjacent tile 20 (e.g., the edges 24 oriented perpendicular with respect to the spine 34). Alternatively, the pedestal 50 may be used to engage a single tile 20 along a given groove 24*a* formed in an edge 24 thereof, such that all or a portion of the rail 36 is positioned in a single groove 24*a* of a single tile 20. The rail 36 may be positioned at any point along the length of the tile(s) 20, and the spine 34 may constitute a border or periphery of the tiled surface in a manner similar to that previously described with respect to the pedestal 50 shown in FIG. 23A.

In an aspect, the spine 34 may be positioned along a straight edge of the pedestal upper surface 54. However, in another aspect, the spine 34 and/or rail(s) 36 may be curved, contoured, and/or non-linear so as to follow a curved, contoured, and/or non-linear edge 24 of a particular tile 20. Accordingly, the specific orientation and/or configuration of a tile 20 or tiles 20, pedestal 50, pedestal base 52, pedestal upper surface 54, spine 34, and/or rail(s) 36 for any illustrative aspects of a pedestal 50, spine 34, and/or rail(s) 36 in no way limits the scope of the present disclosure unless so indicated in the following claims.

Generally, a tiled surface (e.g., roof, deck, patio, etc.) may be constructed using pedestals 50 such as those shown in FIGS. 19A-23B using a method similar to those previously described herein for the support structures 30, roof support structures 30', and/or support structures 30 in conjunction with a retaining element 60. Alternatively, in an aspect of a pedestal 50 having an adapter portion configured with one or more spines 34 and one or more rails 36, the pedestal bases 52 may be secured and arranged in a desired manner first Next, rails 36 of corresponding adapters may be engaged with grooves 24*a* of a tile 20 such that the relative positions of the adapters correspond to relative positions of the pedestal bases 52, and such that the adapter(s) and corresponding tile 20 may be lowered simultaneously until the adaptor(s) engages the pedestal(s) 50 (which engagement may be primarily at the pedestal upper surface 54 and/or adjacent portion) and the tile 20 is supported by the pedestal(s) 50. However, the feasibility of such a method of constructing a tiled surface may depend on the specific configuration of the spines 34 and/or rails 36 on the adapter, and specifically may depend at least on the number of tiles 20 that the adapter is configured to engage, the position on the edge 24 that the tile 20 engages the groove 24*a*, and/or the shape of the tile 20 without limitation unless so indicated in the following claims.

The pedestals 50, spine(s) 34, and/or rail(s) 36 may be configured such that the position of a tile 20 relative to the position of a pedestal 50 and/or the position of another tile 20 may be fixed in one dimension, two dimensions, or three dimensions without limitation unless so indicated in the following claims. In an aspect, one or more spines 34 and/or rails 36 may cooperate with one or more adjacent tiles 20 to fix the relative position of a tile 20 with respect to one or more pedestals 50 and/or other tiles 20 without limitation unless so indicated in the following claims. Additionally, the pedestals 50 shown in FIGS. 19A-23B (and/or pedestals 50 providing similar features, functionality, and/or benefits thereto) may be used with one another, with a support structure 30, and/or with a roof support structure 30' similar to, or with aspects that are correlative to, that shown in FIGS. 2-9, 11A-12C, and/or 14-16B, and/or a retaining element 60, 60' similar to that shown in FIGS. 17A-18 without limitation unless so indicated in the following claims.

Support Structure and Securement Clip

Referring now to FIGS. 24-26B, another support structure 130 may be configured for use with a securement clip 70. It is contemplated that the support structure 130 and securement clip 70 (any additional elements included therewith, including but not limited to tiles 20 unless otherwise indicated in the following claims) may be configured to comply with one or more wind uplift standards, which wind uplift standards may be applicable to residential or commercial structures, domestic or foreign regulatory bodies, and/or combinations thereof without limitation unless so indicated in the following claims. Additionally, the support structure 130 and securement clip 70 so configured may be utilized with decking and/or roofing applications without limitation unless so indicated in the following claims.

The support structure 130 may be configured with a base 131, flange(s) 132, trough(s) 132*a*, aperture(s) 132*b*, lip(s) 133, spine(s) 134, tip(s) 134*a*, and/or rail(s) 136 as previously described in detail above herein and as shown in various figures herein for engagement with one or more tiles 20. For purposes of brevity, such features will not again be described for the support structure 130 shown in FIGS. 24-26B.

The support structure 130 shown in FIG. 24-26B may be configured to engage a securement clip 70 in such a manner that the vertical movement of the support structure 130 may be prevented and/or limited via the engagement between the support structure 130 and the securement clip 70. It is contemplated that for certain applications it may be advantageous to integrate all or a portion of the securement clip 70 into a pedestal, such as a height adjustable pedestal, a portion of which may be configured similarly to those shown in FIGS. 16A, 16B and 19A-21 as described in further detail below.

Figure 25A:
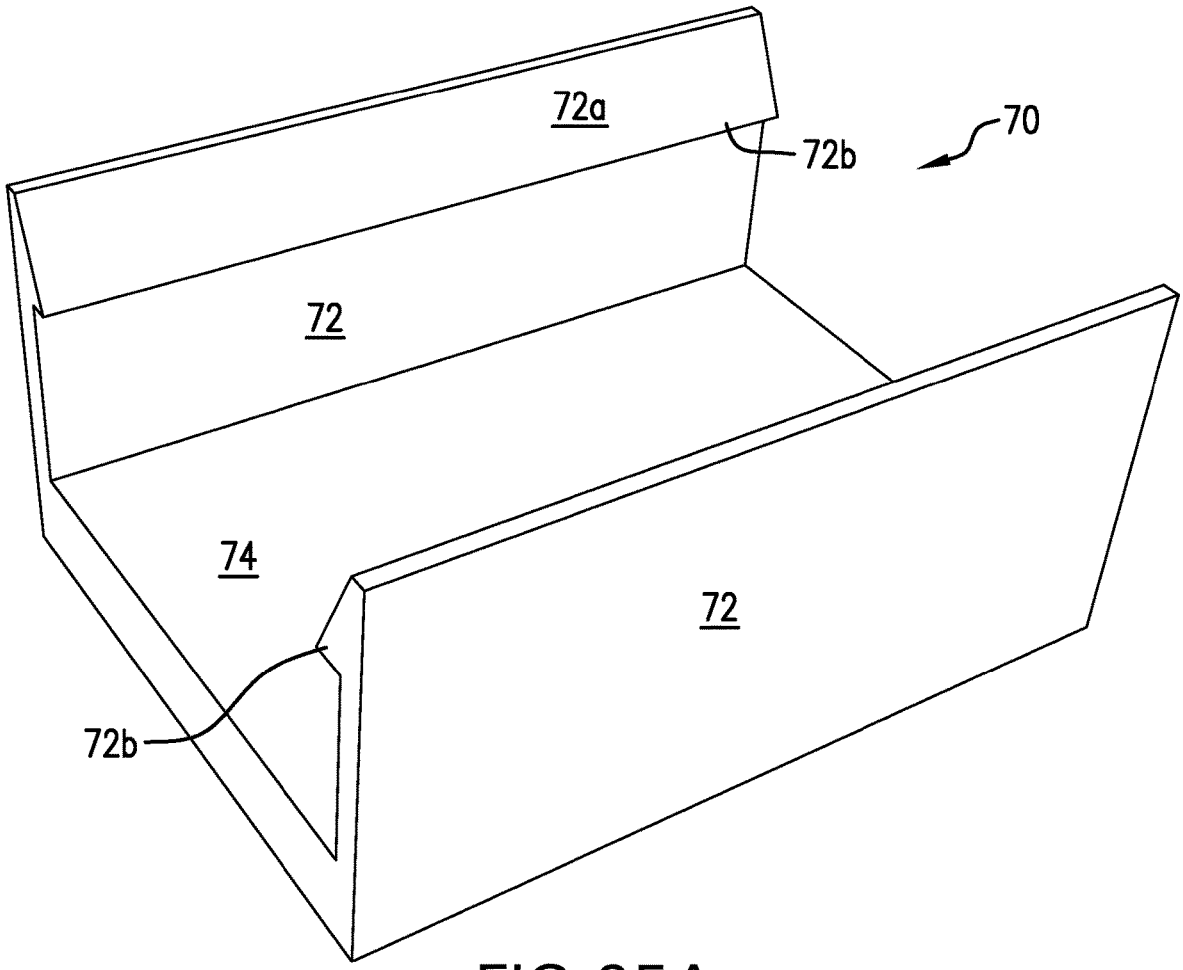
FIGS. 25A-25C provide various views of the securement clip shown in FIG. 24.
Figure 25B:
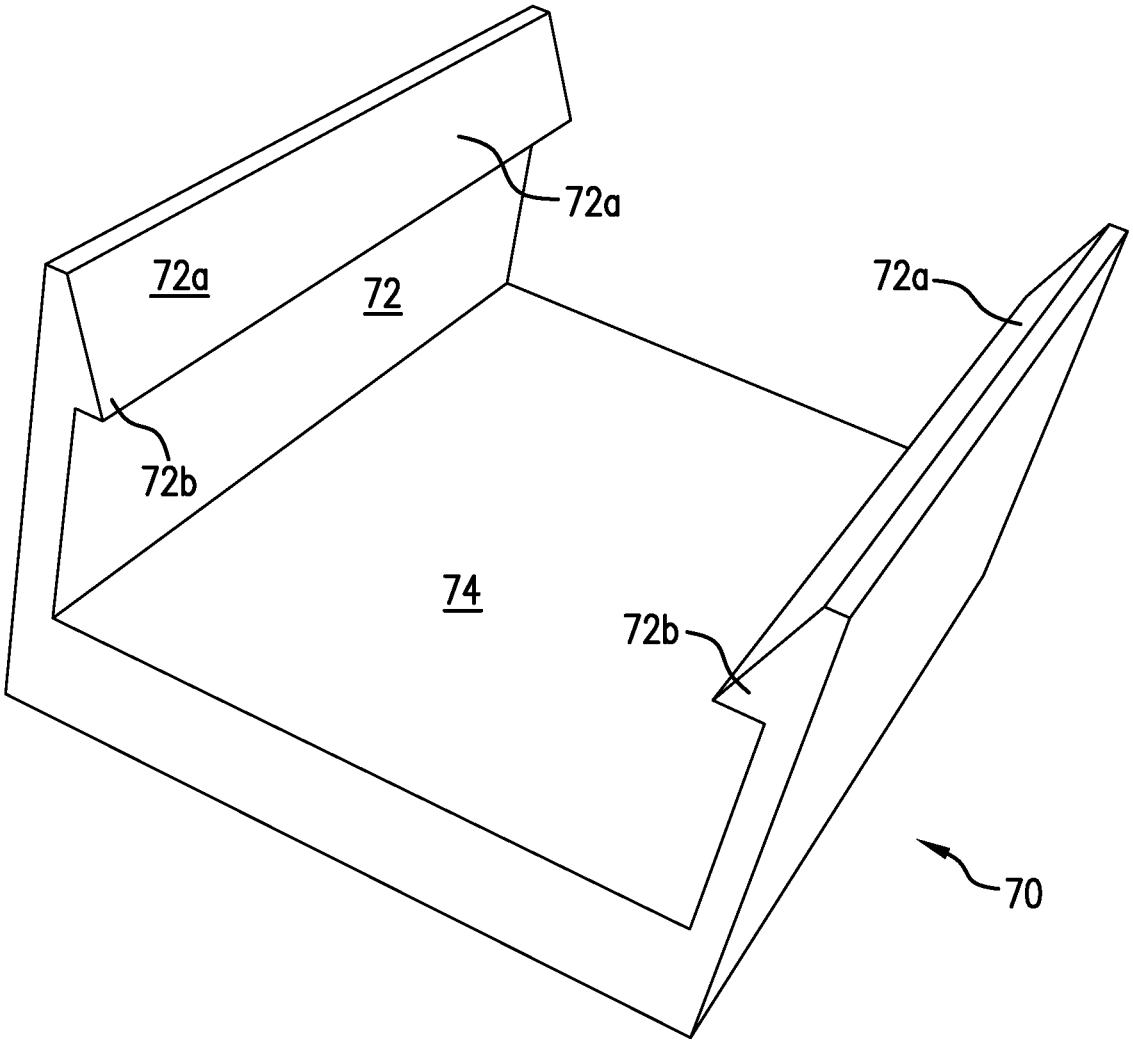
Figure 25C:
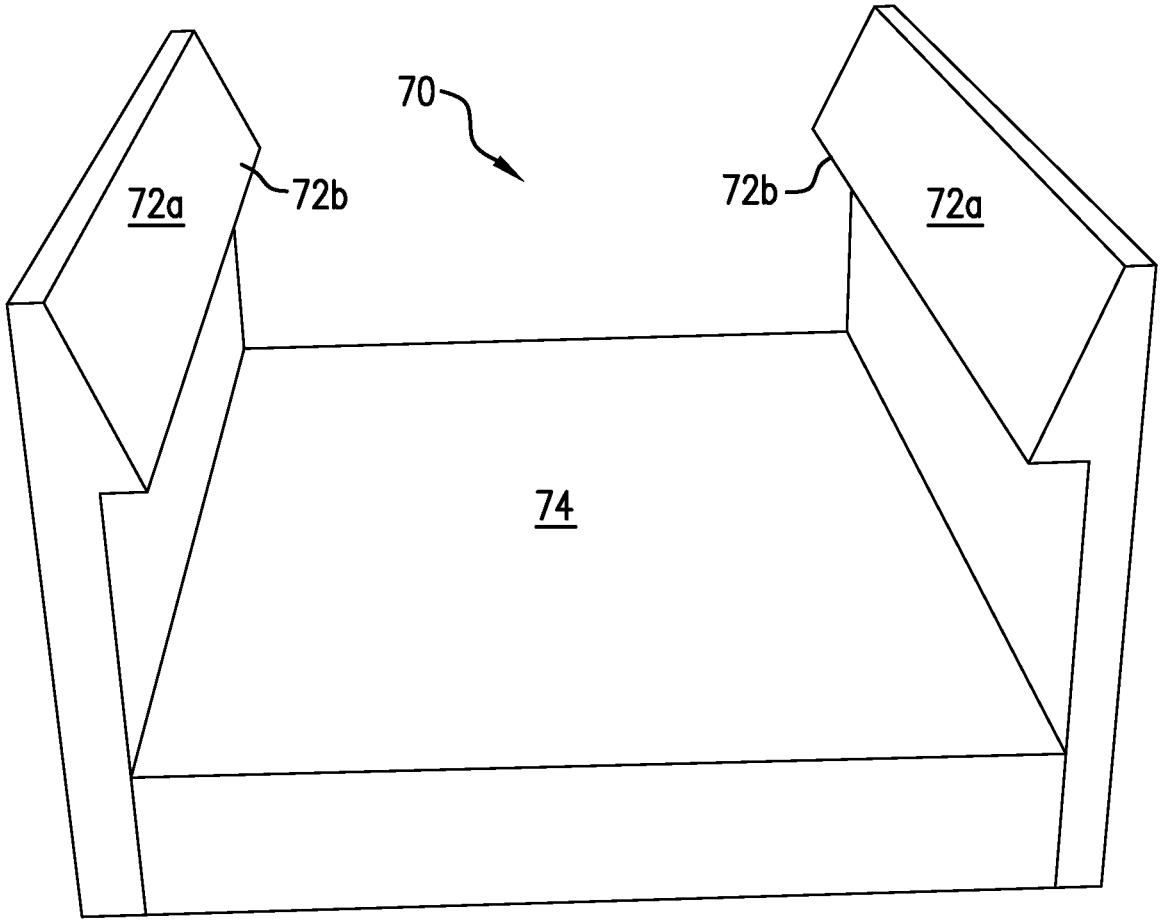

Referring now to FIGS. 25A-25C, which show one embodiment of a securement clip 70 disengaged from the support structure 130, the securement clip 70 may be comprised of two vertical members 72 spaced from one another and extending from a base member 74. A ramp 72*a* may be formed at a distal end of each vertical member 72, wherein a leading edge of the ramp 72*a* terminates at the distal end of the vertical member 72 and a trailing edge of the ramp 72*a* terminates with a catch 72*b* having a surface that is generally perpendicular to the vertical member 72 and generally parallel to the base member 74. Each vertical member 72 may be configured such that it will tolerate a predetermined amount of flexing in a dimension generally parallel to the base member 74 such that the angle between the vertical member 72 and the base member 74 may be manipulated via physical force.

Figure 26A:
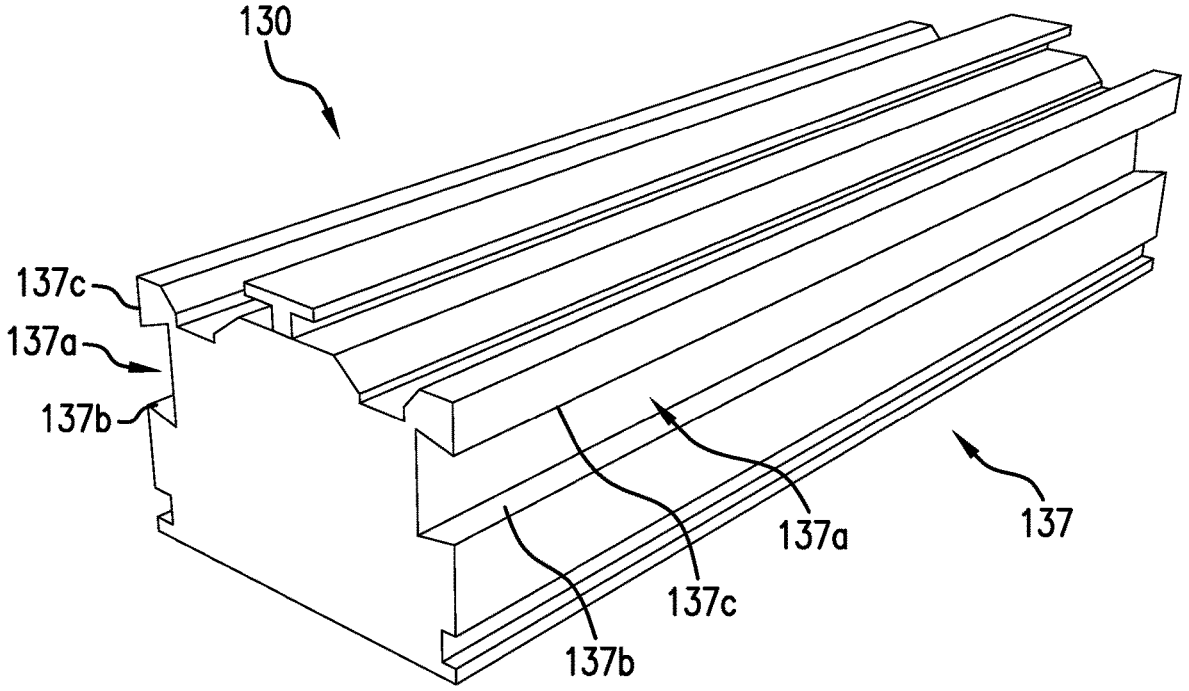
FIGS. 26A & 26B provide various views of the support structure shown in FIG. 24.
Figure 26B:
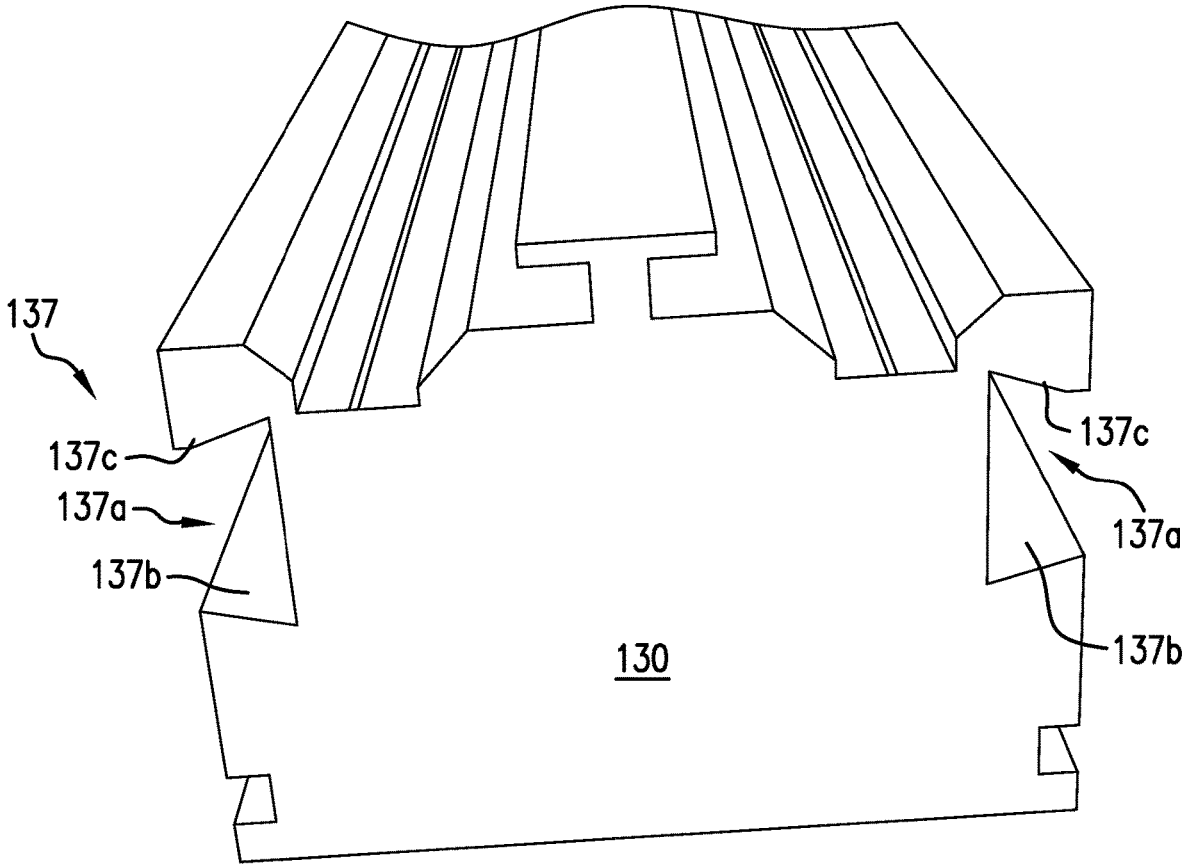

Referring now to FIGS. 26A & 26B, which show one embodiment of a support structure 130 disengaged from the securement clip 70, the support structure 130 may be comprised of a receiver portion 137 generally positioned along either side of the support structure 130. The receiver portion 137 may include a groove 137*a* formed in the side of the support structure 130, which groove 137*a* may extend along the length of the support structure 130. Two surfaces of the groove 137*a* may be defined by an engagement surface 137*b* and a vertical limiter 137*c* on the lower and upper surface, respectively. The engagement surface 137*b* may be configured to correspond with the catch 72*b* formed in the securement clip 70 so as to prevent/mitigate relative vertical movement between the support structure 130 and securement clip 70, thereby preventing/mitigating any wind uplift of one or more tiles 20 engaged with the support structure 130.

The support structure 130 may be engaged with the securement clip 70 via positioning the support structure 130 approximately at the center point between the corresponding vertical members 72 (such that the securement clip 70 and support structure 130 are generally colinear along their major lengths) and applying a predetermined amount of force on the support structure 130 in a direction towards the base member 74 of the securement clip 70. Such force may cause the side members 72 to deflect outward (e.g., away from the support structure 130) as the ramps 72*a* slide along each receiver portion 137 until each ramp 72*a* encounters each groove 137*a*. At this point, each catch 72*b* may engage each engagement surface 137*b* and the vertical member 72 may revert to their original orientation with respect to the base member 74 (e.g., substantially perpendicular) such that the support structure 130 and securement clip 70 snap together.

The catch 72*b* (and/or a portion of the ramp 72*a*) may be configured to corresponding with the engagement surface 137*b* to secure the position of the support structure 130 with respect to the securement clip 70 in at least the vertical dimension. In the illustrative embodiment this may be achieved via configuring the engagement surface 137*b* such that it is angled upward with respect to the horizontal from the proximal to the distal end of the engagement surface 137*b*. In addition or alternatively, the catch 72*b* may be configured such that it is angled downward with respect to the horizontal from the proximal to the distal end of the catch 72*b*. However, other configurations for securing the position of the support structure 130 with respect to the securement clip 70 in at least the vertical dimension may be utilized without limitation unless so indicated in the following claims.

In one embodiment, the vertical members 72 of the securement clip 70 may be integrated into a pedestal upper surface of a prior art pedestal such that the pedestal and securement clip 70 may be formed as one integral unit and may be constructed of the same (or corresponding) materials for ease of manufacture, efficiency in production and/or installation, and/or for other reasons without limitation unless so indicated in the following claims. In this embodiment, all or a portion of the pedestal upper surface may constitute the base member 74.

In an embodiment wherein the vertical members 72 of the securement clip 70 are integraled into a pedestal, two or more pedestals may be properly positioned and a support structure 130 may be then engaged with the pedestals via applying a predetermined force on the support structure 130 as previously described above. In such an embodiment the vertical members 72 and support structure 130 may be configured to comply with any wind uplift standard applicable to the securement clip 70 and support structure 130 shown in FIGS. 24-26B without limitation unless so indicated in the following claims. Additionally, the vertical members 72 may be engaged with other structures adequate to provide sufficient support for the support structure 130 and/or tiles 20 engaged therewith without limitation unless so indicated in the following claims.

Reinforced Tiles

For certain applications (e.g., raised patios or walkways, rooftops, etc.) it may be desirable to elevate a tile (e.g., a ceramic or porcelain tile) for an underlying support structure. Most often tiles are elevated from such a structure using a plurality of pedestals. Generally, for certain applications the pedestals may elevate the tile four inches or more from the underlying support structure. In these applications the tiles are required to exhibit a minimum strength so that they do not break when under load. Various pedestals and installation instructions for such pedestals and different types of raised tiles are shown in Table 1.

TABLE 1 various parameters for pedestals supporting raised tile applications.

| size | up to 2 cm (¾") | from 2 cm (¾") to 10 cm (4") | from 10 cm (4") to 30 cm (12") |
|---|---|---|---|
| 60 × 60 cm/24" × 24" (rated)<br>4 supports per slab | 4 SUPPORTS<br>(3, 4 pcs/m$^2$) | 4 SUPPORTS<br>(3, 4 pcs/m$^2$) | 4 SUPPORTS<br>(3, 4 pcs/m$^2$) +<br>FIBER-MESH PLUS OR<br>GALVANIZED STEEL SHEET |
| 45 × 90 cm/18" × 36" (rated)<br>60 × 120 cm/24" × 48" (rated)<br>6 supports per slab | 6 SUPPORTS<br>(6, 0 pcs/m$^2$ - 45 × 90)<br>(3, 4 pcs/m$^2$ - 60 × 120) | 6 SUPPORTS<br>(6, 0 pcs/m$^2$ - 45 × 90)<br>(3, 4 pcs/m$^2$ - 60 × 120) +<br>FIBER-MESH PLUS OR<br>GALVANIZED STEEL SHEET | 6 SUPPORTS<br>(6, 0 pcs/m$^2$ - 45 × 90)<br>(3, 4 pcs/m$^2$ - 60 × 120) +<br>FIBER-MESH PLUS OR<br>GALVANIZED STEEL SHEET |
| 30 × 120 cm/12" × 48" (rated)<br>6 supports per slab | 6 SUPPORTS<br>(7 pcs/m$^2$) | 6 SUPPORTS<br>(7 pcs/m$^2$) +<br>FIBER-MESH PLUS OR<br>GALVANIZED STEEL SHEET | 6 SUPPORTS<br>(7 pcs/m$^2$) +<br>FIBER-MESH PLUS OR<br>GALVANIZED STEEL SHEET |
| 20 × 120 cm/8" × 48" (rated)<br>6 supports per slab | 6 SUPPORTS<br>(11 pcs/m$^2$) | WITH SPECIAL STRUCTURE<br>SEE E_DECK CATALOGUE | WITH SPECIAL STRUCTURE<br>SEE E_DECK CATALOGUE |
| 90 × 90 cm/36" × 36" (rated)<br>4 supports per slab | 4 SUPPORTS<br>(3 pcs/m$^2$) | WITH SPECIAL STRUCTURE<br>SEE E_DECK CATALOGUE | WITH SPECIAL STRUCTURE<br>SEE E_DECK CATALOGUE |

Applicant has found through testing that adhering a substrate 120*a* to one side of a tile to create a reinforced tile 120 greatly increased the breaking strength of the reinforced tile 120 compared to the prior art tile. Generally, the substrate 120*a* may be adhered to the back or bottom side of the tile to create a reinforced tile 120, but the scope of the present disclosure is not so limited.

Generally, the tile that may be used to create a reinforced tile 120 may be a standard ceramic, porcelain, or otherwise rigid tile. The materials of construction, size, and shape of the tile may vary depending on the specific application of the reinforced tile 120 and is therefor in no way limiting to the scope of the present disclosure unless otherwise indicated in the following claims. In one illustrative embodiment the tile by be 12 inches wide, 12 inches long, and 2 cm thick. In another illustrative embodiment the tile may be 10 inches wide, 10 inches long, and 14 mm thick. Again, the scope of the present disclosure is in no way limited by the dimensions of the tile and/or substrate 120*a* used to create the reinforced tile 120 unless otherwise indicated in the following claims.

Generally, the substrate 120*a* that is adhered to the tile may be a fiberglass reinforced product or similar solid composite in varying thickness applied to the surface of the tile with a chemical adhesive (e.g., epoxy, glue, or another long-lasting adhesive). Through testing it has been found that a reinforced tile 120 exhibits dramatic increases in strength compared to the substrate 120*a* alone or the tile alone.

For a first test, a porcelain tile that was 24 inches wide, 24 inches long, and 20 mm thick was cut to be 12 inches wide and 12 inches long. A ¼-inch thick substrate 120*a* comprised of Extren 500 series was cut to 12 inches by 12 inches and adhered to one side of the porcelain tile. A technical data sheet for this substrate 120*a*, which is a pultruded fiberglass product sold by Strongwell Corp. Ten reinforced tiles 120 were tested according to ASTM C648 "Standard Test Method for Breaking Strength of Ceramic Tile" and exhibited an average breaking strength of 3226 lbf, with the lowest being 2702 lbf and the highest being 3654 lbf. The breaking strength of the tile alone is approximately 2500 lbf.

In a second test, a porcelain tile that was 24 inches wide, 24 inches long, and 20 mm thick was cut to be 12 inches wide and 12 inches long. A ⅛-inch thick substrate 120*a* comprised of Extren 500 series was cut to 12 inches by 12 inches and adhered to one side of the porcelain tile. Ten reinforced tiles 120 were tested according to ASTM C648-04 (2014) "Standard Test Method for Breaking Strength of Ceramic Tile" and exhibited an average breaking strength of 4183 lbf, with the lowest being 1314 lbf and the highest being 6352 lbf. The breaking strength of the tile alone is approximately 2500 lbf.

Through testing, it has been found that the reinforced tile 120 using the ⅛-inch-thick substrate 120*a* may be desirable to that using the ¼-inch-thick substrate 120*a*. Generally, the reinforced tile 120 using the ⅛-inch-thick substrate 120*a* is lighter and less expensive than that using the ¼-inch-thick substrate 120*a*. Additionally, the reinforced tile 120 using the ⅛-inch-thick substrate 120*a* provides a lower profile than that using the ¼-inch-thick substrate 120*a*.

These reinforced tiles 120 were also testing according to ASTM C674-13 "Standard Test Methods for Flexural Properties of Ceramic Whiteware Materials." Additionally, these reinforced tiles 120 were tested according to ISO 10545-5 "Determination of Impact Resistance by Measurement of Coefficient of Restitution."

For a third test a porcelain tile that was 24 inches wide, 24 inches long, and 20 mm thick was cut to be 12 inches wide and 12 inches long. A woven FRP product that is marketed as Lamicor Grade GP-9306 (sold by Liberty Pultrusion), having a thickness of ⅛ was cut to 12 inches by 12 inches and adhered to one side of the porcelain tile. Ten of these reinforced tiles 120 were tested according to ASTM C648-04 (2014) "Standard Test Method for Breaking Strength of Ceramic Tile" and exhibited an average breaking strength of 5707 lbf, with the lowest being 4513 lbf and the highest being 6570 lbf. The breaking strength of the tile alone is approximately 2500 lbf.

These reinforced tiles 120 were also testing according to ASTM C674-13 "Standard Test Methods for Flexural Properties of Ceramic Whiteware Materials."

Figure 27A:
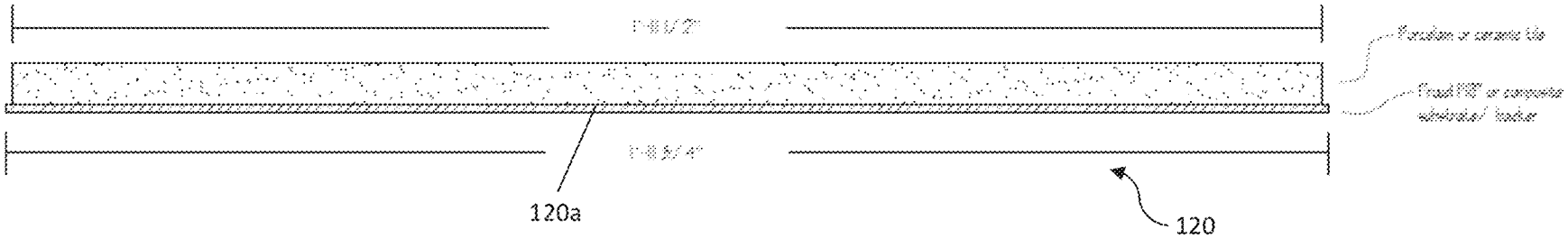
FIG. 27A provides a side view of an illustrative embodiment of a tile.
Figure 27B:
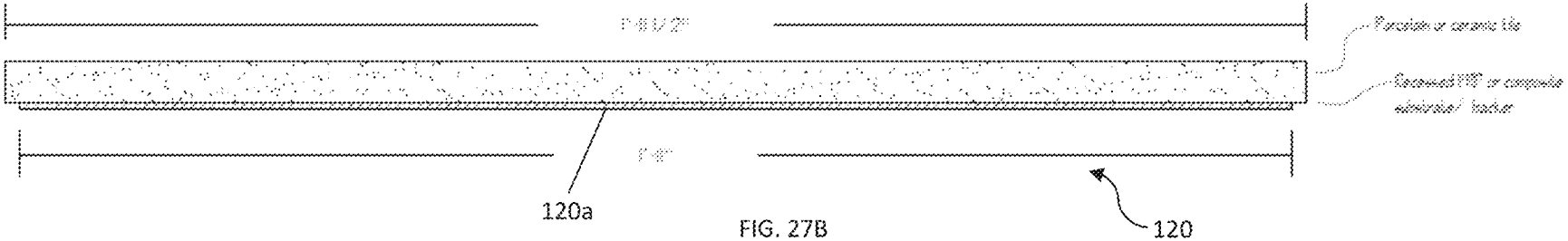
FIG. 27B provides a side view of a second illustrative embodiment of a tile.
Figure 27C:
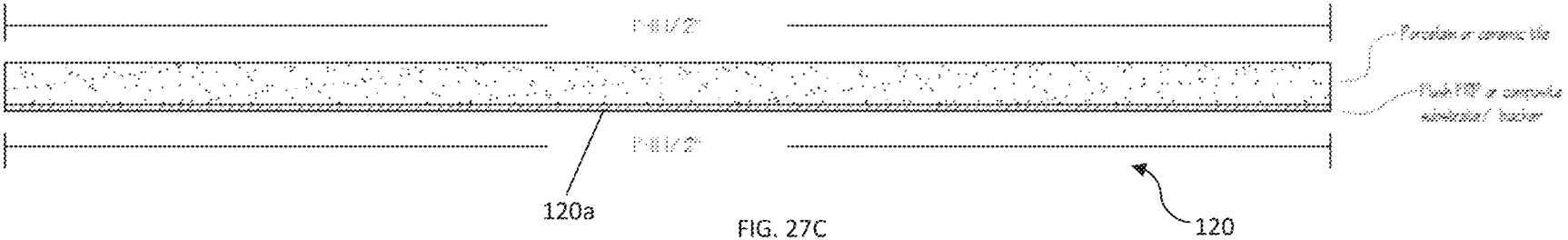
FIG. 27C provides a side view of a third illustrative embodiment of a tile.

The reinforced tiles 120 may be differently configured depending on the specific application. As shown in FIGS. 27A-27C, the edge of the substrate 120*a* may be proud, recessed, or flush with respect to the edge of the tile without limitation unless otherwise indicated in the following claims. Additionally, the thickness of tile and substrate 120*a* can each vary depending at least upon the combined strength necessary for application and are therefore in no way limit the scope of the present disclosure unless otherwise indicated in the following claims.

Although the best results for breaking strength of the reinforced tile 120 were achieved using a woven FRP product, and testing has showed that these reinforced tiles 120 exhibit desirable performance for modulus of rupture (which could also be referred to flexural strength per ASTM C674-13), frost cycle, and thermal shock, other substrates 120*a* and/or composites may be used to create a reinforced tile 120 without limitation unless otherwise indicated in the following claims. The substrate 120*a* used for the reinforced tile 120 may be formed as a plate that is woven (as opposed to a substrate 120*a* having all strands parallel or approximately parallel), which woven configuration may lead to a relative strength improvement in the substrate 120*a* plate and the resulting reinforced tile 120. It is contemplated that if a FRP substrate 120*a* is used, it may lead to increased strength in the resulting reinforced tile 120 if the substrate 120*a* is woven or an irregular mat, such that individual strands and/or components are positioned in various orientations without limitation unless otherwise indicated in the following claims.

Generally, the substrate 120*a* may be adhered to the tile to create a reinforced tile 120 using any suitable structure and/or apparatus without limitation unless so indicated in the following claims. It is contemplated that for some applications it may be desirable to employ an adhesive that remains at least partially flexible rather than becoming brittle upon curing. Such properties may be required to pass certain freeze-thaw tests.

In one embodiment a 2-part epoxy chemical adhesive may be used to bind the substrate 120*a* to the tile. The 2-part epoxy may be comprised of a resin and hardener, which may be proportioned and mixed by hand, mechanically, or an automated process. A desired amount the resulting mixture may then be applied to the substrate 120*a* and/or tile by hand (e.g., spread with a trowel or putty knife), mechanically (e.g., with a pneumatic spray device), of via an automated process. It is contemplated that an automated process may be used to automatically dispense a desired amount of mixed adhesive and automatically apportion that adhesive over the surface area of the substrate 120*a* or tile without limitation unless otherwise indicated in the following claims.

After adhesive is placed on the substrate 120*a* or tile, the substrate 120*a* may be joined with the tile. Mechanical force (e.g., presses, rollers, etc.) may be used to ensure evenness of the adhesive, proper bonding, and a relatively even thickness of the resulting reinforced tile 120. The adhesive may be allowed to dry prior to transport and/or use. It is contemplated that such a process at any and/or all points of construction may be temperature and/or pressure controlled for quality control without limitation unless otherwise indicated in the following claims. The reinforced tiles 120 may be subjected to a machining or finishing process (which may be done via a CNC machine) to ensure proper dimensions and/or shape and enhance quality control.

Reinforced tiles exhibit numerous advantages over the prior art, which advantages include but are not limited to increased breaking strength, which in turn may lead to numerous other advantages including but not limited to: (1) elimination/mitigation of shatter liability; (2) elimination/mitigation of liability of glass-like edges when tiles shatter; (3) prior art broken tiles can shatter and create shards that cause cuts and injuries, whereas reinforced tiles 120, even if broken, are still contained and bonded to a substrate 120*a* plate, which may prevent sharp edges and separation of fragments; (4) provision of a longer warranty and more durable product; (5) allowing raised use on pedestals without voiding tile manufacturers warranties; (6) allowing safe use on pedestals for the growing roof-deck market; (7) may be applied to various tile manufacturer's products for use with various tile products in a variety of thicknesses and sizes; (8) allowing for heavier objects and loads to be placed on tiles without shatter (e.g., furniture, planters, hot-tubs, outdoor kitchens, people, etc.); (9) when prior art tiles shatter, sharp edges therefrom penetrate waterproof membrane beneath, causes expensive and extensive roof repairs; and, (10) may be used instead of unsightly concrete pavers that have 2-3 year warranties, weigh 3-5 times as much, are subject to stain and mold, and require maintenance.

Tile and Support Structure for Vertical Mounting

Figure 28A:
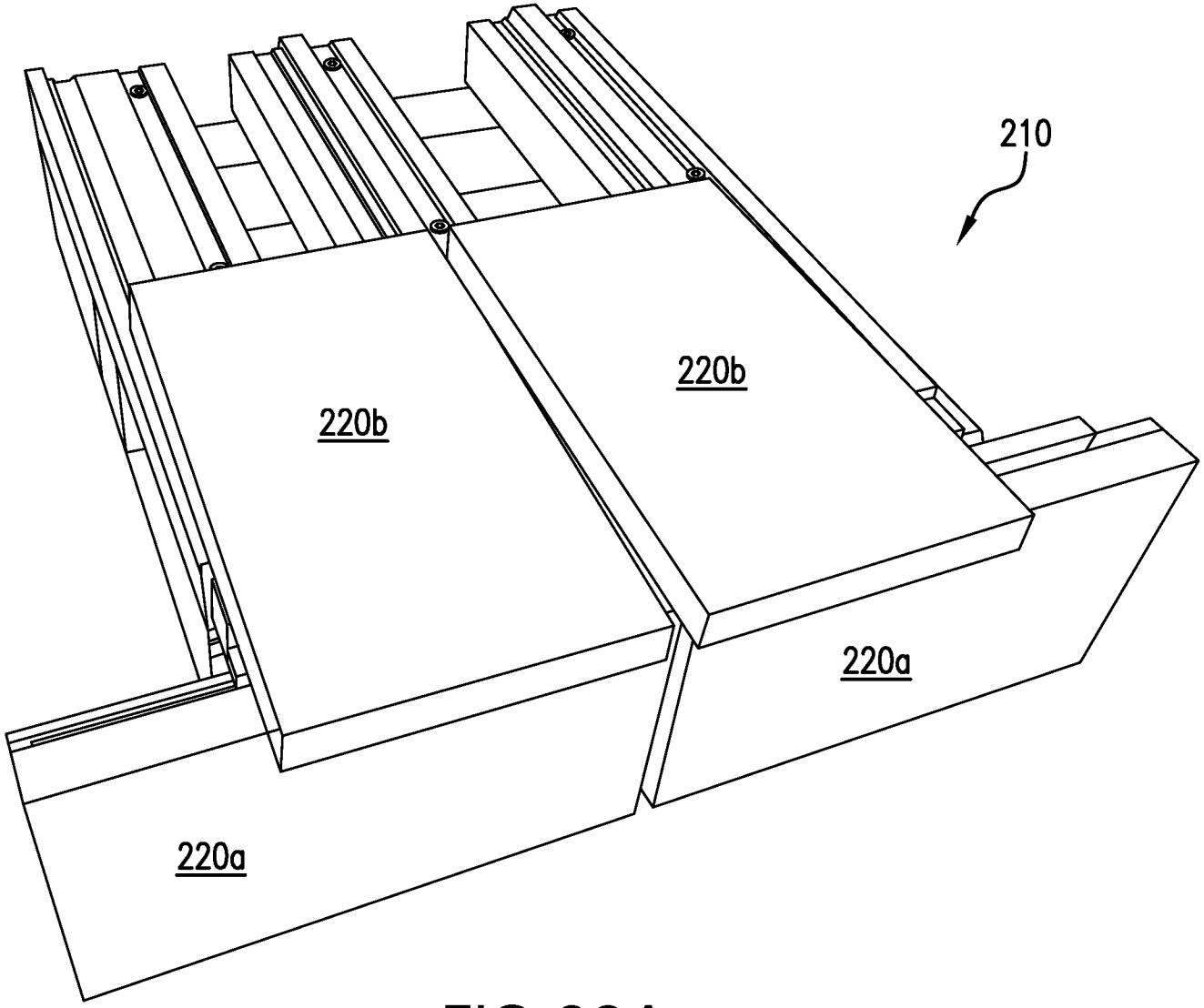
FIG. 28A is a perspective view of a tile and support structure that may be used in a vertical configuration.

Referring now to FIGS. 28A-33, therein is shown various views of a tile and support structure 210 that may be used to mount a tile 220*a* in a vertical configuration, such as the riser of a step, as a border around a portion of a deck, façade, ventilated façade, interior or exterior wall covering, or other surface without limitation unless otherwise indicated in the following claims. A perspective view of an illustrative embodiment of a tile and support structure 210 is shown in FIG. 28A and an end view thereof is shown in FIG. 28B, wherein two riser tiles 220*a* may be positioned below two horizontal end tiles 220*b*. Such a configuration may be used for a step, for a plurality of steps, for a border, or for any application in which it may be desirable to mount one or more tiles 220*a* in a vertical configuration (i.e., wherein the face 222 of the tile 220*a* is substantially parallel to the vertical dimension) without limitation unless otherwise indicated in the following claims.

Figure 28B:
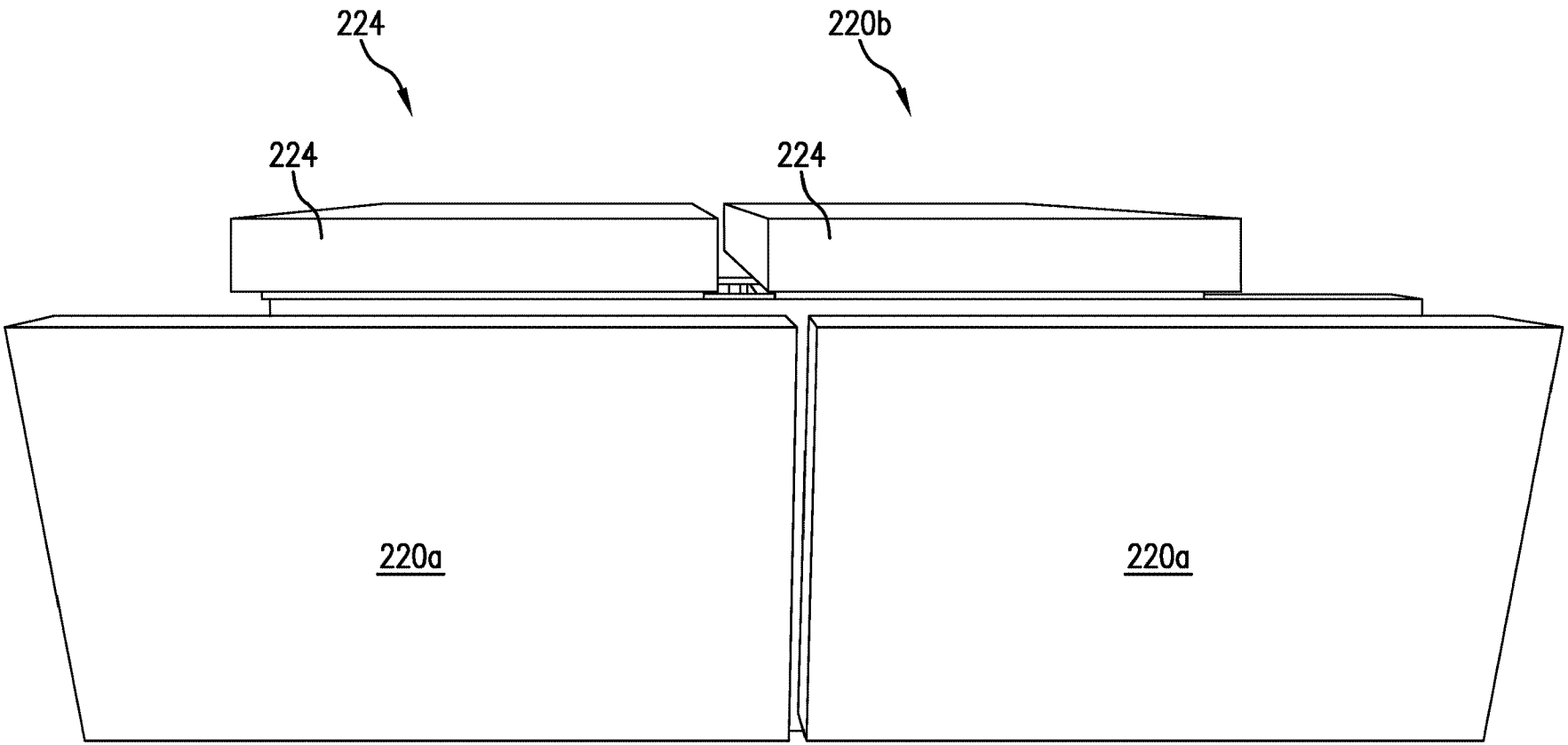
FIG. 28B is a front view of the tile and support structure shown in FIG. 28A.
Figure 29:
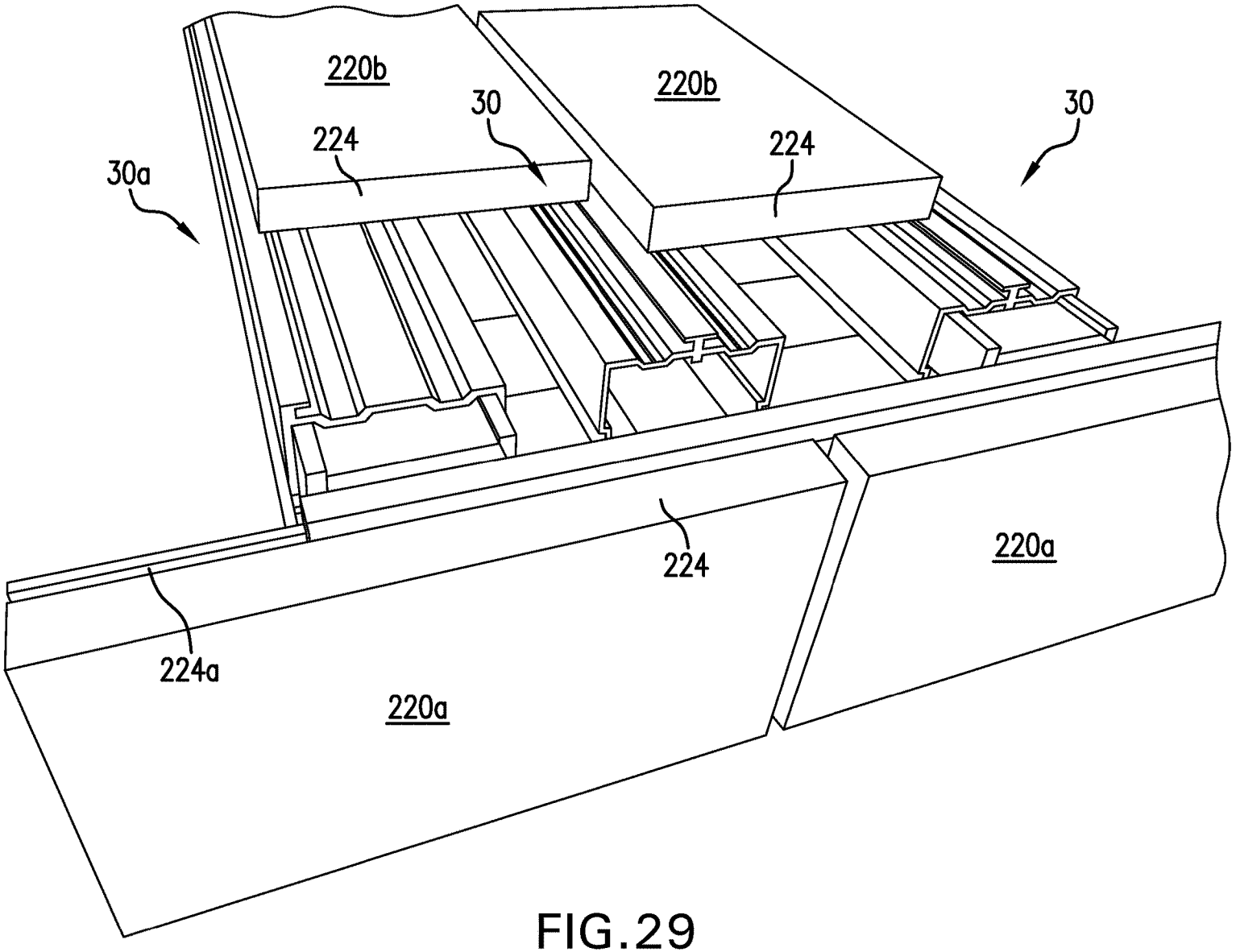
FIG. 29 is a perspective view of the tile and support structure from FIGS. 28A & 28B wherein the horizontal tiles have been slid away from the riser tiles.

Referring now to FIG. 29, which provides a perspective view of the tile and support structure 210 from FIGS. 28A & 28B with the horizontal end tiles 220*b* slide away from the riser tiles 220*a*, the support structure 30 engaged with the horizontal end tiles 220*b* may be configured substantially as those previously described herein and shown in FIGS. 3-15B. However, any suitable support structure 30 may be engaged with the horizontal end tiles 220*b* without limitation unless otherwise indicated in the following claims.

Figure 30A:
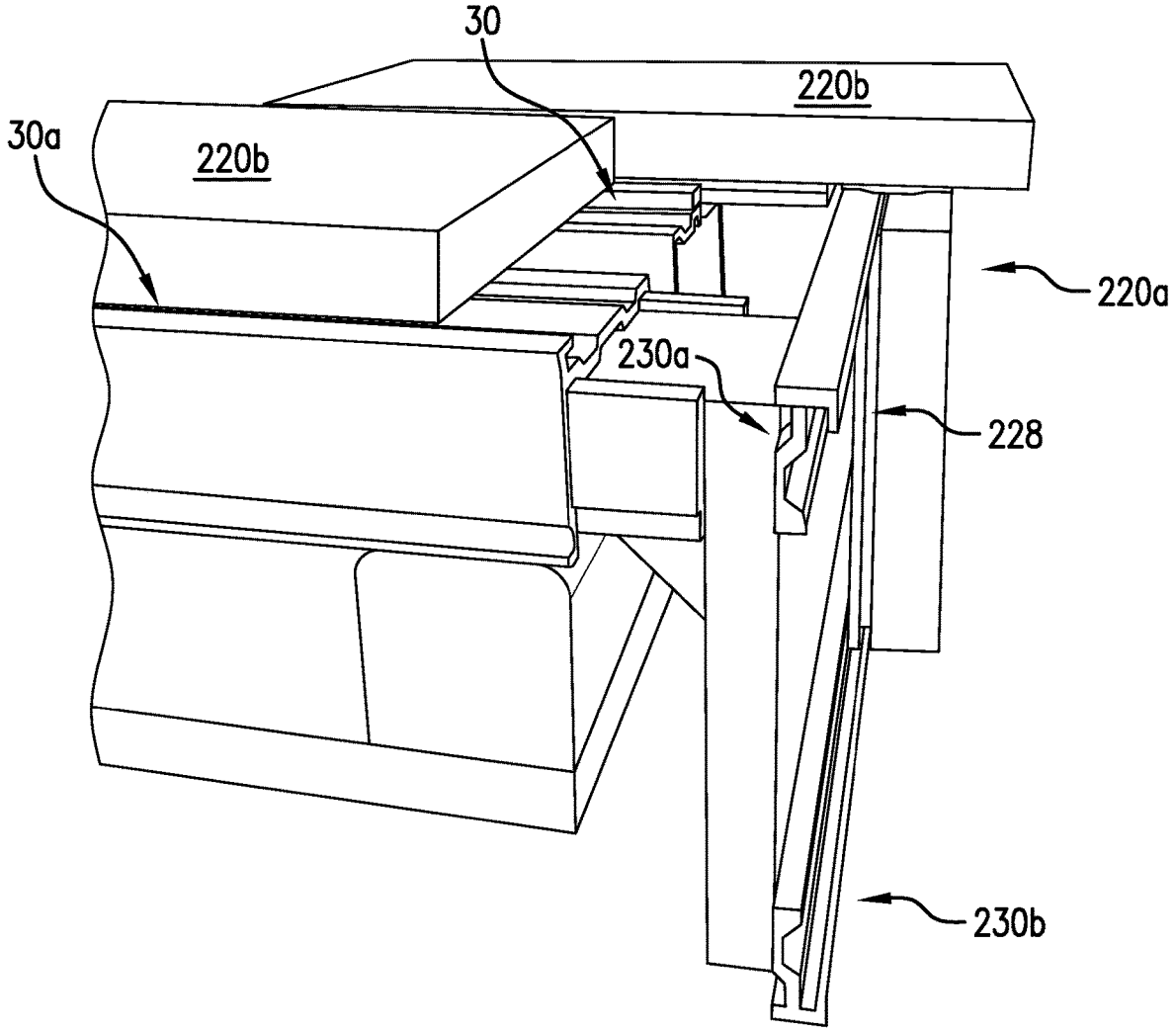
FIG. 30A is a side perspective view of the tile and support structure with one of the riser tiles removed.
Figure 30B:
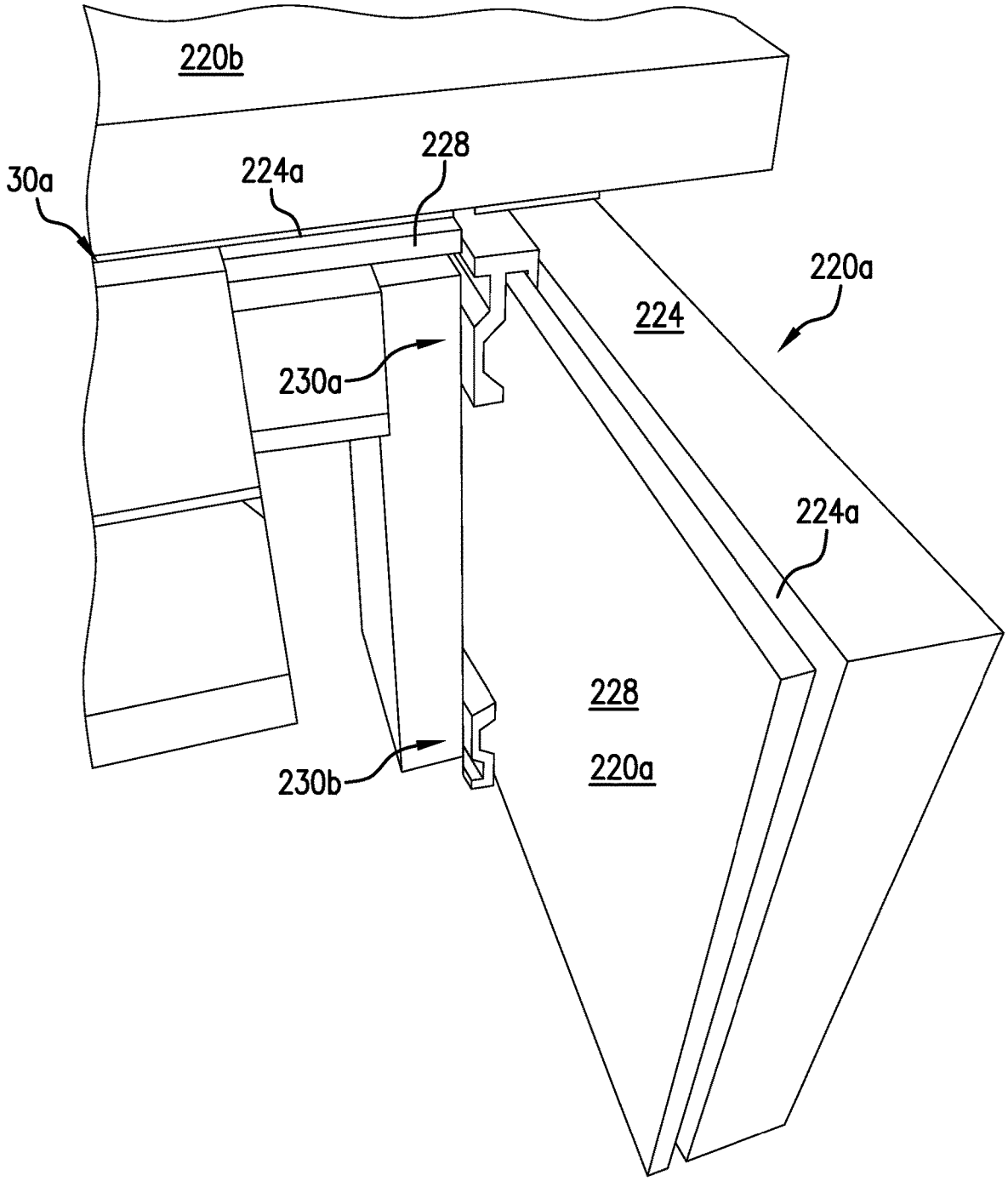
FIG. 30B is a side perspective view of the tile and support structure with one of the riser tiles slid outward beyond the support structure.
Figure 30C:
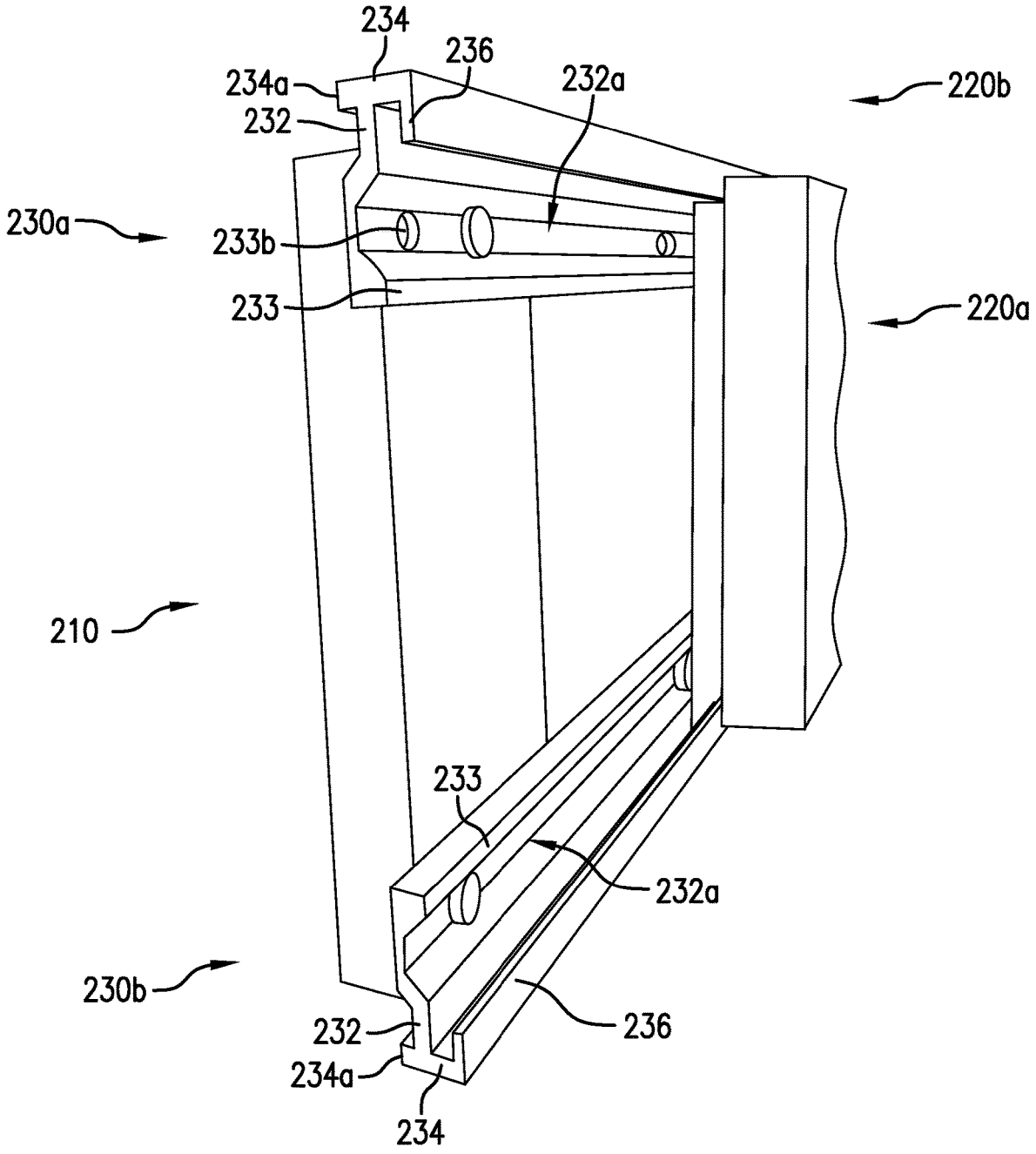
FIG. 30C is a detailed side perspective view of the tile and support structure with one of the riser tiles removed from the support structure.

Referring now to FIGS. 30A-30C, which provide various side prospective views of the tile and support structure 210, one or more riser tiles 220*a* may be engaged with an upper riser support structure 230*a* and a lower riser support structure 230*b*. In an illustrative embodiment of an upper and lower riser support structure 230*a*, 230*b*, they may be mirror images of one another. Further, the upper and lower riser support structure 230*a*, 230*b* may be configured substantially similar to an edge support structure 30*a* as previously described above and as shown in FIG. 9.

Each riser support structure 230*a*, 230*b* may be formed with a base 231 having a flange 232 extending outward therefrom. The flange 232 may be formed with a trough 232*a* therein, and the trough 232*a* may be formed with a plurality of apertures 232*b* therein. The distal edge of the trough 232*a* may be bound by a lip 233, wherein the top surface of the lip 233 may be coplanar with the top surface of the flange 232. Such a configuration may spread the force associated with a tile 220*a* engaged with a given riser support structure 230*a*, 230*b* over a larger area, as explained in detail regarding other embodiments of a support structure having a similar feature.

Figure 33:
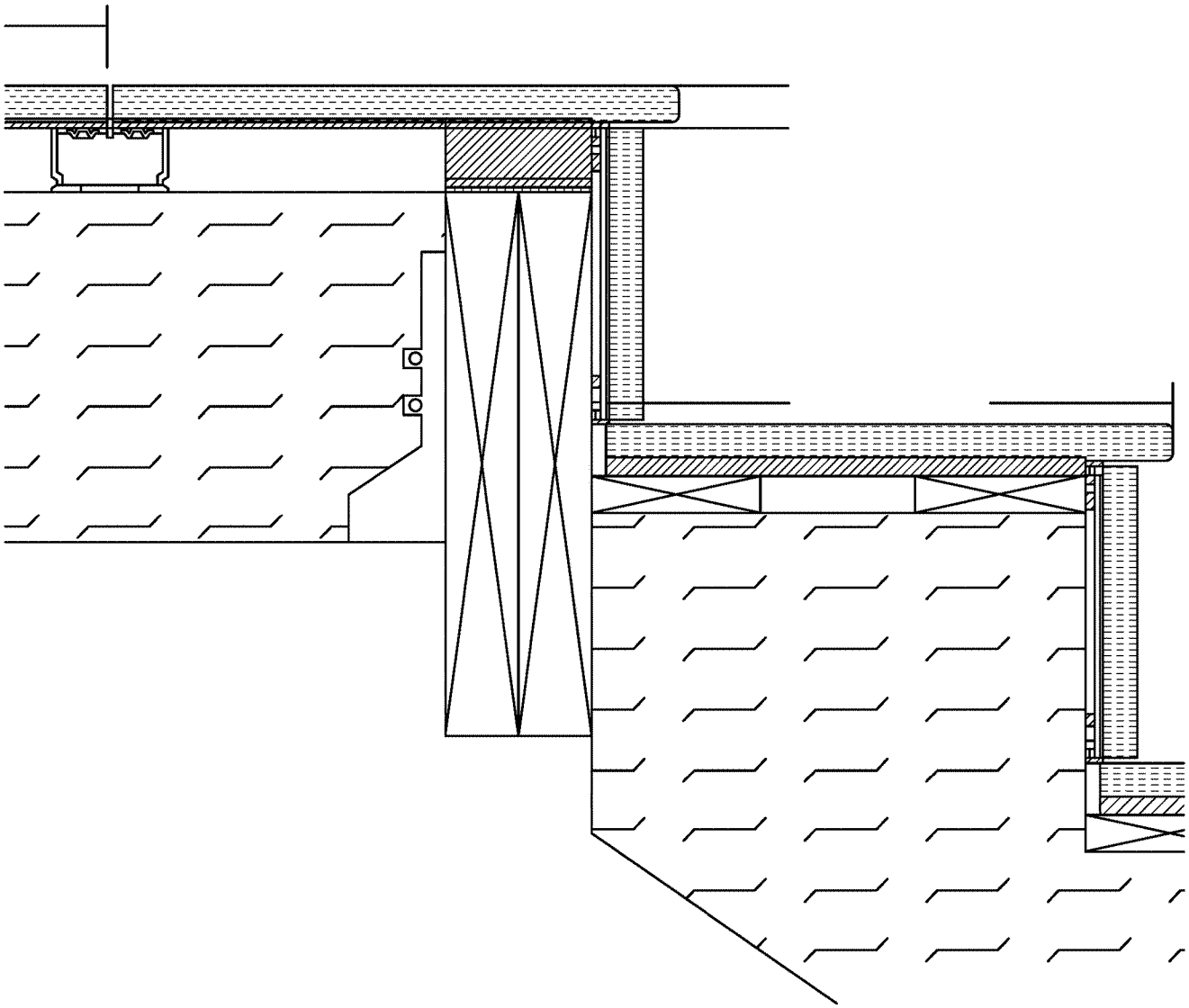
FIG. 33 is an engineering drawing of a plurality of stairs utilizing a tile and support structure that may be used in a vertical configuration.

In an illustrative aspect, the apertures 232*b* formed in the trough 232*a* of each riser support structure 230*a*, 230*b* may be spaced from one another by a distance of four inches, such that a riser support structure 230*a*, 230*b* may be engaged with joists 14 or stair stringers (wherein stringers are shown in FIG. 33) spaced twelve or sixteen inches from adjacent joists 14 without need to modify the riser support structure 230*a*, 230*b*. However, the spacing of the apertures 232*b* in no way limits the scope of the present disclosure unless so indicated in the following claims. Additionally, the apertures 232*b* may be tapered such that the head of a fastener 14 configured as a screw may seat within the aperture 232*b*, and such that in certain aspects the head of a fastener 14 may be flush with the bottom of the trough 232*a*. However, other aspects of the apertures 232*b* may be differently configured without limitation unless so indicated in the following claims.

A spine 234 may extend upward from the base 231 in a generally vertical dimension. At the top distal end of the spine 234, a rail 236 may extend outward from the spine 234 in a generally vertical dimension, wherein the rail 236 may be generally parallel with respect to the flange 232 and generally perpendicular with respect to the spine 234. A tip 234*a* that may be collinear with the spine 234 may extend outward from the spine 234 such that the distal end of the tip 234*a* is coplanar with the bottom surface of the base 231. Such a configuration may allow the tip 234*a* to abut a joist 14, stair stringer, border member, and/or structural component during use.

The various relative dimensions of the components of the tile and support structure 210 (and, consequently the upper and lower riser support structures 230*a*, 230*b*) may be infinitely varied depending on the specific application of the tile and support structure 210. Several illustrative aspects of different support structures 30 according to the present disclosure and dimensions of the components of the support structure 30 are shown in FIGS. 11A-11E, and those relative dimensions may be used for certain applications of the tile and support structure 210. However, these aspects and dimensions are not meant to be limiting in any sense, but rather are provided to show how the various dimensions of the tile and support structure 210 may be manipulated without departing from the spirit and scope of the present disclosure unless so indicated in the following claims.

Figure 31A:
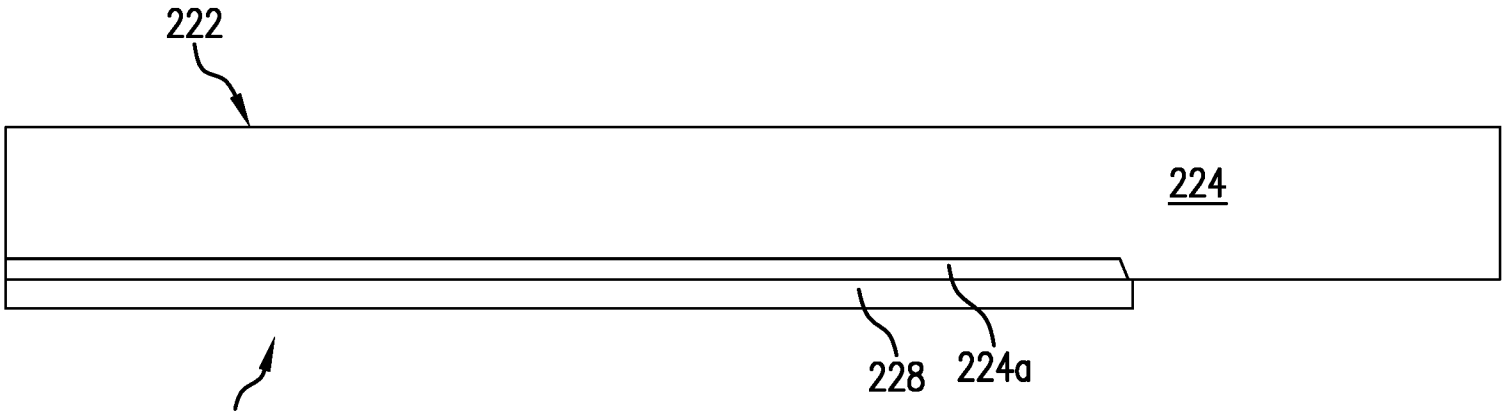
FIG. 31A is a side view of a horizontal end tile that may be used with a tile and support structure.
Figure 31B:
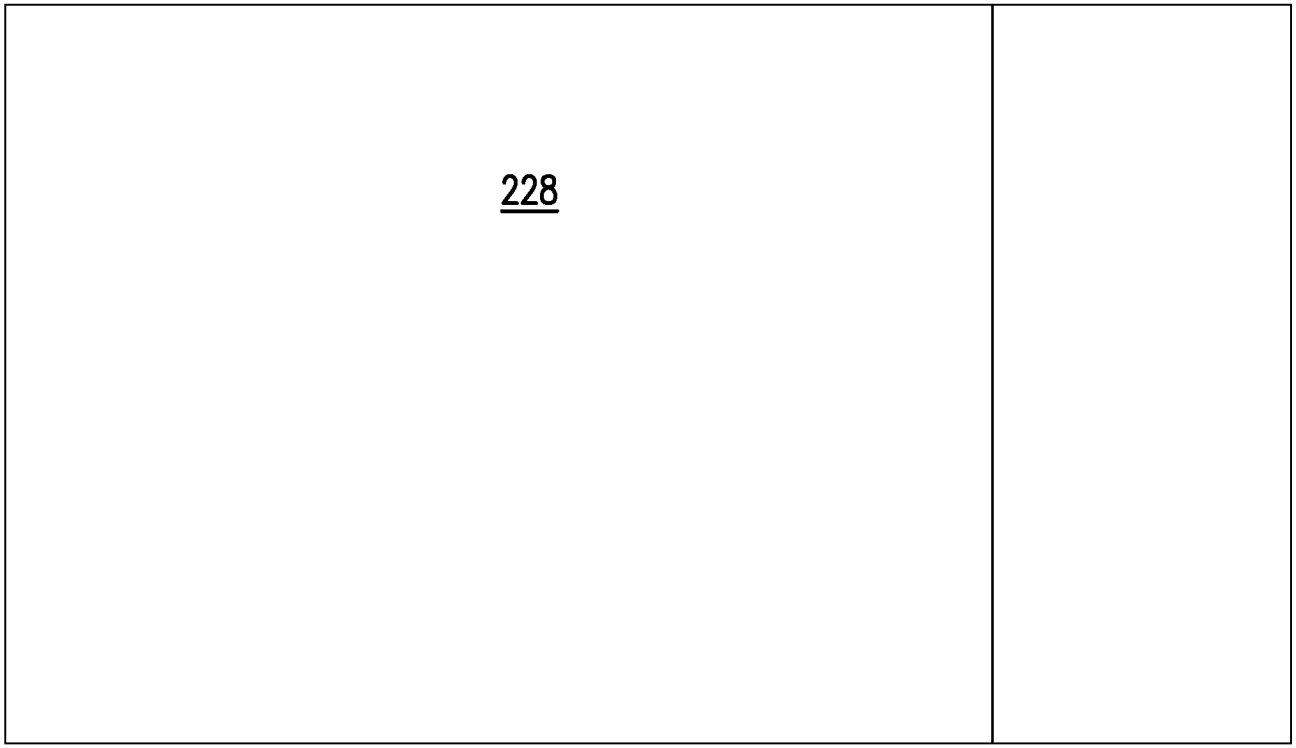
FIG. 31B is a bottom view of the horizontal end tile shown in FIG. 31A.
Figure 32A:
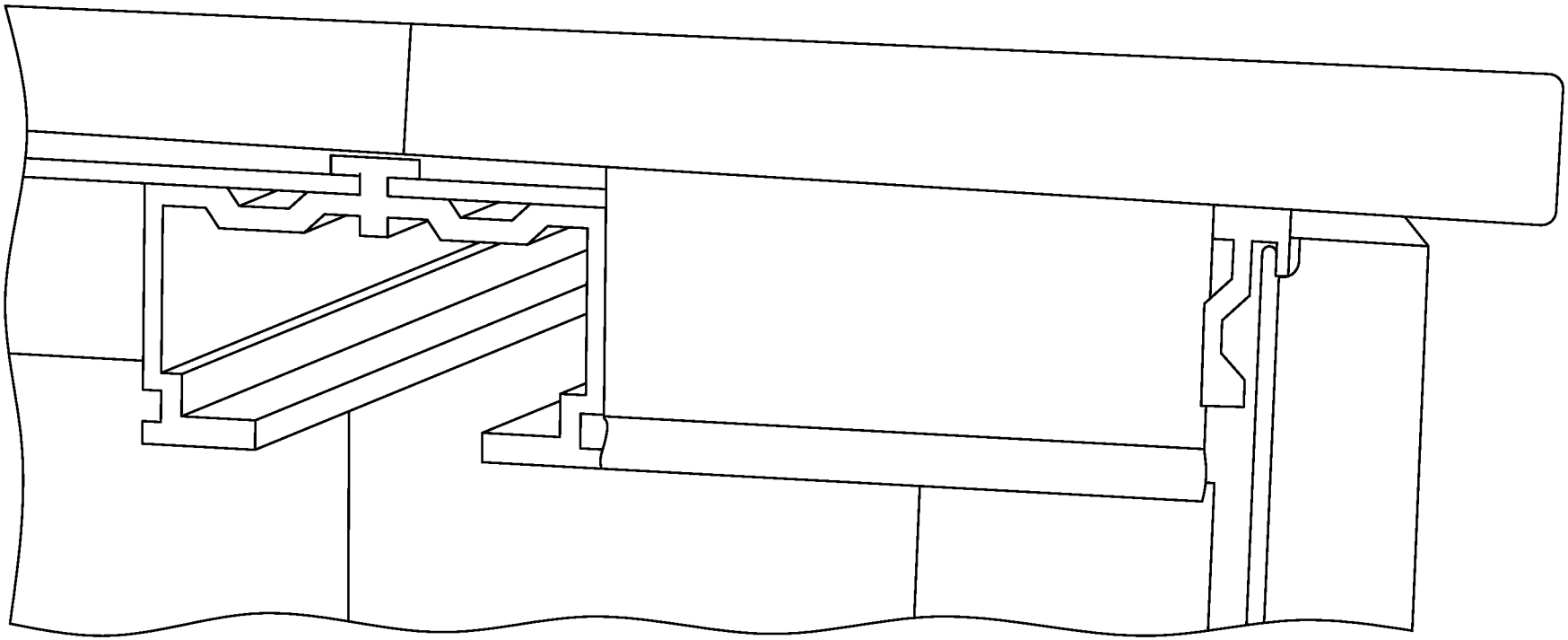
FIGS. 32A through 32D provide various detailed views of a tile and support structure that may be used in a vertical configuration.
Figure 32B:
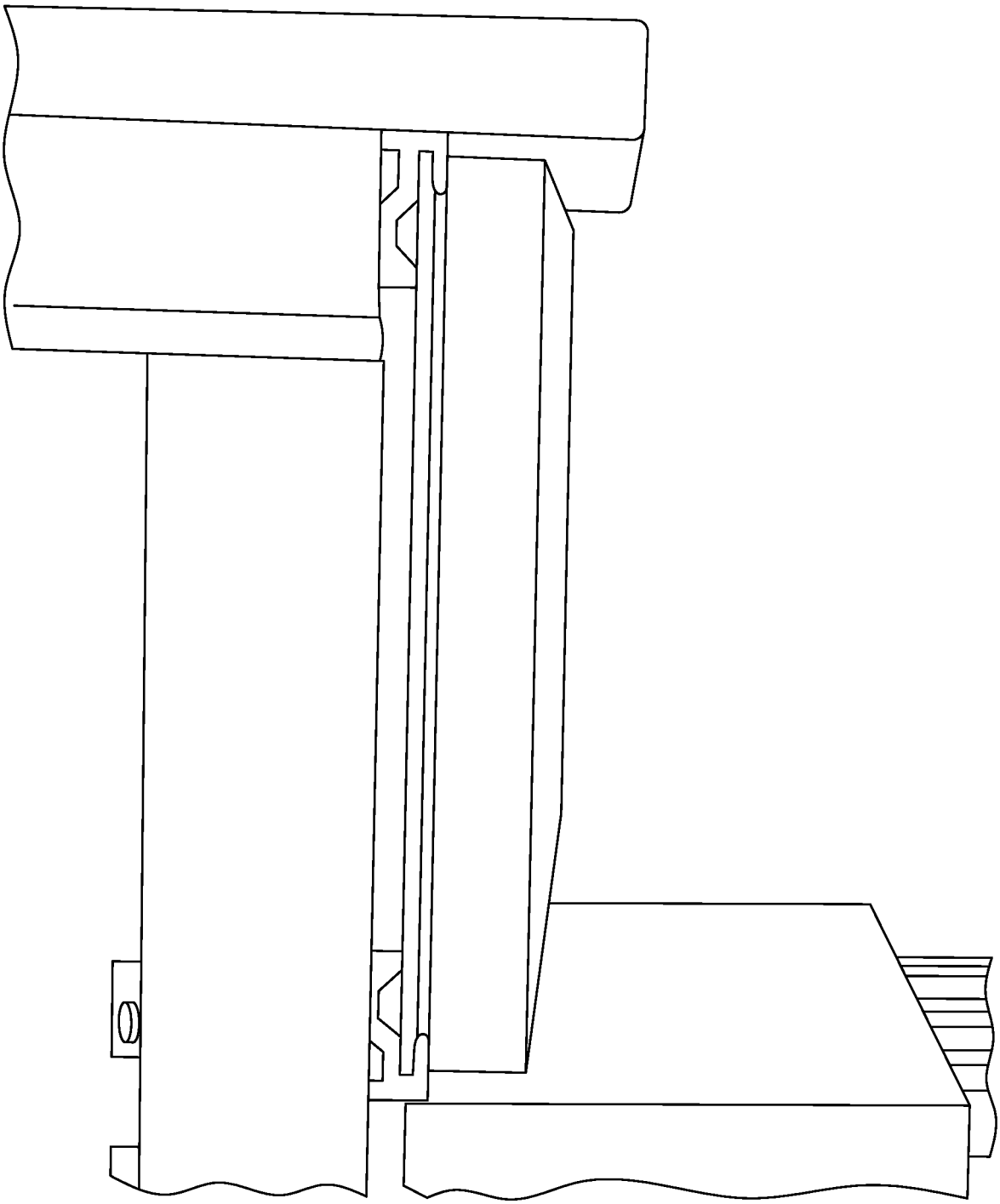
Figure 32C:
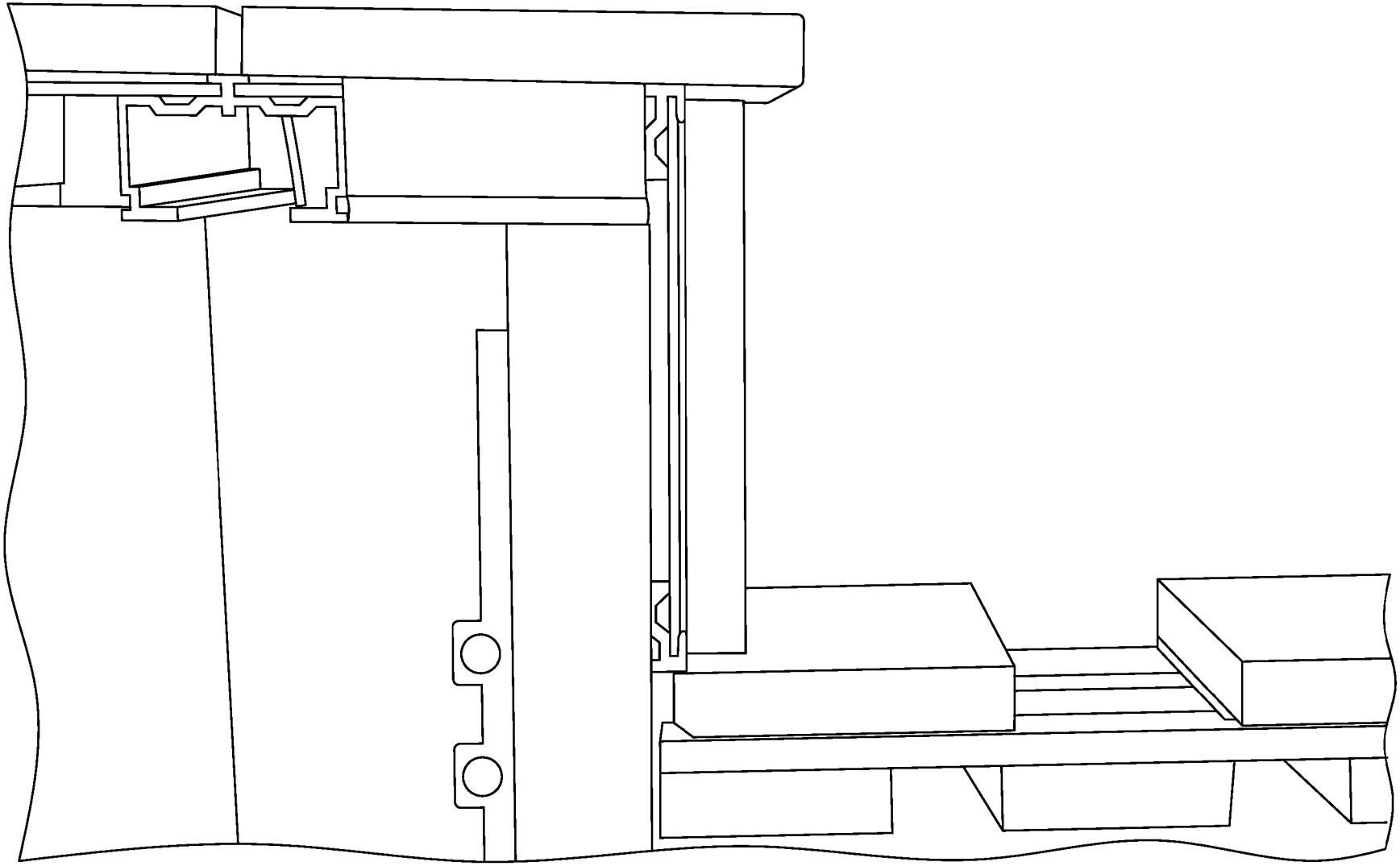
Figure 32D:
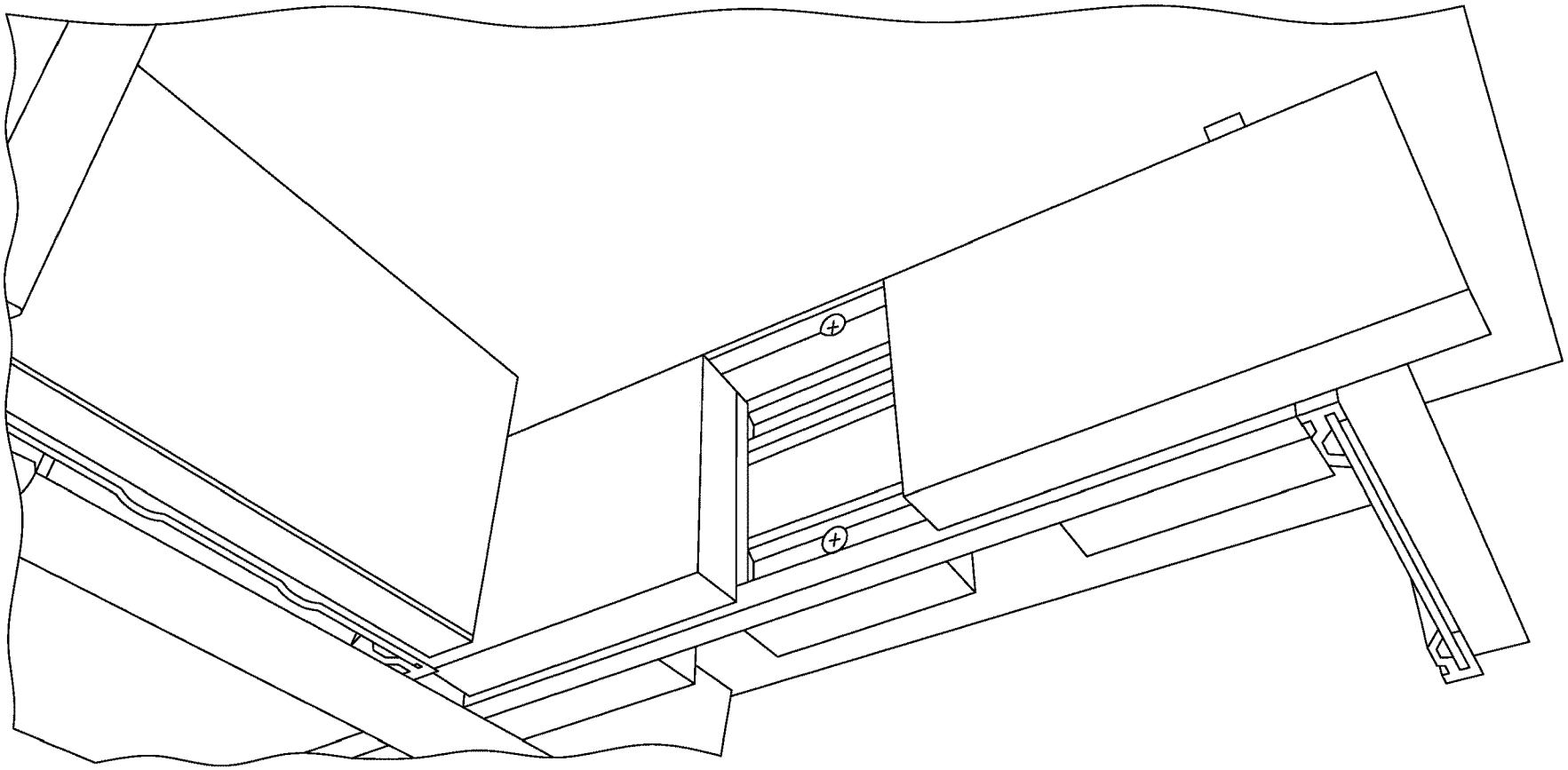

Various illustrative aspects of both a riser tile 220*a* and horizontal end tile 220*b* that may be used with the illustrative embodiment of a tile support structure 210 are shown in FIGS. 28B-31B, wherein FIGS. 31A and 31B provided a detailed side and bottom view, respectively, of an illustrative embodiment of a horizontal end tile 220*b*. The tiles 220*a*, 220*b* may be generally rectangular in shape, such that two rectangular-shaped faces 222 are spaced from one another by the height of an edge 224 of the tile 220*a*, 220*b*. In one aspect, the height of an edge 224 may be 20 millimeters, and in another aspect the height thereof may be 30 millimeters. However, as previously mentioned, the scope of the present disclosure is not limited by the specific shape, dimensions, and/or configuration of the tile 220*a*, 220*b* unless so indicated in the following claims. The bottom face 222 may be engaged with a substrate 228, which may be configured as a synthetic (e.g., fiberglass, plastic, etc.) sheet having a periphery equal to or approximately equal to that of the tile 220*a*, 220*b*. In one aspect, the thickness of a substrate may be ¼ of an inch, but the specific dimensions of the substrate 228, if used for that embodiment of a tile 220*a*, 220*b*, is in no way limiting to the scope of the present disclosure unless so indicated in the following claims. If a substrate 18 is used, it may be engaged with the tile 220*a*, 220*b* using any suitable structure and/or method suitable for the particular application of the tile 220*a*, 220*b*, including but not limited to chemical adhesives, mechanical fasteners, and/or combinations thereof. The scope of the present disclosure is in no way limited by whether a substrate 18 is engaged with a tile 220*a*, 220*b* unless so indicated in the following claims.

Opposite edges 224 of a tile 220*a*, 220*b* may be formed with a groove 224*a* therein, as clearly shown at least in FIGS. 28A, 29, and 30A-31A. The groove 224*a* may be formed in the edge 224 of the tile 220*a*, 220*b*, in a portion of the edge 224 of the tile 220*a*, 220*b*, in a portion of a surface of a substrate 228 (if present), and/or a combination of a portion of the tile 220*a*, 220*b* and a portion of the substrate 228. The groove 224*a* may be configured such that it cooperates with the rail 236 at the distal end of the spine 234, and such that the bottom face 222 of the tile 220*a*, 220*b* (or bottom surface of the substrate 228, if present for that embodiment of a tile 220*a*, 220*b*) rests upon the corresponding surface of the flange 232 and lip 233, as clearly shown at least in FIGS. 30B and 30C. Accordingly, one riser tile 220*a* may be engaged on opposing edges 224 of the tile 220*a* with an adjacent upper and lower riser support structure 230*a*, 230*b*. In this manner, the riser tile 220*a* may slide with respect to the riser support structures 230*a*, 230*b* along the lengths of the riser support structures 230*a*, 230*b*. Such a configuration allows adjacent riser tiles 220*a* between corresponding riser support structures 230*a*, 230*b* to be slid into place from an open end of the riser support structures 230*a*, 230*b* until the final riser tile 220*a* is positioned. Simultaneously, this configuration may secure the relative position of the riser tile 220*a* with respect to the riser support structures 230*a*, 230*b* in all other dimensions (e.g., a vertical dimension and a horizontal dimension perpendicular with respect to the length of the riser support structures 230*a*, 230*b*).

It is contemplated that the dimensions of the groove 224*a* may be selected such that a common blade and/or tool may be used to form the required groove 224*a* in a given edge 224. It is also contemplated that in certain aspects of a tile and support structure 210, a predetermined amount of space may exist between the surfaces of a groove 224*a* and the surfaces of a rail 236, between the edge 224 and the spine 234, and/or between the bottom face 222 and flange 232 such that water and/or other liquids and/or other precipitation may flow via gravity between the groove 224*a* and the rail 236, between the edge 224 and spine 234, and/or between the bottom face 222 and flange 232.

Referring now specifically to FIGS. 31A & 31B, the horizontal end tile 220*b* may be configured such that a first portion thereof has a thinner edge 224 than a second portion thereof. This reduction in the thickness of the edge 224 may be accomplished via not positioning substrate 228 on the first portion, but the scope of the present disclosure is not so limited unless otherwise indicated in the following claims. As shown in FIGS. 30A and 30B, the tile and support structure 210 may be configured such that this first portion extends outward over a portion of the riser tile 220*a*. The edge of the second portion (that portion of the horizontal end tile 220*b* having an edge 224 thickness greater than the first portion thereof) may engage a portion of the upper riser support structure 230*a* (and specifically the tip 234*a* thereof). In the illustrative embodiment, the edge of the second portion may be at least partially comprised of substrate 228, but the scope of the present disclosure is not so limited unless otherwise indicated in the following claims. In this manner, by manipulating the length of the first portion of the horizontal end tile 220*b*, the amount by which the horizontal end tile 220*b* extends over the riser tiles 220*a* may be manipulated for functional and/or aesthetic purposes.

Bottom Indexing Tile and Support Structure

Referring now generally to FIGS. 34-42B, various embodiments of a bottom indexing tile and support structure 310 and/or components thereof are shown. Generally, a bottom indexing tile and support structure 310 may provide at least the benefits of the various tile and support structures 10, 210, roof support structures 30', and/or pedestals 50 disclosed herein above without limitation unless otherwise indicated in the following claims. Throughout this section reference may be made to tile and support structure 10, tile 20, reinforced tile 120, support structure 30, and pedestal 50. However, such terms are not meant to be limiting to the bottom indexing tile and support structure 310 but are instead meant to include any suitable tile and support structure 10, tile 20 and/or reinforced tile 120, support structure 30, and/or pedestal 50 disclosed herein without limitation unless otherwise indicated in the following claims.

In some applications, particularly those involving rooftops, it may be difficult to ensure the spacing between tiles 20, 120 remains consistent and constant over a given period of time. Ensuring proper spacing between or among tiles 20, 120 is retained may be especially difficult in situations wherein the installation of the tile and support structure 10 is done on sloped surfaces due to tipping, moving, flexing, etc. of the support structure 30, pedestal 50, and/or other structural member positioned beneath the tile 20, 120. Generally, the bottom indexing tile and support structure 310 may be configured to ensure proper spacing between or among tiles 20, 120 over a long period of time in a wide variety of conditions. For purposes of brevity, with reference to a bottom indexing tile and support structure 310, the term "tile 20" as used herein may include a tile 20 as previously described, a reinforced tile 120 as previously described, and/or a bottom indexing tile 320 without limitation unless otherwise indicated in the following claims.

Referring generally to FIGS. 34-36B, one illustrative embodiment of a bottom indexing tile and support structure 310 may employ one or more plugs 312 to secure the position of one or more bottom indexing tiles 320. A plug 312 may be securely engaged with a bottom indexing pedestal 350 as shown most clearly in perspective view in FIG. 34. In such a configuration it is contemplated that a bottom indexing pedestal 350 may be positioned adjacent one or more corners of a bottom indexing tile 320, wherein the bottom indexing pedestal 350 (in conjunction with one or more bottom indexing pedestals 350 positioned adjacent other corners of a given bottom indexing tile 320) may function to simultaneously elevate the bottom indexing tile 320 from a surface (such as a concrete base, joists, etc.) and secure the relative position of the bottom indexing tile 320 with respect to the bottom indexing pedestal 350 in three dimensions (i.e., both horizontal axes and the vertical axis).

Figure 36A:
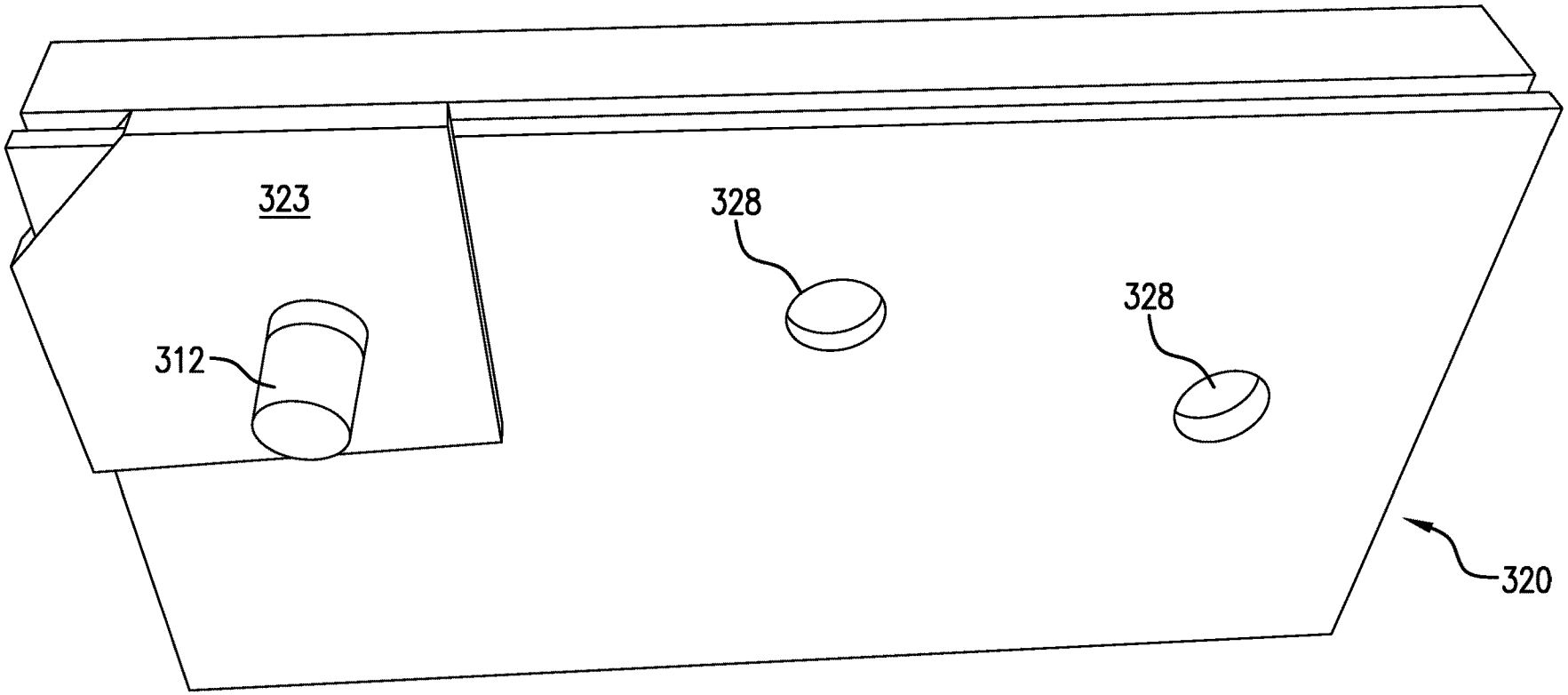
FIG. 36A is a perspective view of the bottom surface of a tile configured for use with the pedestal or support structure shown in FIGS. 34 and FIGS. 35A & 35B, respectively.

Referring now specifically to FIG. 36A, a first illustrative embodiment of a bottom indexing tile 320 may be formed with one or more cavities 328 on the surface opposite the face 322 thereof. Each cavity 328 may be sized and shaped to cooperate with a plug 312 such that when the plug 312 is inserted into the cavity 328, a predetermined amount of force is required to remove the plug 312 from the cavity 328 (which force may generally be applied in a direction parallel to the longitudinal axis of the plug 312). Alternatively, and in reference to FIGS. 36A & 36B, a bracket 323 having a plug 312 secured thereto may be fitted to one or more corners of a bottom indexing tile 320. The bracket 323 may be configured to engage two grooves 324*a* on adjacent perpendicular edges 324 of the bottom indexing tile 320 such that the bracket 323 may be slid onto the bottom indexing tile 320 for engagement therewith. The pedestal upper surface 354 of a bottom indexing pedestal 350 may be configured with a cavity therein (not shown) that corresponds to and cooperates with the plug 312 secured to the bracket 323 such that when the plug 312 is inserted into the cavity (not shown) formed in the pedestal upper surface 354 a predetermined amount of force is required to remove the plug 312 from that cavity (not shown), wherein it is contemplated that the force may generally be applied in a direction parallel to the longitudinal axis of the plug 312.

Figure 34:
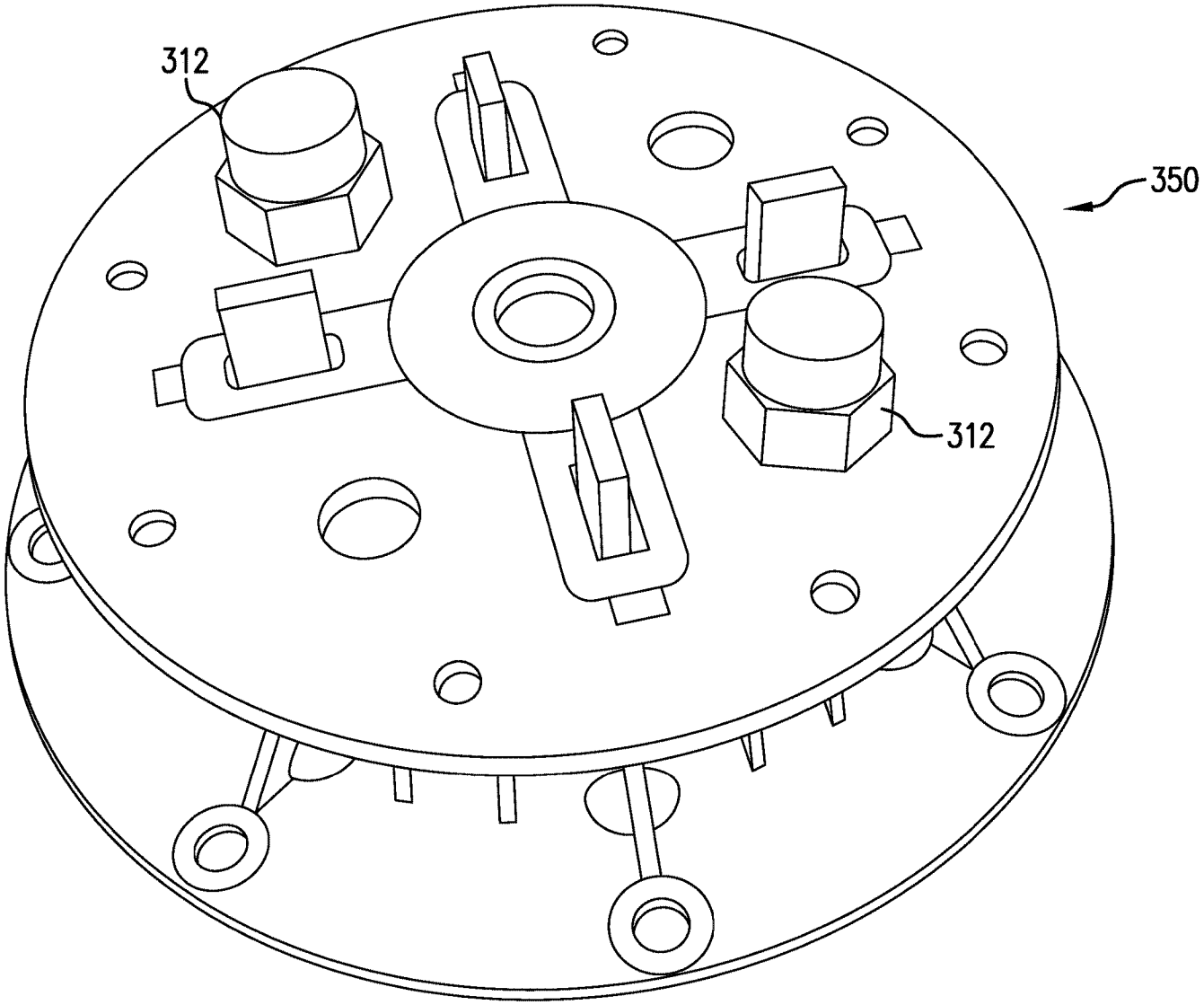
FIG. 34 is a perspective view of a first illustrative embodiment of a pedestal configured for a bottom indexing tile and support structure.
Figure 35A:
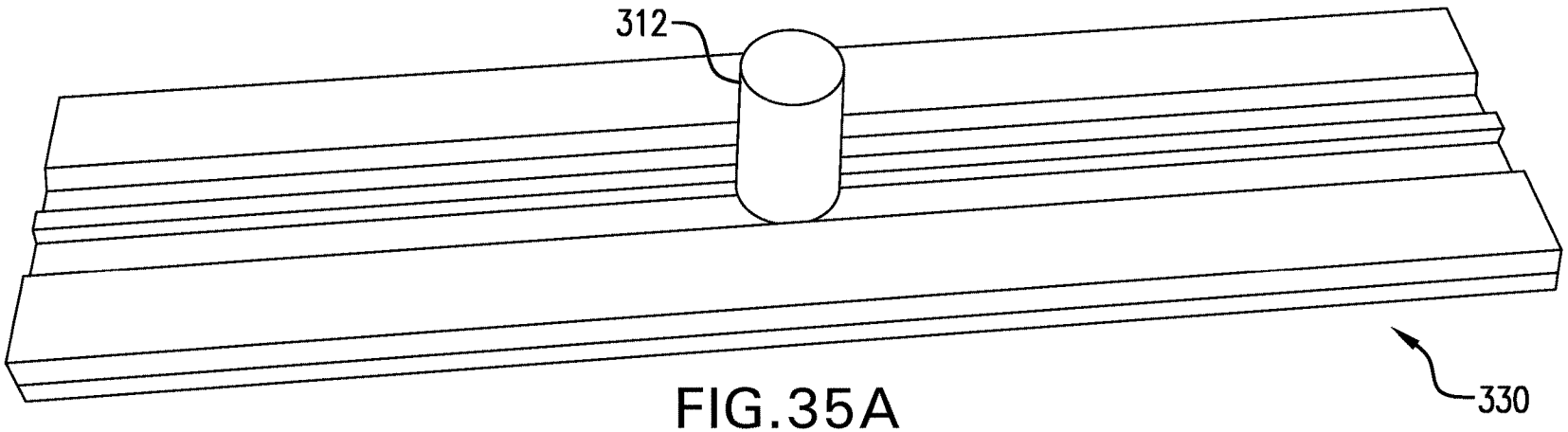
FIG. 35A is a perspective view of a first illustrative embodiment of a support structure configured for a bottom indexing tile and support structure.
Figure 35B:
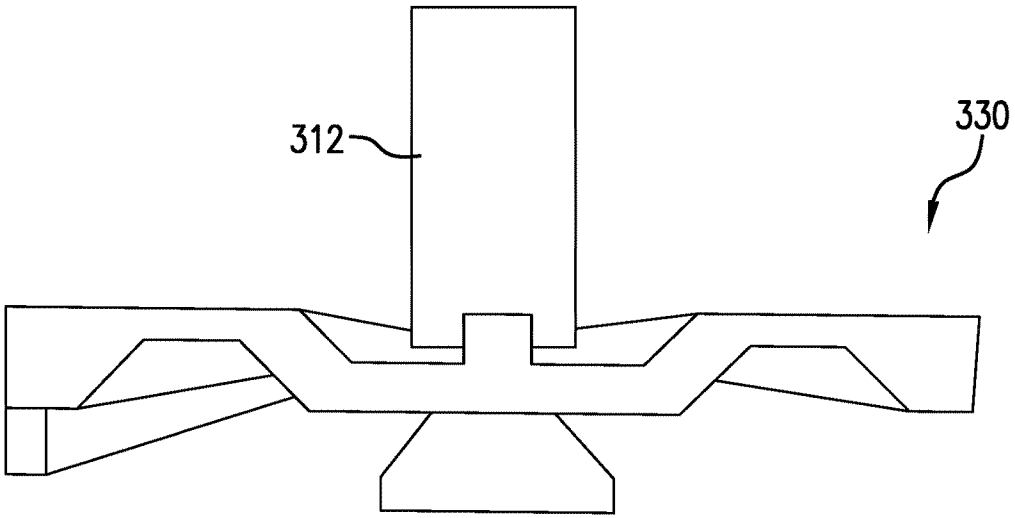
FIG. 35B is an end view of the embodiment of a support structure shown in FIG. 35A.

Referring now to FIGS. 35A & 35B, a first illustrative embodiment of a correlative bottom indexing support structure 330 having a plug 312 secured thereto is shown in perspective in FIG. 35A and an end view in FIG. 35B. Such an embodiment may function in a manner similar to that as previously described for the bottom indexing pedestal 350 having a plug 312 secured thereto and shown in FIG. 34. That is, the plug 312 of the bottom indexing support structure 330 may be inserted into a cavity 328 formed in a bottom surface of a bottom indexing tile 320 to secure the position of the bottom indexing tile 320 with respect to the plug 312 (and consequently with respect to the bottom indexing support structure 330) in three dimensions.

Figure 36B:
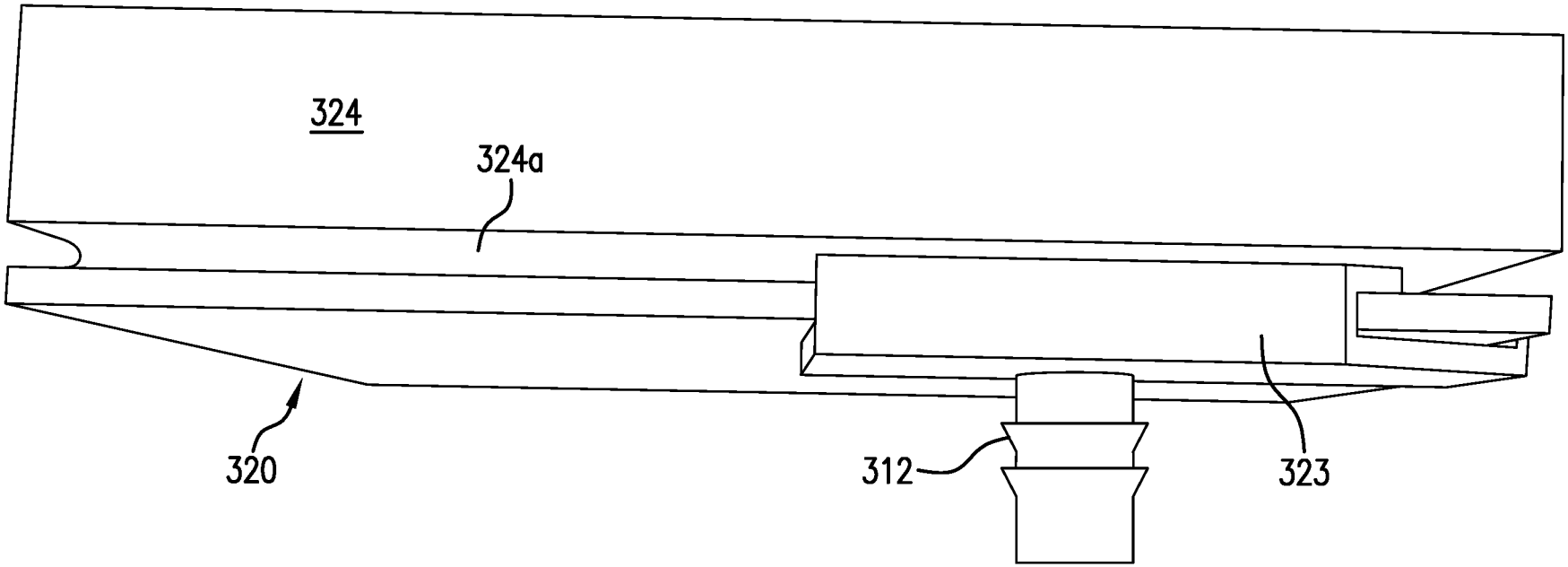
FIG. 36B is an end view of the tile shown in FIG. 36A.

As such, the bottom indexing support structure 330 shown in FIGS. 35A & 35B, bottom indexing pedestal 350 shown in FIG. 34, and/or bottom indexing tile 320 shown in FIGS. 36A & 36B may be configured to prevent wind uplift and achieve the required certifications therefor while simultaneously ensuring proper spacing between and/or among bottom indexing tiles 320 is maintained for a relatively long period of time.

Figure 37:
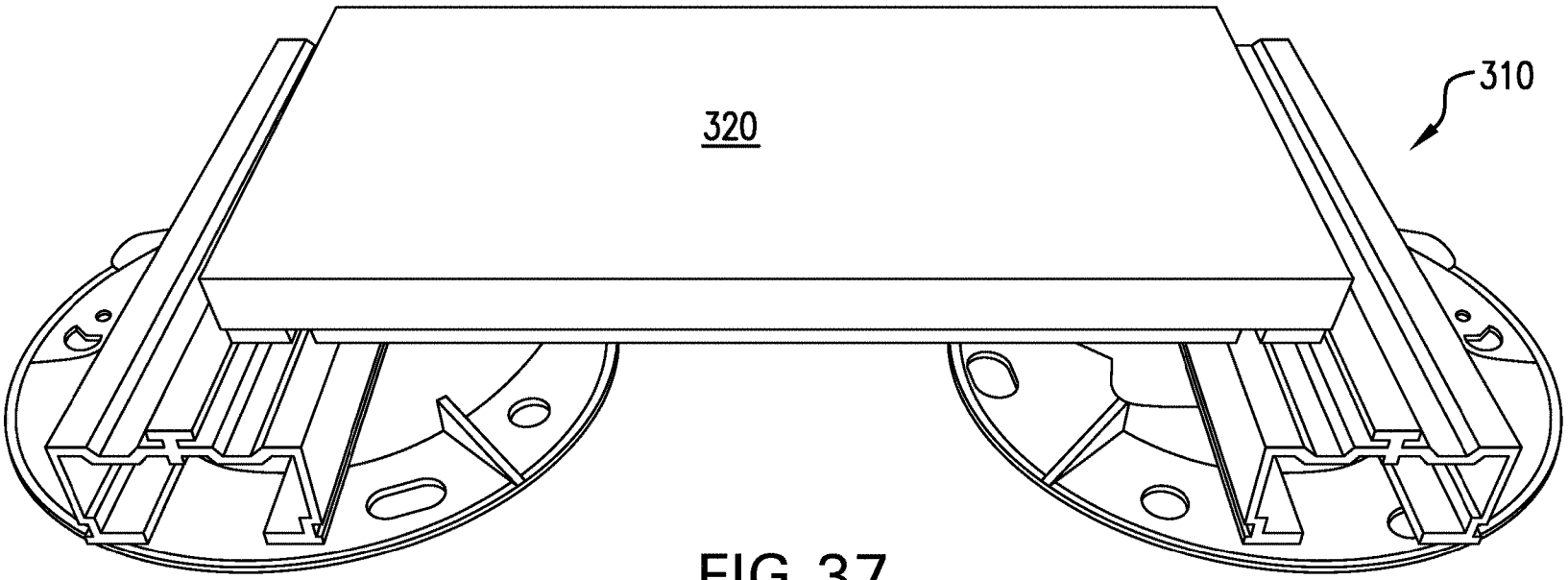
FIG. 37 is a perspective view of a second embodiment of a bottom indexing tile and support structure.

Referring now to FIGS. 37-39C, another illustrative embodiment of a bottom indexing tile and support structure 310 is shown. A perspective view of a bottom indexing tile 320 engaged with a bottom indexing support structure 330 on either edge 324 of the bottom indexing tile 320 is shown in FIG. 37. An end view of the front edge 324 of the bottom indexing tile 320 is shown in FIG. 38A and a detailed view of a portion of that edge 324 is shown in FIG. 38B. A bottom view of the bottom indexing tile 320 is shown in FIG. 38C.

Figure 38A:
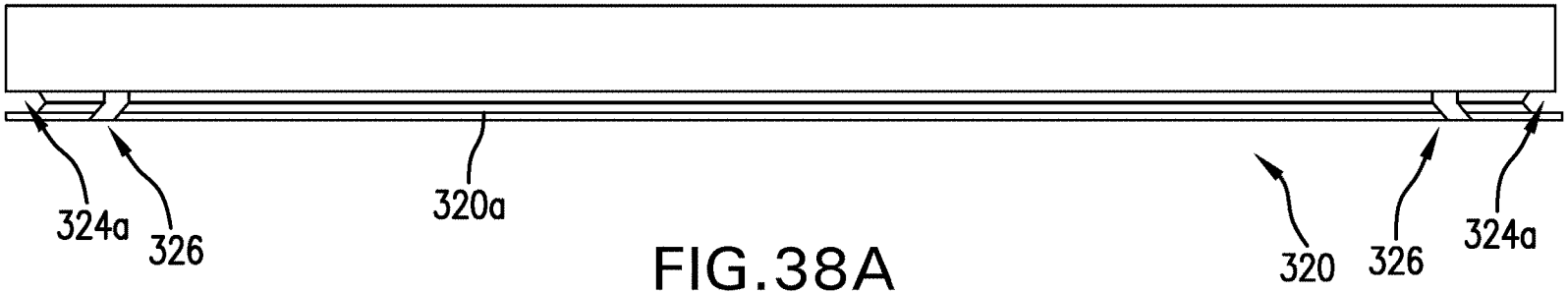
FIG. 38A is a side view of the tile shown in FIG. 37.
Figure 38B:
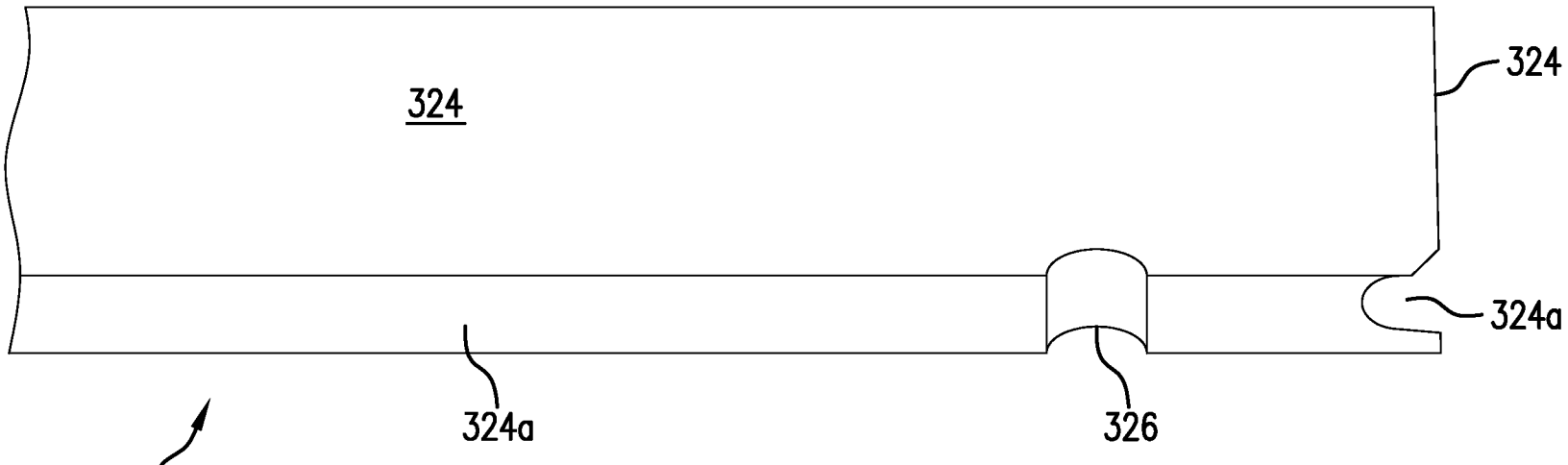
FIG. 38B is a detailed view of a portion of the tile shown in FIGS. 37 & 38A.
Figure 38C:
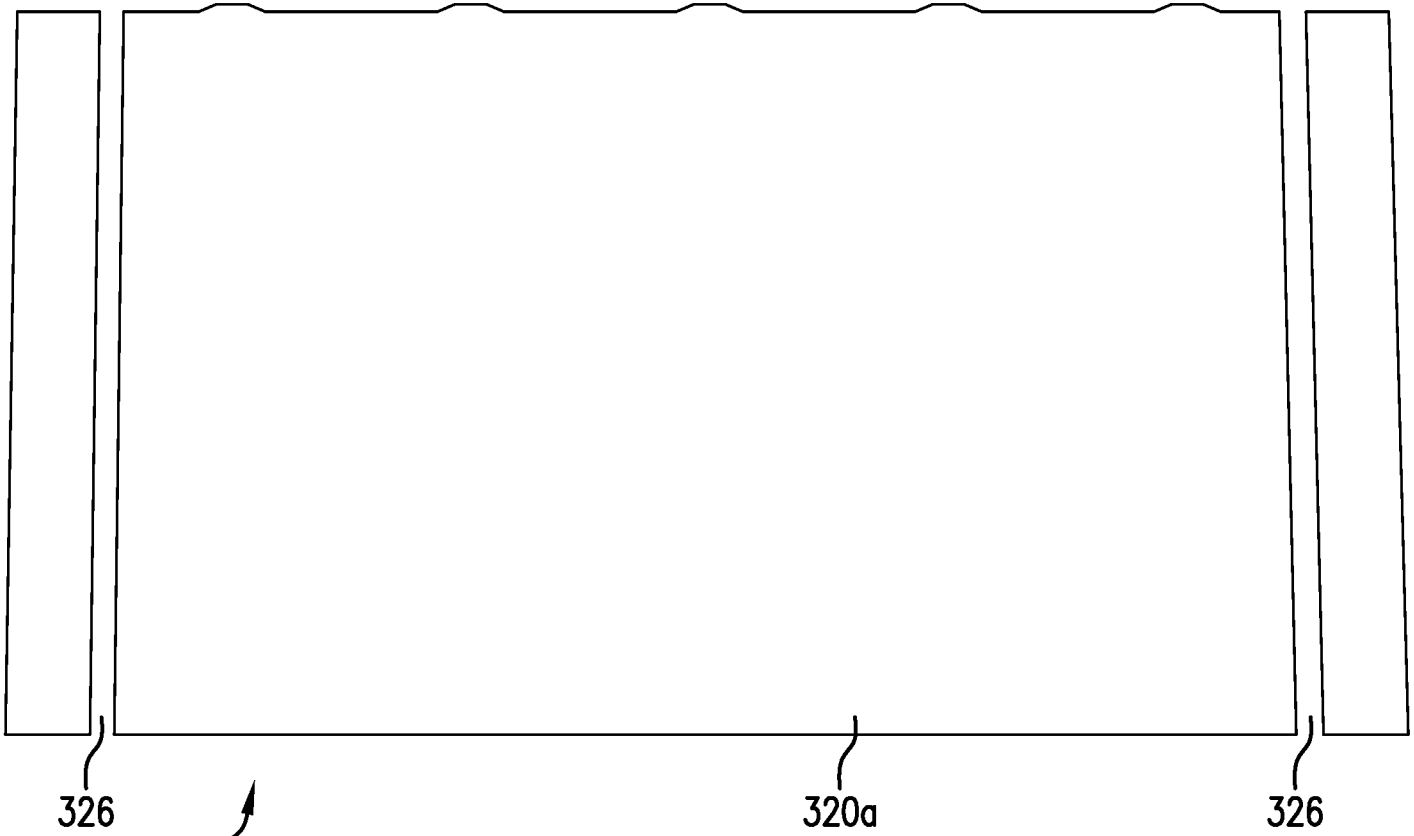
FIG. 38C is a bottom view of the tile shown in FIGS. 37, 38A, & 38B.

Generally, the bottom indexing tile 320 shown in FIGS. 37-38C may be configured as a reinforced tile 120 as previously described herein above. Also, the bottom indexing tile 320 generally may be configured with any of the various features and/or elements for a tile 20 and/or reinforced tile 120 as previously described herein above (e.g., substrate 320*a*, face 322, edge 324, groove 324*a*, protrusion 324*b*, and/or clearance 325) and which features and/or elements may have correlative functions and/or benefits of those previously described without limitation unless otherwise indicated in the following claims. Additionally, the bottom indexing tile 320 may be configured with one or more channels 326 extending along a bottom surface thereof as shown in FIGS. 38A-38C. Each channel 326 may be parallel with respect to two edges 324 and perpendicular with respect to two edges 324, and each channel 326 may terminate at the edges 324 with which the channel 326 is perpendicular with specific reference to FIG. 38C. The optimal depth of the channel 326 will vary from one application of the bottom indexing tile and support structure 310 to the next, but for certain applications it is contemplated that the depth of the channel 326 may extend through the substrate 320*a* and into a portion of the bottom indexing tile 320 adjacent the upper limit of the groove 324*a* as shown at least in FIG. 38B.

Figure 39A:
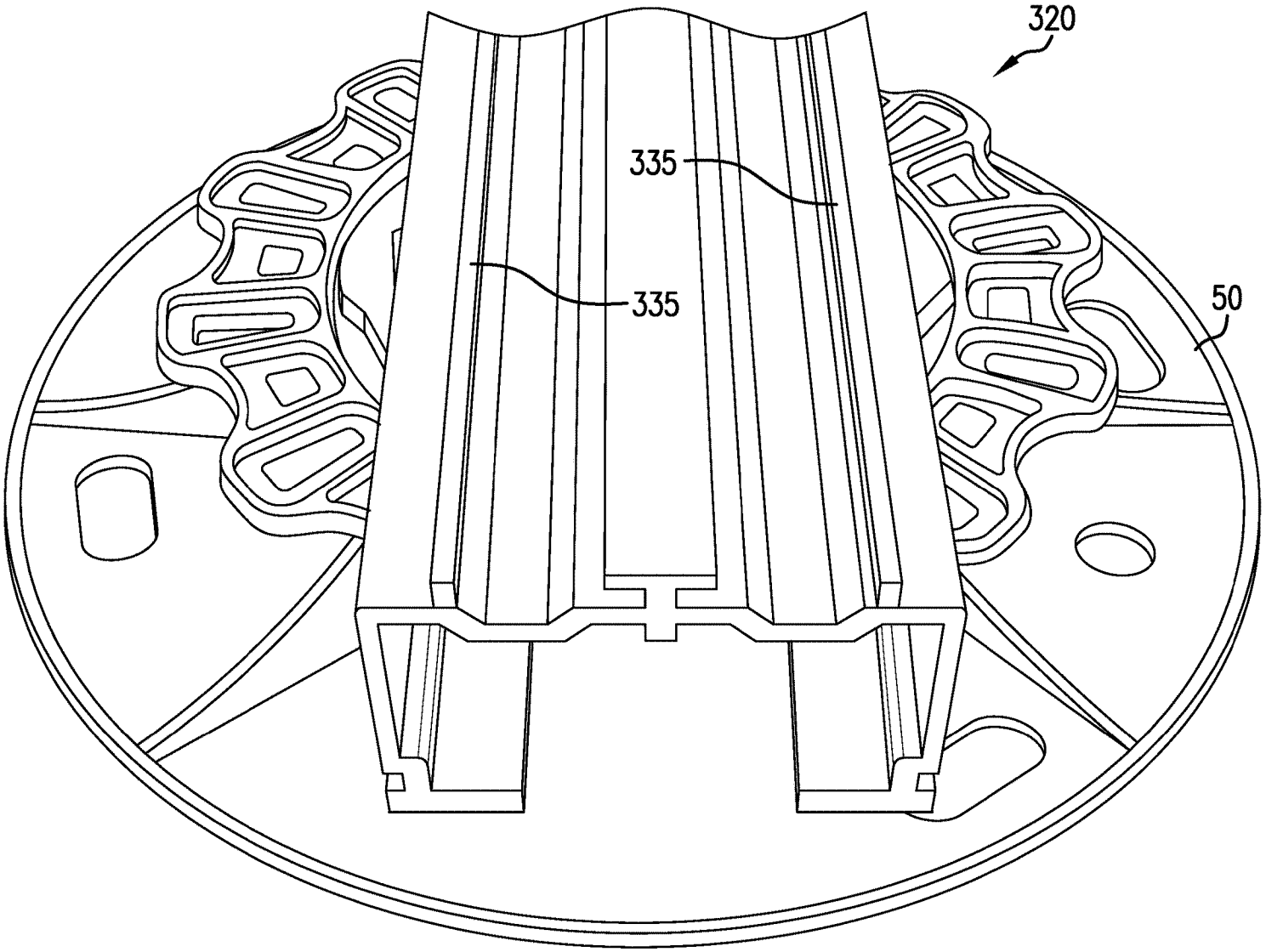
FIG. 39A is a perspective view of the support structure shown in FIG. 37.
Figure 39B:
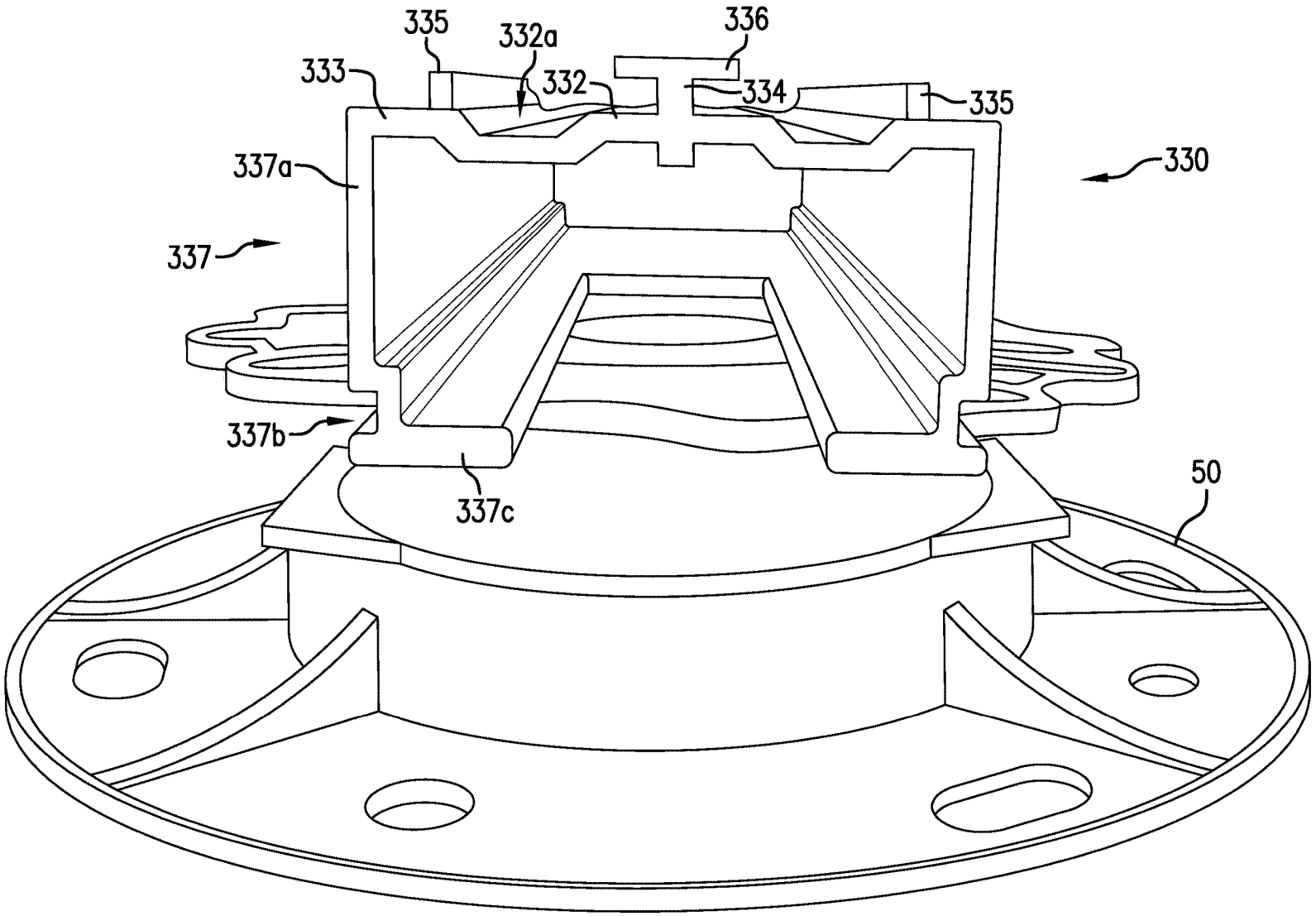
FIG. 39B is an end view of the support structure shown in FIGS. 37 & 39A.
Figure 39C:
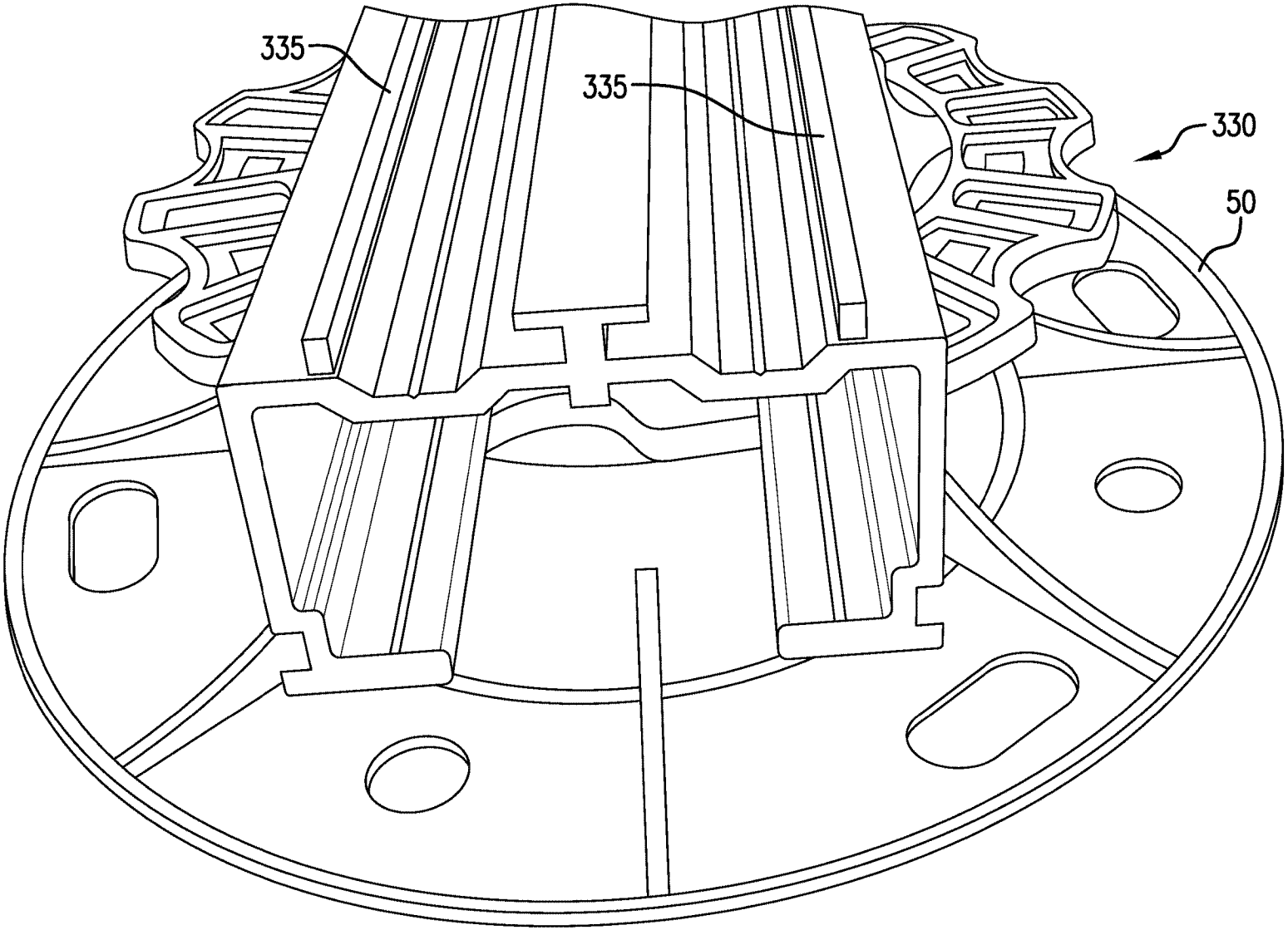
FIG. 39C is another end view of the support structure shown in FIGS. 37, 39A, & 39B.

Referring now to FIGS. 39A-39C, an illustrative embodiment of a bottom indexing support structure 330 is shown therein, wherein FIG. 39A provides a perspective view, FIG. 39B provides an end view, and FIG. 39C provides a detailed perspective view. Generally, the bottom indexing support structure 330 may be configured with any of the various features and/or elements for a support structure 30, edge support structure 30*a*, roof support structure 30', roof edge support structure 30*a*', pedestal 50, and/or support structure 130, as previously described herein above and which features and/or elements may have correlative functions and/or benefits of those previously described without limitation unless otherwise indicated in the following claims.

Additionally, an illustrative embodiment of a bottom indexing support structure 330 may be comprised of a ridge 335 extending upward from an area between the lip 333 and the trough 332*a*. The ridge 335 may be configured such that it fits within the channel 326 formed in the bottom surface of the bottom indexing tile 320 previously described and shown in FIGS. 37-38C without limitation unless otherwise indicated in the following claims. The bottom indexing support structure 330 may include two ridges 335 positioned on either side of the bottom indexing support structure 330 such that the bottom indexing support structure 330 may have a vertical line of symmetry about the spine 334. However, an edge bottom indexing support structure (not shown) may be configured with only one ridge 335 in a manner correlative to that of an edge support structure 30*a* and/or roof edge support structure 30*a*' as previously described above and without limitation unless otherwise indicated in the following claims.

Generally, the interaction between the ridge 335 and a channel 326 may allow the user to slide a bottom indexing tile 320 along the length of a bottom indexing support structure 330 in a manner correlative to that as previously described above and without limitation unless otherwise indicated in the following claims during installation of a bottom indexing tile and support structure 330. Further, the interaction between two ridges 335 on two adjacent bottom indexing support structures 330, wherein each ridge 335 is engaged with a channel 326 on a single bottom indexing tile 320 (such as the configuration shown in FIG. 37), may serve to mitigate and/or eliminate any tendency for the clearance 325 between two adjacent bottom indexing tiles 320 to shift, spread, or otherwise change over time. This is because the ridge 335 may prevent and/or mitigate movement of the bottom indexing tile 320 with respect to the bottom indexing support structure 330 in both directions of the horizontal dimension that is perpendicular with respect to the length of the bottom indexing support structure 330.

Figure 40A:
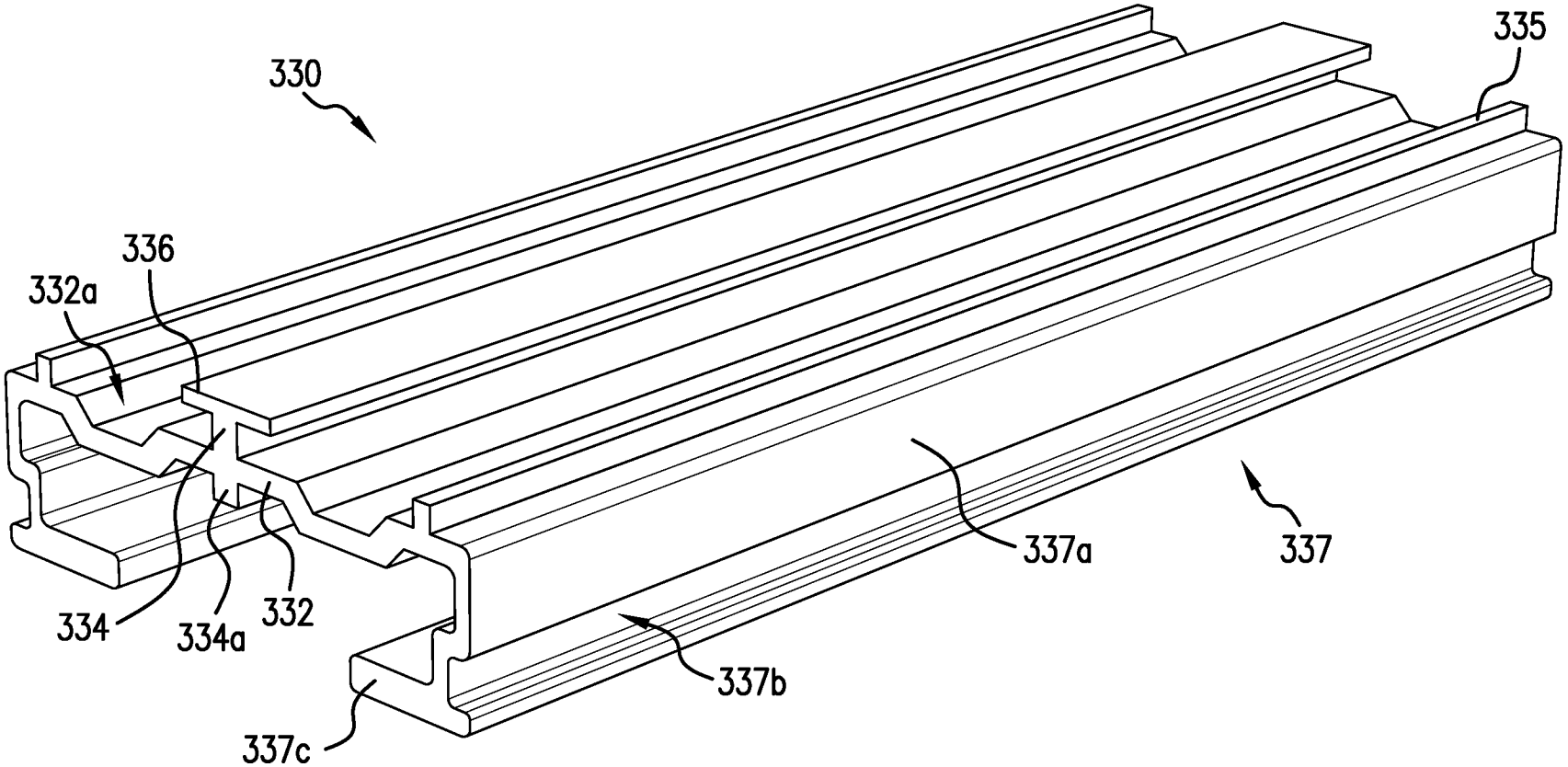
FIG. 40A is a perspective view of another illustrative embodiment of a bottom indexing support structure.
Figure 40B:
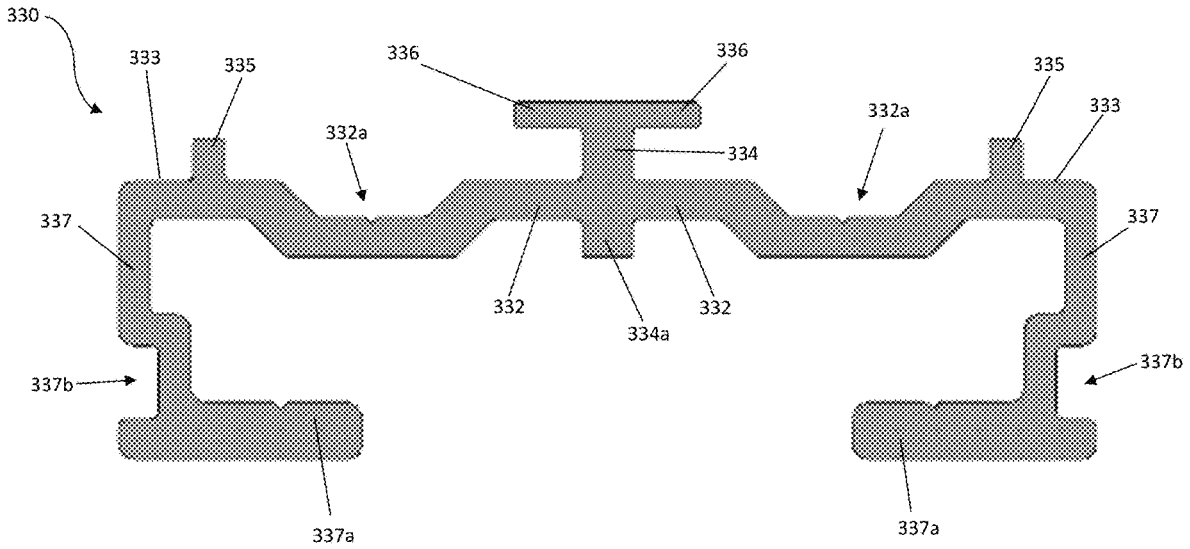
FIG. 40B is an end view of the bottom indexing support structure shown in FIG. 40A.

Additional illustrative embodiments of a bottom indexing support structure 330 are shown in FIGS. 40A-42B. A perspective view of another illustrative embodiment of a bottom indexing support structure 330 is shown in FIG. 40A and an end view thereof is shown in FIG. 40B. Generally, this embodiment of a bottom indexing support structure 330 may function in a manner similar to that previously described and shown in FIGS. 39A-39C, but with a generally lower height, which lower height may be achieved via generally shorter channel portion 337. Such an embodiment of a bottom indexing support structure 330 may be especially useful in applications wherein it may be desirable to minimize the distance between a roof or other underlying structure and the face 322 of the bottom indexing tile 320.

Figure 41A:
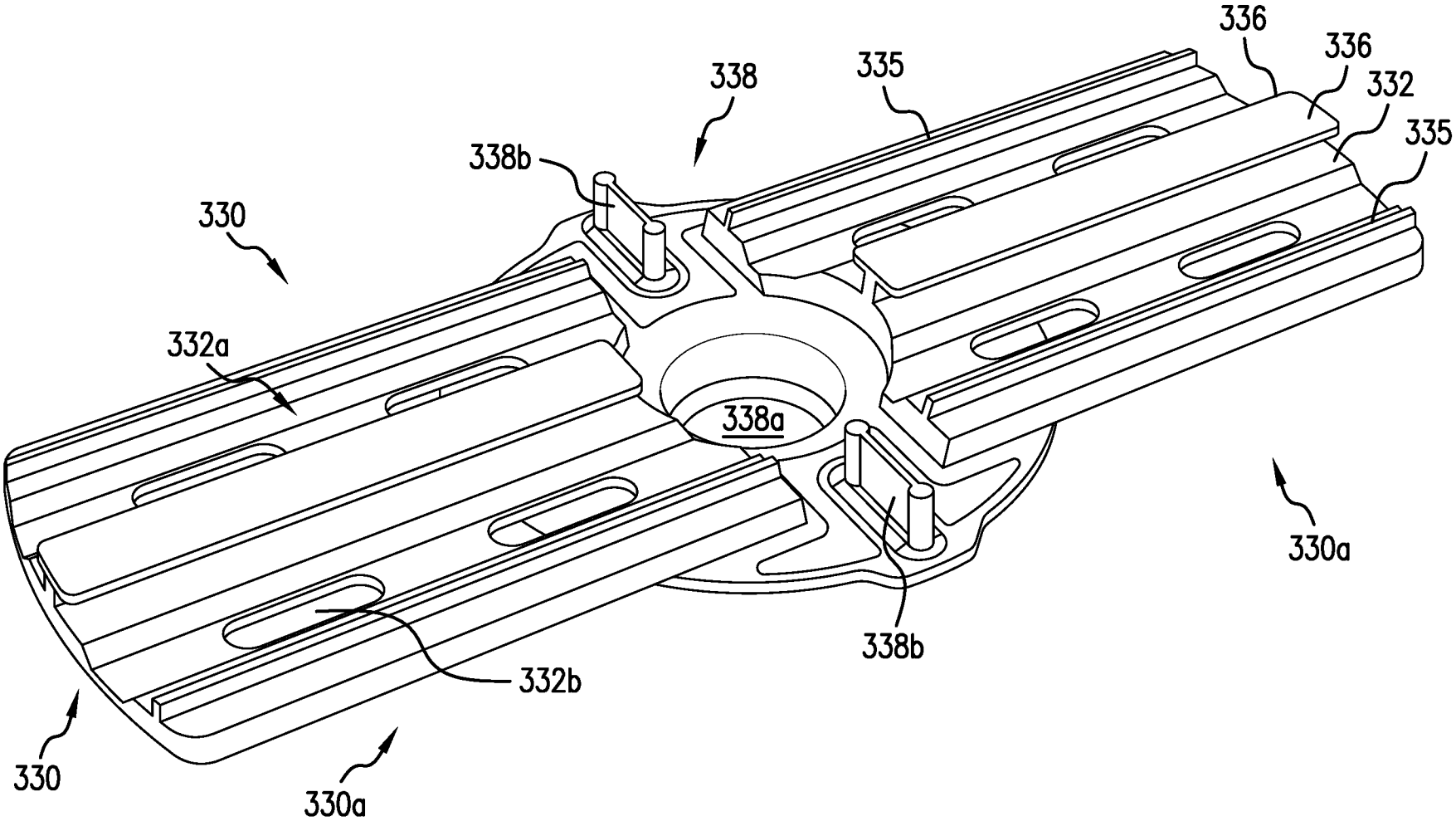
FIG. 41A is a perspective view of another illustrative embodiment of a bottom indexing support structure.
Figure 41B:
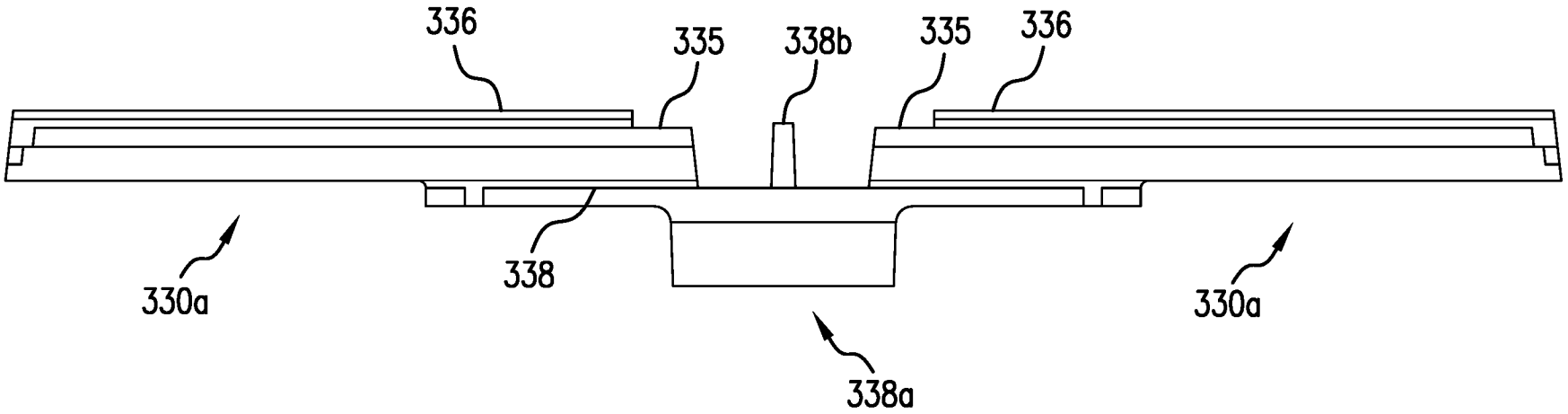
FIG. 41B is a side view of the bottom indexing support structure shown in FIG. 41A.
Figure 41C:
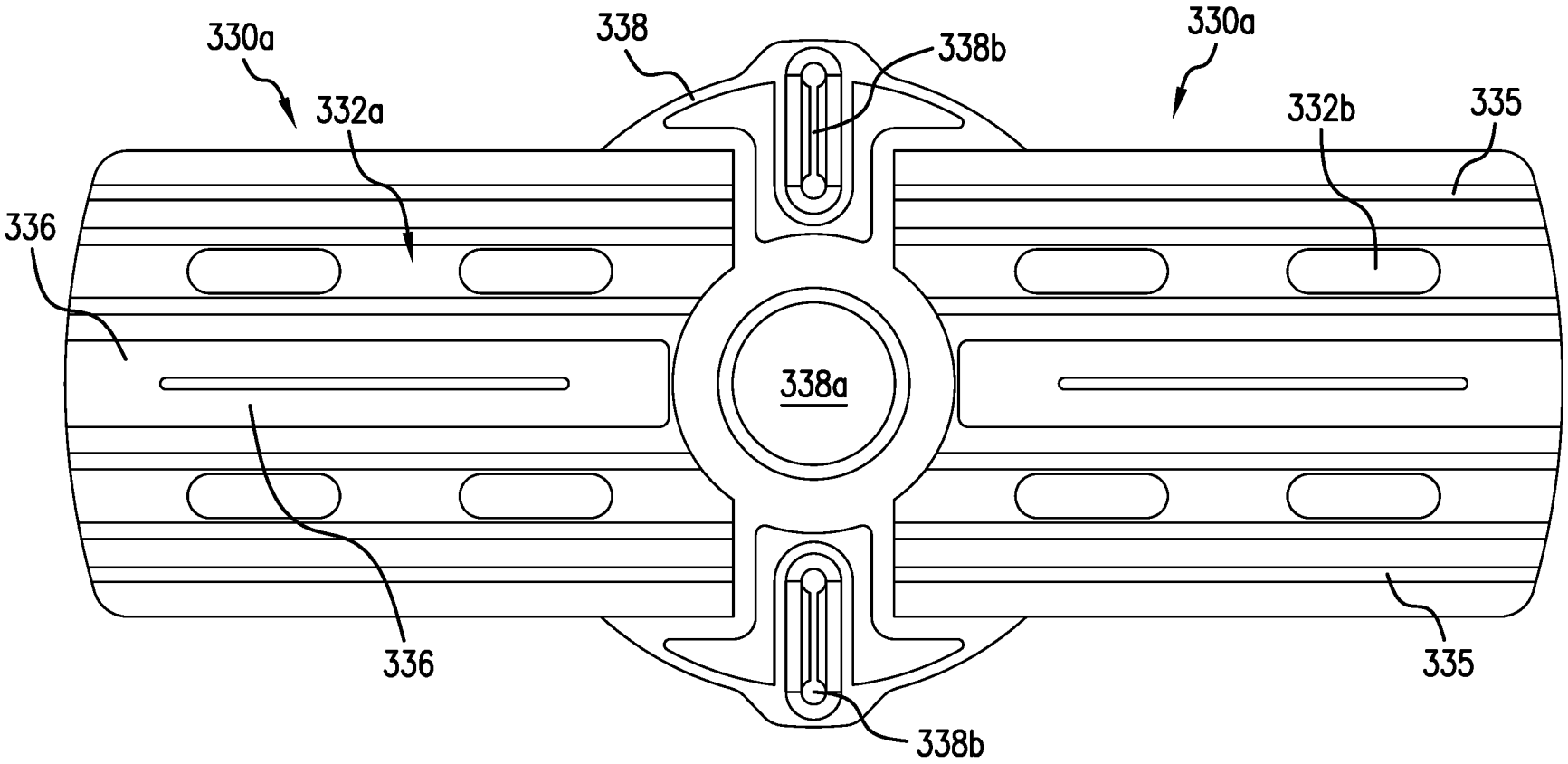
FIG. 41C is a top view of the bottom indexing support structure shown in FIGS. 41A & 41B.
Figure 42A:
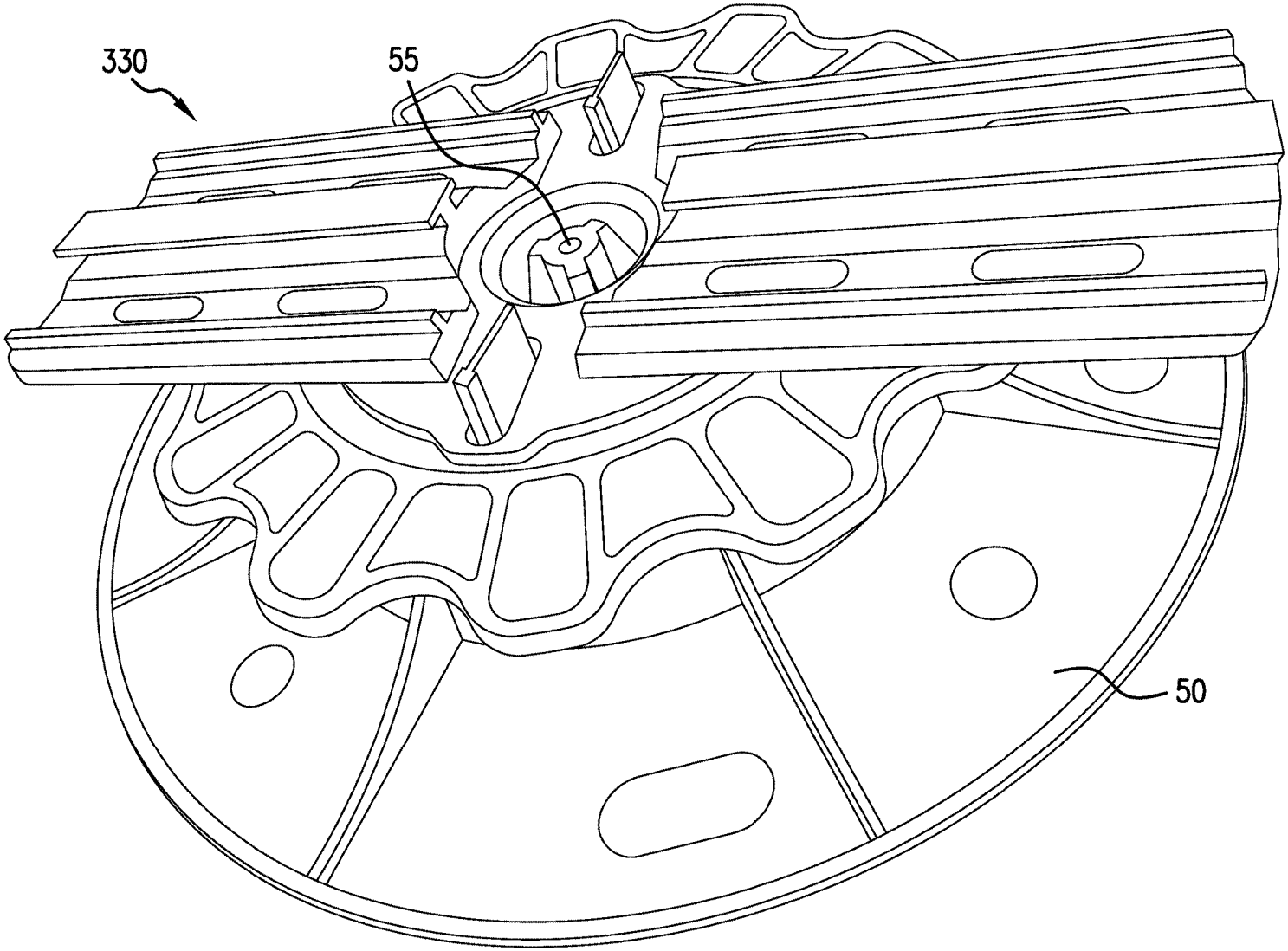
FIG. 42A is a perspective view of the bottom indexing support structure shown in FIGS. 41A-41C engaged with a pedestal.
Figure 42B:
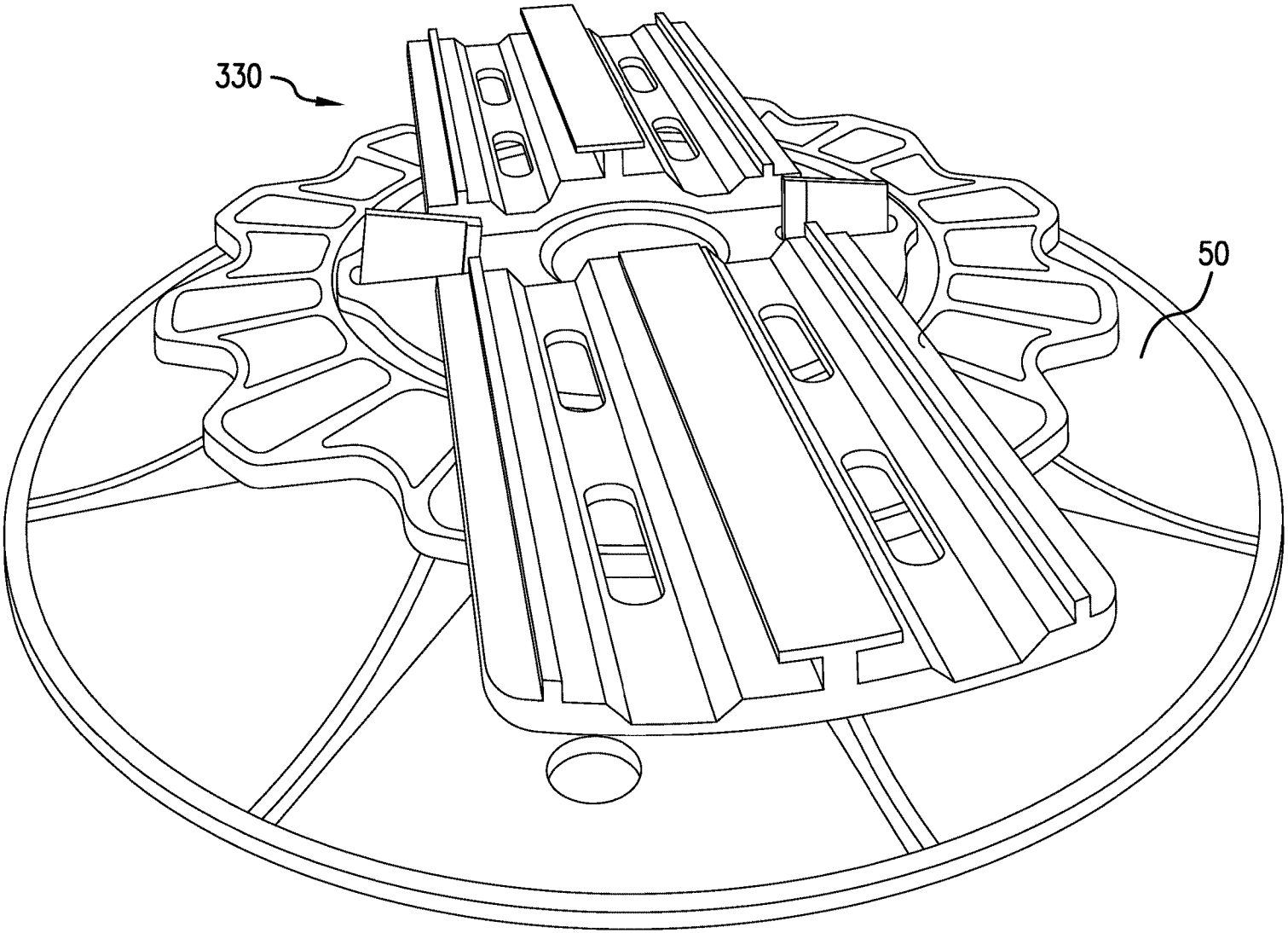
FIG. 42B is another perspective view of the bottom indexing support structure shown in FIGS. 41A-41C engaged with a pedestal.

Yet another illustrative embodiment of a bottom indexing support structure 330 is shown in FIGS. 41A-42B. Generally, this illustrative embodiment of a bottom indexing support structure 330 may function in a manner similar to and provide the benefits of those previously described herein without limitation unless otherwise indicated in the following claims. However, the illustrative embodiment of a bottom indexing support structure 330 shown in FIGS. 41A-42B may be configured to directly engage a pedestal 50, as shown in FIGS. 42A & 42B.

Referring now specifically to FIGS. 41A-41C, a bottom indexing support structure 330 may be formed with a center portion 338 having two wing portions 330*a* extending therefrom. The wing portions 338 may be symmetrical with one another, as shown, or they may be differently configured without limitation unless otherwise indicated in the following claims. The wing portions 330*a* may be formed with features generally similar to those previously described for the bottom indexing support structure 330 previously described above, which features may provide generally similar or identical functionality to corresponding features of other bottom indexing support structures 330 previously described without limitation unless otherwise indicated in the following claims. Such features include, but are not limited to a flange 332, trough 332*a*, lip 333, spine 334, ridge(s) 335, and/or rail(s) 336.

Generally, the center portion 338 may be configured to engage a pedestal 50, as best shown in FIGS. 42A & 42B. Accordingly, the center portion 338 may be formed with an aperture 338*a* formed therein such that a lug 55 adjacent the center of the pedestal 50 may pass through the aperture 338*a* and allow a user to selectively engage and disengage with bottom indexing support structure 330 with the pedestal 50. Accordingly, the shape of the center portion 338 may generally mimic the shape of the pedestal upper surface 54 (both of which are shown to be generally circular in the illustrative embodiments pictured herein but may be differently configured in other embodiments without limitation unless otherwise indicated in the following claims) without limitation unless otherwise indicated in the following claims. The aperture 338*a* may be formed at the distal end of a flange extending away from the center portion 338 in a direction generally opposite to the direction from which the ridge(s) 335 extend from the bottom indexing support structure 330. That is, the flange may extend from the center portion 338 toward a pedestal 50 with which the bottom indexing support structure 330 is engaged during use.

The center portion 338 may also be formed with one or more center walls 338*b* extending upward therefrom along a central axis of the center portion 338. The center wall(s) 338*b* may extend upward from the center portion 338 in a direction generally parallel to that in which the ridge(s) 335 extend from the bottom indexing support structure 330, and the longitudinal axis of the center walls 338*b* may be generally perpendicular to the ridge(s) 335. When a bottom indexing tile 320 (or reinforced tile 120 configured for bottom indexing) is engaged with the bottom indexing support structure 330, the center walls 338*b* may serve to limit the amount of travel that the bottom indexing tile 320 may experience with respect to the bottom indexing support structure 330 and/or pedestal 50 in at least one direction along a generally horizontal dimension in a direction parallel to the length of the ridge(s) 335. The center wall(s) 338*b* may thereby function to assist in accurately positioning one or more bottom indexing tiles 320 with respect to a pedestal 50 and/or bottom indexing support structure 330. The center wall(s) 338*b* may also function to ensure proper spacing between two adjacent edges 324 of two adjacent bottom indexing tiles 320.

Although the illustrative embodiments of a bottom indexing support structure 330 shown in FIGS. 39A-42B are shown configured similar to a roof support structure 30' and may be engaged with a typical pedestal 50, the scope of the bottom indexing support structure 330 is not so limited and extends to the relevant features and/or structures of a bottom indexing support structure 330 integrated into a pedestal upper surface 354 of a bottom indexing pedestal 350 in a manner correlative to the pedestals 50 shown in FIGS. 19A-23A without limitation unless otherwise indicated in the following claims. Additionally, the scope of the bottom indexing support structure 330 extends to embodiments thereof having a lower height profile than the illustrative embodiments thereof shown in FIGS. 39A-42B. Such a lower height profile may be configured by removing the channel portion 337 (and, consequently, without side members 337*a*, notches 337*b*, and/or bottom members 337*c*) as shown in FIGS. 41A-42B. It is contemplated that a lower height profile embodiment of a bottom indexing support structure 330 may be directly integrated into a pedestal upper surface 354 of a bottom indexing pedestal 350 or it may be selectively secured to a pedestal upper surface 354 of a bottom indexing pedestal 350 in any manner correlative to that previously described above in reference to at least FIGS. 13-15B without limitation unless otherwise indicated in the following claims.

Although the illustrative embodiments of a bottom indexing tile and support structure 310 shown in FIGS. 34-42B employ a bottom indexing tile 320 (which may be configured with a substrate 320*a* such that it may constitute a reinforced tile 120 that is configured for use with a bottom indexing support structure 330), the scope of the present disclosure is not so limited unless otherwise indicated in the following claims. Accordingly, the bottom indexing support structures 330 disclosed herein may be configured for use with any suitable blocks, pavers, and/or tiles, including but not limited to concrete pavers, Ipe tiles/pavers, and/or any other type of tile and/or paver currently known or later developed that may be used with patios, pedestals, roofing applications, and/or decking without limitation unless otherwise indicated in the following claims.

Furthermore, although various benefits/features of the illustrative embodiments of the bottom indexing tile & support structure 310 have been described herein in accordance with a rooftop application, the scope of the present disclosure is not so limited unless otherwise indicated in the following claims. For example, the bottom indexing tile & support structure 310 may be configured for use with interior raised floors, on joist framed decks, raised patios, etc., or any other suitable application without limitation unless otherwise limited in the following claims.

From the preceding detailed description, it will be apparent to those of ordinary skill in the art that the present disclosure provides many benefits over the prior art. Some of those benefits include, but are not limited to: (1) the ability to provide a deck 12, patio, stairs, steps, risers, facades, ventilated facades, interior walls, exterior walls, border, roof, or other surface having tiles 20 without the need for grout and/or other sealer; (2) the ability to provide a deck 12, patio, roof, or other surface that is virtually maintenance free; (3) the ability to provide a deck 12, patio, roof, or other surface that mitigates and/or eliminates puddling even when the surface is level and/or nearly level; (4) the ability to provide a more robust deck 12, patio, roof, or other surface that is not affected by typical freeze/thaw cycles; (5) the ability to allow a certain, predetermined amount of relative movement between tiles 20, tiles 20 and support structures 30, tiles 20 and joists 14, and/or tiles 20 and other structures without damaging the tiles 20; and, (6) the ability to suspend a tile surface using properly configured pedestals 50 and thereby securing each tile 20 in one, two, and/or three dimensions (which may properly secure each tile 20 and prevent and/or mitigate wind uplift).

Although the descriptions of the illustrative aspects of the present disclosure have been quite specific, it is contemplated that various modifications could be made without deviating from the spirit and scope of the present disclosure. Accordingly, the scope of the present disclosure is not limited by the description of the illustrative aspects and/or corresponding figures unless so indicated in the following claims.

The number, configuration, dimensions, geometries, and/or relative locations of the various elements of the tile 20, bottom indexing tile 320, pedestal 50, bottom indexing pedestal 350, spine 34, rail 36, support structure 30, and/or bottom indexing support structure 330 will vary from one aspect of the present disclosure to the next, as will the optimal configuration thereof. Accordingly, the present disclosure is in no way limited by the specific configurations, dimensions, and/or other constraints of those elements unless so indicated in the following claims.

In the foregoing detailed description, various features are grouped together in a single embodiment for purposes of streamlining the disclosure. This method of disclosure is not to be interpreted as reflecting an intention that the present disclosure requires more features than are expressly recited in each claim. Rather, as the following claims reflect, inventive aspects lie in less than all features of a single foregoing disclosed embodiment. Thus, the following claims are hereby incorporated into this detailed description, with each claim standing on its own as a separate embodiment.

The materials used to construct the tile and support system 10 and/or bottom indexing tile and support system 310 and various elements and/or components thereof will vary depending on the specific application thereof, but it is contemplated that polymers, metals, metal alloys, natural materials, stone, cement, ceramics, fibrous materials, and/or combinations thereof may be especially useful for the tile and support system 10 and/or bottom indexing tile and support system 310 in some applications. Accordingly, the above-referenced elements may be constructed of any material known to those skilled in the art or later developed, which material is appropriate for the specific application of the present disclosure without departing from the spirit and scope of the present disclosure unless so indicated in the following claims.

Having described the preferred embodiments of the various methods and apparatuses, other features of the present disclosure will undoubtedly occur to those versed in the art, as will numerous modifications and alterations in the various aspects as illustrated herein, all of which may be achieved without departing from the spirit and scope of the present disclosure. Accordingly, the methods and embodiments pictured and described herein are for illustrative purposes only, and the scope of the present disclosure extends to all method and/or structures for providing the various benefits and/or features of the present disclosure unless so indicated in the following claims. Furthermore, the methods and embodiments pictured and described herein are no way limiting to the scope of the present disclosure unless so stated in the following claims.

Although several figures are drawn to accurate scale, any dimensions provided herein are for illustrative purposes only and in no way limit the scope of the present disclosure unless so indicated in the following claims. It should be noted that the tile and support structure 10, bottom indexing tile and support system 310, pedestal 50, bottom indexing pedestal 350, spine 34, rail 36, wing portion 330*a*, base 331, flange 332, ridge 335, etc., and/or components thereof are not limited to the specific embodiments pictured and described herein, but are intended to apply to all similar apparatuses and methods positioning and/or retaining tile(s) 20, bottom indexing tiles 320, pavers, blocks, decking, etc. without limitation unless otherwise indicated in the following claims. Modifications and alterations from the described embodiments will occur to those skilled in the art without departure from the spirit and scope of the present disclosure.

Any of the various features, functionalities, aspects, configurations, etc. for the tiles 20, bottom indexing tiles 320, support structure 30, bottom indexing support structure 330, spine 34, rail 36, roof support structure 30', inner member 40, bottom indexing pedestal 350, and/or pedestal 50, retaining element 60, 60', and/or components of any of the foregoing may be used alone or in combination with one another (depending on the compatibility of the features) from one embodiment and/or aspect of the tile and support system 10 and/or bottom indexing tile and support system 310 to the next. Accordingly, a nearly infinite number of variations of the tile and support system 10 and/or bottom indexing tile and support system 310 exists. All of these different combinations constitute various alternative aspects of the tile and support system 10 and/or bottom indexing tile and support system 310. The embodiments described herein explain the best modes known for practicing the tile and support system 10 and/or bottom indexing tile and support system 310 and will enable others skilled in the art to utilize the same. The claims are to be construed to include alternative embodiments to the extent permitted by the prior art. Modifications and/or substitutions of one feature for another in no way limit the scope of the tile and support system 10, and/or bottom indexing tile and support system 310, and/or component thereof unless so indicated in the following claims.

It is understood that the present disclosure extends to all alternative combinations of one or more of the individual features mentioned, evident from the text and/or drawings, and/or inherently disclosed. All of these different combinations constitute various alternative aspects of the present disclosure and/or components thereof. The embodiments described herein explain the best modes known for practicing the apparatuses, methods, and/or components disclosed herein and will enable others skilled in the art to utilize the same. The claims are to be construed to include alternative embodiments to the extent permitted by the prior art.

While the tiles 20, bottom indexing tiles 320, support structure 30, bottom indexing support structure 330, spine 34, rail 36, roof support structure 30', inner member 40 and/or pedestal 50, bottom indexing pedestal 350, retaining element 60, 60', and/or components thereof and/or methods of using same have been described in connection with preferred aspects and specific examples, it is not intended that the scope be limited to the particular embodiments and/or aspects set forth, as the embodiments and/or aspects herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: matters of logic with respect to arrangement of steps or operational flow; plain meaning derived from grammatical organization or punctuation; the number or type of embodiments described in the specification.

It should be noted that the present disclosure is not limited to the specific embodiments pictured and described herein, but are intended to apply to all similar apparatuses and methods for arranging, securing, engaging tiles 20, bottom indexing tiles 320, pavers, blocks, and/or the like, and/or otherwise providing any of the features and/or advantages of any aspect of the present disclosure. Modifications and alterations from the described embodiments will occur to those skilled in the art without departure from the spirit and scope of the present disclosure.

What is claimed is:

1. A bottom indexing support structure comprising:

a. a base having a first flange extending horizontally, wherein a distal end of said first flange is secured to a top edge of a first side member;

b. a spine engaged with said base, wherein said spine extends upward from a center of said base, and wherein said spine is generally perpendicular with respect to said base;

c. a first rail extending from a terminal end of said spine, wherein said first rail is generally perpendicular with respect to said spine;

d. a second rail extending from said terminal end of said spine, wherein said second rail is generally perpendicular with respect to said spine;

e. a first ridge extending upward from said first flange in an area between said distal end of said first flange and said spine;

f. at least one bottom indexing tile configured to engage a bottom indexing support structure, said at least one bottom indexing tile comprising:

i. a first face configured to be generally facing upward during use;

ii. a second face configured to be generally facing downward during use, wherein said first face and said second face are opposite one another, wherein said second face is generally horizontally oriented, and wherein said first face and said second face are separated by a thickness of said bottom indexing tile defined by a first, second, third, and fourth edge of said bottom indexing tile;

iii. a channel formed in said second face and extending upward toward said first face, wherein said channel extends from said first edge to said second edge of said bottom indexing tile, and wherein a width of said channel is greater than a width of said ridge such that said bottom indexing tile may slide along a length of said bottom indexing support structure when said ridge is positioned in said channel;

iv. a groove formed in said first edge of said bottom indexing tile, wherein said groove extends inward from said first edge, wherein a depth of said channel is generally perpendicular to a depth of said groove, and wherein said first rail is engaged with said groove such that said bottom indexing tile may move with respect to said bottom indexing support structure in a dimension parallel with respect to said length of said bottom indexing support structure as said ridge engages said channel, and simultaneously such that said bottom indexing tile is prevented from moving with respect to said bottom indexing support structure in a dimension perpendicular with respect to said length of said bottom indexing support structure such that said bottom indexing can be engaged with said first rail and said ridge only in said dimension parallel with respect to said length of said bottom indexing support structure; and, v. a clearance formed between the edges of said at least one bottom indexing tile and an edge of an adjacent bottom indexing tile.

2. The bottom indexing support structure according to claim 1 further comprising a second flange extending horizontally from said base, wherein a distal end of said second flange is secured to a top edge of a second side member, and wherein said support structure is generally symmetrical about a plane perpendicularly oriented with respect to said first and second rails and bisecting said spine.

3. The bottom indexing support structure according to claim 2 further comprising a second ridge extending upward from said second flange in an area between said distal end of said second flange and said spine.

4. The bottom indexing support structure according to claim 3 further comprising a trough formed between said first ridge and said spine.

5. The bottom indexing support structure according to claim 4 wherein said bottom indexing tile further comprises a second channel formed in said second face.

6. The bottom indexing support structure according to claim 5 wherein said first face and said second face of said bottom indexing tile are further defined as being generally rectangular in shape and wherein said channel and said second channel are generally parallel with respect to one another.

7. The bottom indexing support structure according to claim 2 wherein said bottom indexing support structure is further defined as being engaged with a pedestal.

8. A support structure comprising:

g. a channel portion comprising:

i. a first side member that is generally vertically oriented;

ii. a second side member that is generally vertically oriented and parallel to said first side member;

h. a support structure comprising:

i. a base having a first flange and a second flange extending horizontally, wherein a distal end of said first flange is secured to a top edge of said first side member, wherein a distal end of said second flange is secured to a top edge of said second side member;

ii. a spine engaged with said base, wherein said spine extends upward from a center of said base, and wherein said spine is generally perpendicular with respect to said base;

iii. a first rail extending from a terminal end of said spine, wherein said first rail is generally perpendicular with respect to said spine;

iv. a second rail extending from said terminal end of said spine, wherein said second rail is generally perpendicular with respect to said spine, wherein said support structure is generally symmetrical about a plane perpendicularly oriented with respect to said first and second rails and bisecting said spine; and, v. a first ridge extending upward from said first flange in an area between said distal end of said first flange and said spine;

vi. at least one bottom indexing tile configured to engage a bottom indexing support structure, said at least one bottom indexing tile comprising:

1. a first face configured to be generally facing upward during use, 2. a second face configured to be generally facing downward during use, wherein said first face and said second face are opposite one another, wherein said second face is generally horizontally oriented, and wherein said first face and said second face are separated by a thickness of said bottom indexing tile defined by a first, second, third, and fourth edge of said bottom indexing tile;

3. a channel formed in said second face and extending upward toward said first face, wherein said channel extends from said first edge to said second edge of said bottom indexing tile, and wherein a width of said channel is greater than a width of said first ridge such that said bottom indexing tile may slide along a length of said bottom indexing support structure when said first ridge is positioned in said channel;
4. a groove formed in said first edge of said bottom indexing tile, wherein said groove extends inward from said first edge, wherein a depth of said channel is generally perpendicular to a depth of said groove, and wherein said first rail is engaged with said groove such that said bottom indexing tile may move with respect to said bottom indexing support structure in a dimension parallel with respect to said length of said bottom indexing support structure as said ridge engages said channel, and simultaneously such that said bottom indexing tile is prevented from moving with respect to said bottom indexing support structure in a dimension perpendicular with respect to said length of said bottom indexing support structure such that said bottom indexing can be engaged with said first rail and said ridge only in said dimension parallel with respect to said length of said bottom indexing support structure; and,
5. a clearance formed between the edges of said at least one bottom indexing tile and an edge of an adjacent bottom indexing tile.

9. The support structure according to claim 8 further comprising a second ridge extending upward from said second flange in an area between said distal end of said second flange and said spine.

10. The support structure according to claim 9 further comprising a trough formed between said first ridge and said spine.

11. The support structure according to claim 8 wherein said tile further comprises a second channel formed in said second face.

12. The support structure according to claim 11 wherein said first face and said second face of said tile are further defined as being generally rectangular in shape and wherein said channel and said second channel are generally parallel with respect to one another.

13. The support structure according to claim 8 wherein said support structure is further defined as being engaged with a pedestal.

14. A bottom indexing support structure comprising:

i. a base having a first flange extending horizontally, wherein a distal end of said first flange is secured to a top edge of a first side member;
j. a spine engaged with said base, wherein said spine extends upward from a center of said base, wherein said spine is generally perpendicular with respect to said base, wherein said spine has a top surface and said top surface of said spine is flat;
k. a first rail extending from a terminal end of said spine, wherein said first rail is generally perpendicular with respect to said spine;
l. a second rail extending from said terminal end of said spine, wherein said second rail is generally perpendicular with respect to said spine;
m. a first ridge extending upward from said first flange in an area between said distal end of said first flange and said spine;
n. a bottom indexing tile configured to engage a bottom indexing support structure, said bottom indexing tile comprising:
   i. a first face configured to be generally facing upward during use;
   ii. a second face configured to be generally facing downward during use, wherein said first face and said second face are opposite one another, wherein said second face is generally horizontally oriented, and wherein said first face and said second face are separated by a thickness of said bottom indexing tile defined by a first, second, third, and fourth edge of said bottom indexing tile;
   iii. a channel formed in said second face and extending upward toward said first face, wherein said channel extends from said first edge to said second edge of said bottom indexing tile, and wherein a width of said channel is greater than a width of said ridge such that said bottom indexing tile may slide along a length of said bottom indexing support structure when said ridge is positioned in said channel;
   iv. a groove formed in said first edge of said bottom indexing tile, wherein said groove extends inward from said first edge, wherein a depth of said channel is generally perpendicular to a depth of said groove, and wherein said first rail is engaged with said groove such that said bottom indexing tile may move with respect to said bottom indexing support structure in a dimension parallel with respect to said length of said bottom indexing support structure as said ridge engages said channel, and simultaneously such that said bottom indexing tile is prevented from moving with respect to said bottom indexing support structure in a dimension perpendicular with respect to said length of said bottom indexing support structure such that said bottom indexing can be engaged with said first rail and said ridge only in said dimension parallel with respect to said length of said bottom indexing support structure; and,
   v. a clearance positioned between the edges of said bottom indexing tile and an edge of an adjacent bottom indexing tile.

15. The bottom indexing support structure according to claim 14 further comprising a second flange extending horizontally from said base, wherein a distal end of said second flange is secured to a top edge of a second side member, and wherein said support structure is generally symmetrical about a plane perpendicularly oriented with respect to said first and second rails and bisecting said spine.

16. The bottom indexing support structure according to claim 15 further comprising a second ridge extending upward from said second flange in an area between said distal end of said second flange and said spine.

17. The bottom indexing support structure according to claim 16 further comprising a trough formed between said first ridge and said spine.

18. The bottom indexing support structure according to claim 16 wherein said bottom indexing tile further comprises a second channel formed in said second face.

19. The bottom indexing support structure according to claim 18 wherein said first face and said second face of said bottom indexing tile are further defined as being generally rectangular in shape and wherein said channel and said second channel are generally parallel with respect to one another.

20. The bottom indexing support structure according to claim 14 wherein said bottom indexing support structure is further defined as being engaged with a pedestal.

21. The bottom indexing support structure according to claim 15 wherein said bottom indexing support structure is further defined as being engaged with a pedestal.

* * * * *